US006903060B1

(12) United States Patent
Dykstra et al.

(10) Patent No.: US 6,903,060 B1
(45) **Date of Patent: *Jun. 7, 2005**

(54) STABLE FORMULATION COMPONENTS, COMPOSITIONS AND LAUNDRY METHODS EMPLOYING SAME

(75) Inventors: Robert Richard Dykstra, Cleves, OH (US); Penny Sue Weed, Erlanger, KY (US)

(73) Assignee: Procter & Gamble Company, Cincinnati, OH (US)

( * ) Notice: Subject to any disclaimer, the term of this patent is extended or adjusted under 35 U.S.C. 154(b) by 336 days.

This patent is subject to a terminal disclaimer.

(21) Appl. No.: 10/069,634

(22) PCT Filed: Aug. 25, 2000

(86) PCT No.: PCT/US00/23317

§ 371 (c)(1),
(2), (4) Date: Feb. 26, 2002

(87) PCT Pub. No.: WO01/16274

PCT Pub. Date: Mar. 8, 2001

Related U.S. Application Data

(60) Provisional application No. 60/151,176, filed on Aug. 27, 1999.

(51) Int. Cl.[7] ..... C11D 3/26; C11D 3/39; C11D 3/395

(52) U.S. Cl. ..... 510/314; 510/303; 510/309; 510/310; 510/336; 510/337; 510/351; 510/352; 510/372; 510/376; 510/504; 502/200; 564/271

(58) Field of Search ..... 510/303, 304, 510/309, 310, 314, 336, 337, 351, 352, 372, 376, 504; 502/200; 564/271; 8/111

(56) References Cited

U.S. PATENT DOCUMENTS

| | | | |
|---|---|---|---|
| 4,096,141 | A | 6/1978 | Milkowski et al. |
| 4,194,987 | A | 3/1980 | Brubaker |
| 4,325,957 | A | 4/1982 | Zeugner et al. |
| 4,505,908 | A | 3/1985 | Zeugner et al. |
| 4,595,531 | A | 6/1986 | Milkowski et al. |
| 5,041,232 | A | 8/1991 | Batal et al. |
| 5,045,223 | A | 9/1991 | Batal et al. |
| 5,047,163 | A | 9/1991 | Batal et al. |
| 5,310,925 | A | 5/1994 | Batal et al. |
| 5,360,568 | A | 11/1994 | Madison et al. |
| 5,360,569 | A | 11/1994 | Madison et al. |
| 5,370,826 | A | 12/1994 | Madison et al. |
| 5,413,733 | A | 5/1995 | Nicholson et al. |
| 5,442,066 | A | 8/1995 | Madison et al. |
| 5,478,357 | A | 12/1995 | Madison et al. |
| 5,482,515 | A | 1/1996 | Madison et al. |
| 5,550,256 | A | 8/1996 | Madison et al. |
| 5,576,282 | A | 11/1996 | Miracle et al. |
| 5,652,207 | A | 7/1997 | Ghatlia |
| 5,693,603 | A | 12/1997 | Ghatlia |
| 5,710,116 | A | 1/1998 | Miracle et al. |
| 5,753,599 | A | 5/1998 | Coope et al. |
| 5,760,222 | A | 6/1998 | Coope |
| 5,817,614 | A | 10/1998 | Miracle et al. |
| 5,952,282 | A | 9/1999 | Löffler et al. |
| 6,007,583 | A | 12/1999 | Nestler |
| 6,120,557 | A | 9/2000 | Nestler |

FOREIGN PATENT DOCUMENTS

| | | |
|---|---|---|
| CA | 1122980 | 5/1982 |
| WO | WO 95/13351 | 5/1995 |
| WO | WO 95/13352 | 5/1995 |
| WO | WO 95/13353 | 5/1995 |
| WO | WO 95/28399 | 10/1995 |
| WO | WO 97/06147 | 2/1997 |
| WO | WO 98/07825 | 2/1998 |
| WO | WO 98/15535 | 4/1998 |
| WO | WO 98/23602 | 6/1998 |
| WO | WO 98/23717 | 6/1998 |

OTHER PUBLICATIONS

H. Böhme et al., *Uber Derivate des 1,2,3,4, 5–Pentahydro–2–benzazepins*, Arch Pharm, vol. 306 (4), 1972, pp. 271–274.

U.S. Appl. No. 10/069,635, filed Feb. 26, 2002, Dykstra et al.

U.S. Appl. No. 10/069,632, filed Feb. 26, 2002, Dykstra et al.

U.S. Appl. No. 10/069,633, filed Feb. 26, 2002, Dykstra et al.

U.S. Appl. No. 10/069,628, filed Feb. 26, 2002, Dykstra et al.

U.S. Appl. No. 10/069,631, filed Feb. 26, 2002, Dykstra et al.

U.S. Appl. No. 10/083,948, filed Feb. 27, 2002, Dykstra et al.

U.S. Appl. No. 10/069,630, filed Feb. 26, 2002, Dykstra et al.

U.S. Appl. No. 10/069,629, filed Feb. 26, 2002, Dykstra et al.

U.S. Appl. No. 10/854,696, filed May 26, 2004, Dykstra et al.

U.S. Appl. No. 10/854,409, filed May 26, 2004, Dykstra et al.

*Primary Examiner*—Gregory R. Del Cotto
(74) *Attorney, Agent, or Firm*—James F. McBride; Kim W. Zerby; Steve W. Miller

(57) ABSTRACT

The present invention relates to formulation components, such as organic catalyst compounds having increased stability, compositions and laundry methods employing such organic catalyst compounds. More particularly, this invention relates to organic catalysts compounds such as quaternary imine bleach boosting compounds, quaternary oxaziridinium bleaching species, modified amines and amine oxides, compositions and laundry methods employing such organic catalyst compounds.

25 Claims, No Drawings

STABLE FORMULATION COMPONENTS, COMPOSITIONS AND LAUNDRY METHODS EMPLOYING SAME

This application is an entry into the U.S. National Stage under 35 U.S.C. §371 of PCT International Application Serial No. PCT/US00/23317, filed Aug. 25, 2000, and claims priority under 35 U.S.C. §119(e) U.S. Provisional Application Ser. No. 60/151,176 filed Aug. 27, 1999.

FIELD OF THE INVENTION

The present invention relates to formulation components, such as organic catalyst compounds having increased stability, compositions and laundry methods employing such organic catalyst compounds. More particularly, this invention relates to organic catalysts compounds such as quaternary imine bleach boosting compounds, quaternary oxaziridinium bleaching species, modified amines and amine oxides, compositions and laundry methods employing such organic catalyst compounds.

BACKGROUND OF THE INVENTION

Oxygen bleaching agents have become increasingly popular in recent years in household and personal care products to facilitate stain and soil removal. Bleaches are particularly desirable for their stain-removing, dingy fabric cleanup, whitening and sanitization properties. Oxygen bleaching agents have found particular acceptance in laundry products such as detergents, in automatic dishwashing products and in hard surface cleansers. Oxygen bleaching agents, however, are somewhat limited in their effectiveness. Some frequently encountered disadvantages include their lack of fabric color safety and their tendency to be extremely temperature rate dependent. Thus, the colder the solution in which they are employed, the less effective the bleaching action. Temperatures in excess of 60° C. are typically required for effectiveness of an oxygen bleaching agent in solution.

To solve the aforementioned temperature rate dependency, a class of compounds known as "bleach activators" has been developed. Bleach activators, typically perhydrolyzable acyl compounds having a leaving group such as oxybenzenesulfonate, react with the active oxygen group, typically hydrogen peroxide or its anion, to form a more effective peroxyacid oxidant. It is the peroxyacid compound which then oxidizes the stained or soiled substrate material. However, bleach activators are also somewhat temperature dependent. Bleach activators are more effective at warm water temperatures of from about 40° C. to about 60° C. In water temperatures of less than about 40° C., the peroxyacid compound loses some of its bleaching effectiveness.

Unsuccessful attempts have been made, as disclosed in U.S. Pat. Nos. 5,360,568, 5,360,569 and 5,370,826 all to Madison et al., to develop a bleach system comprising organic catalysts, more specifically, iminium-based organic catalysts, which is effective in lower temperature water conditions and is safe on colors. However, cationic, quaternary imine salts, the organic catalysts disclosed in these applications, are not completely satisfactory in laundry bleaching applications. In particular, the quaternary imine salts, when combined with peroxygen compounds, cause an unacceptable level of color damage on fabrics. In addition, the quaternary imine salts are less stable at higher wash temperatures, which can result in a loss of effectiveness.

U.S. Pat. Nos. 5,576,282 and 5,817,614 both to Miracle et al. disclose another attempt at developing a bleach system comprising organic catalysts which is effective in lower temperature water conditions and is safe on colors. Although the bleach system disclosed in this patent provides enhanced color-safety over traditional organic catalyst bleach systems at lower temperature water conditions, it is also preferred to achieve such bleaching also at higher wash temperatures.

Many iminiums and dihydroisoquinoliniums, and the quaternary oxaziridinium bleaching species formed from them, exemplified in the art have organic catalyst lifetimes of less than 30 min at 20° C., as determined according to the Test Protocol, disclosed hereinafter. At higher temperatures, such as 40° C., these organic catalyst lifetimes would be less than 3 min. At even higher wash temperatures, such as 60° C., the organic catalyst lifetimes would be less than 20 seconds. Such instability at warmer wash temperatures, can result in a dramatic loss of effectiveness.

In light of the foregoing, researchers have been pursuing effective organic catalyst bleach systems which provide effective bleaching both in lower (cold) and higher (warm or hot) water temperatures, and provide improved stability toward unwanted organic catalyst decomposition.

Accordingly, it is evident that there still exists a need for an organic catalyst bleach system that provides improved stability toward unwanted organic catalyst decomposition and that provides effective bleaching not only in lower temperature water conditions, but also more effective bleaching at higher temperature water conditions compared to the bleach systems disclosed in the prior art.

SUMMARY OF THE INVENTION

The present invention fulfills the need discussed above. The present invention provides formulation components, such as organic catalyst compounds having organic catalyst lifetimes of greater than 30 minutes, as determined according to the Test Protocol, disclosed hereinafter. Such organic catalyst compounds are effective not only for a longer duration of time under lower temperature water conditions, such as the 20° C. temperature indicated in the Protocol, and lower temperatures, such as 5° C., but also have a greater catalyst lifetime under higher temperature water conditions, such as greater than 40° C. up to about 60° C. or even higher temperatures, resulting in improved stability of the organic catalyst compared to the organic catalysts of the prior art bleaching systems.

For example, an organic catalyst compound with an organic catalyst lifetime (OCL) of only 20 minutes at 20° C., as determined according to the Test Protocol, disclosed hereinafter, will have an OCL of only approximately 2 minutes at 40° C., whereas an organic catalyst compound with an OCL of 10 hours at 20° C., as determined according to the Test Protocol, disclosed hereinafter, will have an OCL of approximately 1 hour at 40° C. Similarly, an organic catalyst compound with an OCL of 40 minutes at 20° C., as determined according to the Test Protocol, disclosed hereinafter, will have an OCL of approximately 4 minutes at 40° C. The performance advantage of a lifetime of 1 hour at 40° C., compared to 2 minutes at 40° C., is apparent. For a 10 minute wash cycle, for example, the performance from an organic catalyst compound with a lifetime of 4 minutes at 40° C., compared to 2 minutes at 40° C., may also be much greater, particularly if the stained fabric in need of laundering is added to the wash after the OCL of the organic catalyst of the prior art has expired (i.e. after 2 minutes). The organic catalyst of the prior art will show no or little bleaching (lifetime expired), whereas the organic catalysts provided by the present invention (having 2 minutes of OCL left) will continue to demonstrate effective bleaching.

In addition to the organic catalyst compounds, compositions and laundry methods employing such organic catalyst compounds are disclosed herein. More particularly, organic catalysts compounds such as quaternary imine bleach boosting compounds, quaternary oxaziridinium bleaching species, modified amines and amine oxides, compositions and laundry methods employing such organic catalyst compounds are provided by the present invention.

Nonlimiting examples of the benefits provided by the formulation components, specifically the organic catalyst compounds, include superior bleaching effectiveness, such as stain removal, whitening, etc., in lower and higher temperature water, permits various manners of addition, minimizes unwanted organic catalyst decomposition products and the resulting loss of peracid AvO due to bleaching of decomposition products, allows greater organic catalyst efficiency (i.e., allows the use of less organic catalyst, which results in lower costs of the bleaching compositions, less impact on the environment, and reduced formula space).

In one aspect of the present invention, a formulation component, preferably an organic catalyst compound which demonstrates effective bleaching in lower and higher water temperature and allows for a broader in-use temperature range compared to the conventional organic catalysts is provided.

In accordance with another aspect of the present invention, a bleaching composition comprising one or more of the formulation components described above in conjunction with or without a peroxygen source is provided.

In accordance with yet another aspect of the present invention, a method for laundering a fabric in need of laundering comprising contacting the fabric with a laundry solution having one or more of the bleaching compositions described herein is provided.

In accordance with still yet another aspect of the present invention, a laundry additive product comprising one or more of the formulation components described herein is provided.

Accordingly, it is an object of the present invention to provide: a formulation component, preferably an organic catalyst compound, which demonstrates improved performance in lower and higher temperature water wash solutions; a bleaching composition comprising one or more of the formulation components described herein; a method for laundering a fabric using one or more of the bleaching compositions described herein; and a laundry additive product comprising one or more of the formulation components described herein.

These and other objects, features and advantages of the present invention will be recognized by one of ordinary skill in the art from the following description and the appended claims.

All percentages, ratios and proportions herein are on a weight basis unless otherwise indicated. All documents cited herein are hereby incorporated by reference.

DETAILED DESCRIPTION OF THE INVENTION

The present invention discloses highly useful formulation components, such as organic catalyst compounds ("bleach boosting comounds", "bleaching species", "modified amines", "modified amine oxides" and mixtures thereof), compositions, and methods employing the formulation components.

The formulation components, particularly the organic catalyst compounds of the present invention provide increased bleaching effectiveness, such as stain removal, whitening, etc., in lower- and higher-temperature water, permits various manners of addition, minimizes unwanted organic catalyst decomposition products and the resulting loss of peracid available oxygen (AvO) due to bleaching of decomposition products, allows greater organic catalyst efficiency (e.g., allows the use of less organic catalyst, which results in lower costs of the bleaching compositions, less impact on the environment, and reduced formula space) compared to conventional organic catalyst bleaching systems.

The formulation components of the present invention act in conjunction with or without, preferably with conventional peroxygen bleaching sources to provide the above-mentioned improved stability of the organic catalysts and the increased bleaching effectiveness as described above.

Definitions

"Peroxygen source" as used herein means materials that generate peroxygen compounds, which can include the peroxygen compounds themselves. Examples include, but are not limited to, bleach activators, peracids, percarbonate, perborate, hydrogen peroxide, bleach boosting compounds, and/or bleaching species (e.g., oxaziridiniums).

"Peroxygen compounds" as used herein includes peracids and peroxides (e.g., hydrogen peroxide, alkyl hydroperoxides, etc.

"Peracid" as used herein means a peroxyacid such as peroxycarboxylic acid and/or peroxymonosulfuric acid (tradname OXONE) and their salts.

Organic Catalyst Compounds

Nonlimiting examples of organic catalyst compounds, such as bleach boosting and bleaching species compounds are described in U.S. Pat. Nos. 5,041,232, 5,045,223, 5,047,163, 5,310,925, 5,413,733, 5,360,568, 5,482,515, 5,550,256, 5,360,569, 5,478,357, 5,370,826, 5,442,066, 5,576,282, 5,760,222, 5,753,599, 5,652,207 and 5,817,614, PCT Published Applications WO 98/23602, WO 95/13352, WO 95/13353, WO 95/13351, WO 97/06147 and WO 98/23717 and EP 728 182.

The organic catalyst compounds of the present invention that are particularly useful in the compositions and methods of the present invention are the organic catalyst compounds that exhibit organic catalyst lifetimes of greater than 30 minutes, as determined according to the Test Protocol described hereinafter.

Preferably, the organic catalyst compounds of the present invention, more preferably the iminium-based organic catalyst compounds of the present invention, include, but are not limited to, bleach boosting compounds, bleaching species, modified amines, modified amine oxides and mixtures thereof.

Bleach Boosting Compounds—The bleach boosting compounds, preferably iminium-based bleach boosting compounds, of the present invention include, but are not limited to, aryliminium cations, aryliminium polyions having a net charge of from about +3 to about −3, and aryliminium zwitterions having a net charge of from about +3 to about −3.

The aryliminium cations and aryliminium polyions having a net charge of from about +3 to about −3, are represented by the formula [I]:

[I]

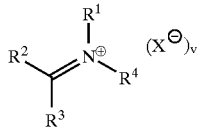

where $R^2$–$R^3$ are independently selected from substituted or unsubstituted, saturated or unsaturated radicals selected from the group consisting of H, alkyl, cycloalkyl, aryl, alkaryl, aralkyl, heterocyclic ring, silyl, nitro, halo, cyano, sulfonato, alkoxy, keto, carboxylic, and carboalkoxy radicals; $R^1$ and $R^4$ are radicals selected from the group consisting of substituted or unsubstituted, saturated or unsaturated, H, alkyl, cycloalkyl, aryl, alkaryl, aralkyl, heterocyclic ring, silyl, nitro, halo, cyano, alkoxy, keto and carboalkoxy radicals, provided that when $R^1$ or $R^4$ is isopropyl, $R^2$ or $R^3$ is not $ArCOCH_3$; $X^-$ is a suitable charge-balancing counterion, preferably a bleach-compatible counterion; and v is an integer from 1 to 3.

Preferably, the aryliminium cations and aryliminium polyions having a net charge of from about +3 to about −3, are represented by the formula [XI]:

[XI]

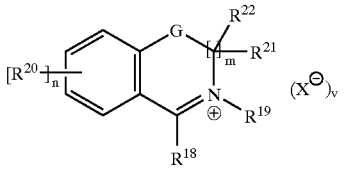

where m is 1 to 3 when G is present and m is 1 to 4 when G is not present; and n is an integer from 0 to 4; each $R^{20}$ is independently selected from a substituted or unsubstituted radical selected from the group consisting of H, alkyl, cycloalkyl, aryl, fused aryl, heterocyclic ring, fused heterocyclic ring, nitro, halo, cyano, sulfonato, alkoxy, keto, carboxylic, and carboalkoxy radicals, and any two vicinal $R^{20}$ substituents may combine to form a fused aryl, fused carbocyclic or fused heterocyclic ring, provided that $R^{20}$ is not phenyl; and provided that when $R^{19}$ is isopropyl, $R^{20}$ is not $COCH_3$; $R^{18}$ may be a substituted or unsubstituted radical selected from the group consisting of H, alkyl, cycloalkyl, alkaryl, aryl, aralkyl, heterocyclic ring, silyl, nitro, halo, cyano, sulfonato, alkoxy, keto, carboxylic, and carboalkoxy radicals; $R^{19}$ is a radical selected from the group consisting of substituted or unsubstituted, saturated or unsaturated, H, alkyl, cycloalkyl, alkaryl, aryl, aralkyl and heterocyclic ring; G is selected from the group consisting of: (I) —O—; (2) —N($R^{23}$)—; and (3) —N($R^{23}R^{24}$)—; $R^{21}$–$R^{24}$ are substituted or unsubstituted radicals independently selected from the group consisting of H, oxygen, linear or branched $C_1$–$C_{12}$ alkyls, alkylenes, alkoxys, aryls, alkaryls, aralkyls, cycloalkyls, and heterocyclic rings; provided that any of $R^{18}$, $R^{19}$, $R^{20}$, $R^{21}$–$R^{24}$ may be joined together with any other of $R^{18}$, $R^{19}$, $R^{20}$, $R^{21}$ $R^{24}$ to form part of a common ring; any geminal $R^{21}$–$R^{22}$ may combine to form a carbonyl; any vicinal $R^{21}$–$R^{24}$ may join to form unsaturation; and wherein any one group of substituents $R^2$–$R^{24}$ may combine to form a substituted or unsubstituted fused unsaturated moiety; $X^-$ is a suitable charge-balancing counterion, preferably a bleach-compatible counterion; v is an integer from 1–3.

For cationic organic catalyst compounds, we have surprisingly found that substitution or branching on $R^{19}$ provides increased stability. More preferred is when branching is at the alpha (α) and/or beta (β) positions (relative to the nitrogen atom) and even more preferred at the alpha (α) position, most preferably such that substitution or branching is present at the alpha (α) position in the form of geminal disubstitution as is shown in the following formula:

[XIa]

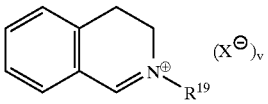

preferably, $R^{19}$ has the formula:

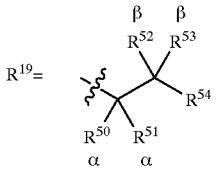

wherein $R^{50}$–$R^{54}$ may be independently selected from a substituted or unsubstituted radical selected from the group consisting of H, linear or branched, substituted or unsubstituted alkyl, cycloalkyl, alkaryl, aryl, aralkyl, heterocyclic ring, silyl, nitro, halo, cyano, alkoxy, keto and carboalkoxy radicals, provided that any of $R^{50}$–$R^{54}$ may be joined together with any other of $R^{50}$–$R^{54}$ to form part of a common ring; and provided that when $R^{54}$ is an unsubstituted, linear alkyl radical, $R^{50}$–$R^{53}$ are not all H; and when $R^{54}$ is H, $R^{50}$–$R^{51}$ do not combine with any of $R^{52}$–$R^{53}$ to form an aromatic moiety. Preferably, at least one, more preferably two of $R^{50}$–$R^{51}$ is not H. Even more preferably, $R^{50}$–$R^{51}$ are independently selected from the group consisting of alkyl and cycloalkyl radical; most preferably $R^{50}$–$R^{51}$ are independently selected from a methyl or ethyl radical.

More preferred, aryliminium cations and aryliminium polyions having a net charge of from about +3 to about −3, as represented by the formula [XI], include those of formula [XI] where $R^{18}$ is H or methyl and $R^{19}$ is H or substituted or unsubstituted, saturated or unsaturated $C_1$–$C_{14}$ alkyl or cycloalkyl.

The aryliminium zwitterions having a net charge of from about +3 to about −3, are represented by the formula [II]:

[II]

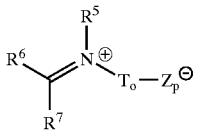

where $R^5$–$R^7$ are independently selected from substituted or unsubstituted radicals selected from the group consisting of H, alkyl, cycloalkyl, aryl, alkaryl, aralkyl, heterocyclic ring, silyl, nitro, halo, cyano, sulfonato, alkoxy, keto, carboxylic, and carboalkoxy radicals; also present in this formula is the radical represented by the formula:

$$—T_o—Z_p^{\ominus}$$

where $Z_p^-$ is covalently bonded to $T_o$, and $Z_p^-$ is selected from the group consisting of $—CO_2^-$, $—SO_3—$, $—OSO_3^-$, $—SO_2^-$ and $—OS_2^-$ and p is either 1, 2 or 3; $T_o$ is selected from the group consisting of substituted or unsubstituted, saturated or unsaturated alkyl, cycloalkyl,.aryl, alkaryl, aralkyl, and heterocyclic ring.

Preferably, the aryliminium zwitterions having a net charge of from about +3 to about −3 are represented by the formula [XII]:

[XII]

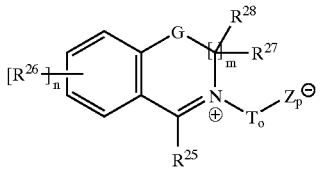

where m is 1 to 3 when G is present and m is 1 to 4 when G is not present; and n is an integer from 0 to 4; each $R^{26}$ is independently selected from a substituted or unsubstituted radical selected from the group consisting of H, alkyl, cycloalkyl, aryl, fused aryl, heterocyclic ring, fused heterocyclic ring, nitro, halo, cyano, sulfonato, alkoxy, keto, carboxylic, and carboalkoxy radicals, and any two vicinal $R^{26}$ substituents may combine to form a fused aryl, fused carbocyclic or fused heterocyclic ring; $R^{25}$ may be a substituted or unsubstituted radical selected from the group consisting of H, alkyl, cycloalkyl, alkaryl, aryl, aralkyl, heterocyclic ring, silyl, nitro, halo, cyano, sulfonato, alkoxy, keto, carboxylic, and carboalkoxy radicals; also present in this formula is the radical represented by the formula:

$$—T_o—Z_p^{\ominus}$$

where $Z_p^-$ is covalently bonded to $T_o$, and $Z_p^-$ is selected from the group consisting of $—CO_2^-$, $—SO_3^-$, $—OSO_3^-$, $—SO_2^-$ and $—OSO_2^-$ and p is either 1, 2 or 3; $T_o$ is selected from the group consisting of:

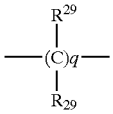

wherein q is an integer from 1 to 8; $R^{29}$ is independently selected from substituted or unsubstituted radicals selected from the group consisting of linear or branched H, alkyl, cycloalkyl, alkaryl, aryl, aralkyl, alkylene, heterocyclic ring, alkoxy, arylcarbonyl, carboxyalkyl and amide groups, provided that all $R^{29}$ groups are not independently selected to be H; G is selected from the group consisting of: (1) —O—; (2) $—N(R^{30})—$; and (3) $—N(R^{30}R^{31})—$; $R^{27}$, $R^{28}$, $R^{30}$ and $R^{31}$ are substituted or unsubstituted radicals independently selected from the group consisting of H, oxygen, alkyl, cycloalkyl, alkaryl, aryl, aralkyl, alkylenes, heterocyclic ring, alkoxys, arylcarbonyl groups, carboxyalkyl groups and amide groups; any of $R^{25}$, $R^{26}$, $R^{27}$, $R^{28}$, $R^{30}$ and $R^{31}$ may be joined together with any other of $R^{25}$, $R^{26}$, $R^{27}$, $R^{28}$, $R^{30}$ and $R^{31}$ to form part of a common ring; any geminal $R^{27}$–$R^{28}$ may combine to form a carbonyl; any vicinal $R^{27}$–$R^{31}$ may join to form unsaturation; and wherein any one group of substituents $R^{27}$–$R^{31}$ may combine to form a substituted or unsubstituted fused unsaturated moiety; and provided that the radical represented by the formula:

$$—T_o'—Z_p'^{\ominus}$$

is not $CH_2CH(OSO_3^-)R^{41}$ wherein $R^{41}$ is selected from the group consisting of geminal dimethyl substituted alkyl, unsubstituted alkyl and phenyl.

For zwitterionic organic catalyst compounds, we have surprisingly found that substitution or branching on $R^{19}$ provides increased stability. More preferred is when branching is at the alpha (α) or beta (β) positions (relative to the nitrogen atom) and even more preferred at the alpha (α) position, most preferably such that substitution or branching is present at the alpha (α) and beta (β) positions, as shown in the following formula:

[XIIa]

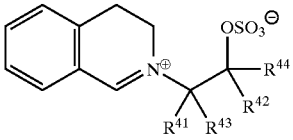

wherein $R^{41}$–$R^{44}$ may be independently selected from a substituted or unsubstituted radical selected from the group consisting of H, linear or branched, substituted or unsubstituted alkyl, cycloalkyl, alkaryl, aryl, aralkyl, alkylene, alkoxy,radicals, provided that any of $R^{41}$–$R^{44}$ may be joined together with any other of $R^{41}$–$R^{44}$ to form part of a common ring; more preferably at least one, even more preferably two of $R^{41}$–$R^{44}$ is H. Yet even more preferably, $R^{41}$–$R^{42}$ are H, and either $R^{43}$ or $R^{43}$–$R^{44}$ are independently selected from the group consisting of linear or branched C1–C16 alkyl or cycloalkyl, and yet still even more preferably the sum of the carbon atoms within $R^{43}$ and $R^{44}$ is from 2–20. Most preferably, $R^{43}$ and $R^{44}$ are configured as shown in the following formula:

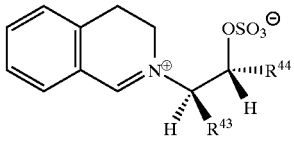

More preferred aryliminium zwitterions having a net charge of from about +3 to about −3, as represented by the formula [XII], include those of formula [XII] where $R^{25}$ is H or methyl, and for the radical represented by the formula:

$$—T_o—Z_p^{\ominus}$$

$Z_p^-$ is $—CO_2^-$, $—SO_3^-$ or $—OSO_3^-$, and p is 1 or 2; even more preferably $Z_p^-$ is $—SO_3^-$ or $—OSO_3^-$, and p is 1.

Nonlimiting examples of suitable zwitterionic organic catalysts include the following:

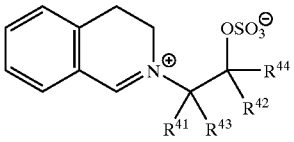

wherein

| $R^{41}$ | $R^{42}$ | $R^{43}$ | $R^{44}$ |
|---|---|---|---|
| H | H | $CH_3$ | $CH_3$ |
| H | H | $CH_2CH_3$ | $CH_2CH_3$ |
| H | H | $CH_2CH_3$ | $(CH_2)_6CH_3$ |
| H | H | $(CH_2)_3CH_3$ | $(CH_2)_3CH_3$ |
| H | H | $(CH_2)_5CH_3$ | $(CH_2)_5CH_3$ |
| H | H | $CH_3$ | $(CH_2)_5CH_3$ |
| H | H | $CH_3$ | $(CH_2)_6CH_3$ |
| H | H | $CH_3$ | $(CH_2)_7CH_3$ |
| H | H | $CH_3$ | $(CH_2)_8CH_3$ |
| H | H | $CH_3$ | $(CH_2)_9CH_3$ |
| H | H | $(CH_2)_7CH_3$ | $CH_3$ |
| H | H | $CH_3$ | H |
| H | H | $(CH_2)_7CH_3$ | H |
| H | $CH_3$ | H | $CH_3$ |
| H | $CH_3$ | $CH_3$ | $CH_3$ |
| $CH_3$ | H | $CH_3$ | $CH_3$ |
| $CH_3$ | H | $CH_3$ | H |

Bleaching Species—The bleaching species (oxaziridiniums) may also be used directly in accordance with the present invention. The bleaching species of the present invention include, but are not limited to, oxaziridinium cations, oxaziridinium polyions having a net charge of from about +3 to about −3, and oxaziridinium zwitterions having a net charge of from about +3 to about −3.

The oxaziridinium cations and polyions having a net charge of from about +3 to about −3, are represented by the formula [III]:

[III]

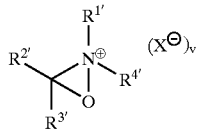

where $R^{2'}$–$R^{3'}$ are independently selected from substituted or unsubstituted radicals selected from the group consisting of H, alkyl, cycloalkyl, aryl, alkaryl, aralkyl, heterocyclic ring, silyl, nitro, halo, cyano, sulfonato, alkoxy, keto, carboxylic, and carboalkoxy radicals; $R^{1'}$ and $R^{4'}$ are radicals selected from the group consisting of substituted or unsubstituted, saturated or unsaturated, H, alkyl, cycloalkyl, aryl, alkaryl, aralkyl, heterocyclic ring, silyl, nitro, halo, cyano, alkoxy, keto and carboalkoxy radicals, provided that when $R^{1'}$ or $R^{4'}$ is isopropyl, $R^{2'}$ or $R^{3'}$ is not $ArCOCH_3$; $X^-$ is a suitable charge-balancing counterion, preferably a bleach-compatible counterion; and v is an integer from 1 to 3.

Preferably, the oxaziridinium cations and polyions having a net charge of from about +3 to about −3, are represented by formula [XIII]:

[XIII]

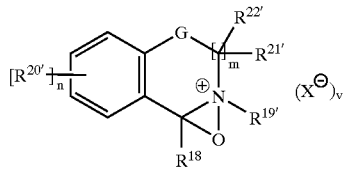

wherein m is 1 to 3 when G is present and m is 1 to 4 when G is not present; and n is an integer from 0 to 4; each $R^{20'}$ is independently selected from a substituted or unsubstituted radical selected from the group consisting of H, alkyl, cycloalkyl, aryl, fused aryl, heterocyclic ring, fused heterocyclic ring, nitro, halo, cyano, sulfonato, alkoxy, keto, carboxylic, and carboalkoxy radicals, and any two vicinal $R^{20'}$ substituents may combine to form a fused aryl, fused carbocyclic or fused heterocyclic ring, provided that when $R^{19'}$ is isopropyl, $R^{20'}$ is not $COCH_3$; $R^{18'}$ may be a substituted or unsubstituted radical selected from the group consisting of H, alkyl, cycloalkyl, alkaryl, aryl, aralkyl, heterocyclic ring, silyl, nitro, halo, cyano, sulfonato, alkoxy, keto, carboxylic, and carboalkoxy radicals; $R^{19'}$ may be a substituted or unsubstituted, saturated or unsaturated, radical selected from the group consisting of H, alkyl, cycloalkyl, alkaryl, aryl, aralkyl and heterocyclic ring. G is selected from the group consisting of: (1) —O—; (2)—$N(R^{23'})$—; and (3) —$N(R^{23'}R^{24'})$—; $R^{2'}$–$R^{24'}$ are substituted or unsubstituted radicals independently selected from the group consisting of H, oxygen, linear or branched $C_1$–$C_{12}$ alkyls, alkylenes, alkoxys, aryls, alkaryls, aralkyls, cycloalkyls, and heterocyclic rings; provided that any of $R^{18'}$, $R^{19'}$, $R^{21'}$–$R^{24'}$ may be joined together with any other of $R^{18'}$, $R^{19'}$, $R^{21'}$–$R^{24'}$ to form part of a common ring; any geminal $R^{21'}$–$R^{22'}$ may combine to form a carbonyl; any vicinal $R^{21'}$–$R^{24'}$ may join to form unsaturation; and wherein any one group of substituents $R^{21'}$–$R^{24'}$ may combine to form a substituted or unsubstituted fused unsaturated moiety; and wherein any one group of substituents $R^{21'}$–$R^{24'}$ may combine to form a substituted or unsubstituted fused unsaturated moiety; $X^-$ is a suitable charge-balancing counterion, preferably a bleach-compatible counterion; and v is an integer from 1 to 3.

More preferred oxaziridinium cations and oxaziridinium polyions having a net charge of from about +3 to about −3, as represented by the formula [XIII], include those of formula [XIII] where $R^{18'}$ is H or methyl, and $R^{19'}$ is H or substituted or unsubstituted, saturated or unsaturated, $C_1$–$C_{14}$ alkyl or cycloalkyl.

The oxaziridinium zwitterions having a net charge of from about +3 to about −3 are represented by formula [IV]:

[IV]

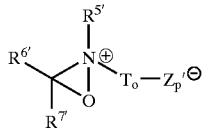

where $R^{5'}$–$R^{7'}$ are independently selected from substituted or unsubstituted radicals selected from the group consisting of H, alkyl, cycloalkyl, aryl, alkaryl, aralkyl, heterocyclic ring, silyl, nitro, halo, cyano, sulfonato, alkoxy, keto, carboxylic, and carboalkoxy radicals; also present in this formula is the radical represented by the formula:

$$—T_o'—Z_p'^{\ominus}$$

where $Z'_p{}^-$ is covalently bonded to $T'_o$, and $Z'_p{}^-$ is selected from the group consisting of —$CO_2^-$, —$SO_3^-$, —$OSO_3^-$, —$SO_2^-$ and —$OSO_2^-$ and p is either 1, 2 or 3; $T'_o$ is selected from the group consisting of substituted or unsubstituted, saturated or unsaturated alkyl, cycloalkyl, aryl, alkaryl, aralkyl, and heterocyclic ring.

Preferably, the oxaziridinium zwitterions having a net charge of from about +3 to about −3, and are represented by formula [XIV]:

[XIV]

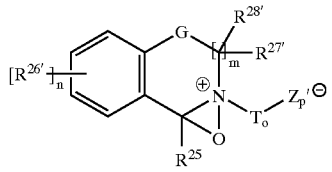

wherein m is 1 to 3 when G is present and m is 1 to 4 when G is not present; and n is an integer from 0 to 4; each $R^{26'}$ is independently selected from a substituted or unsubstituted radical selected from the group consisting of H, alkyl, cycloalkyl, aryl, fused aryl, heterocyclic ring, fused heterocyclic ring, nitro, halo, cyano, sulfonato, alkoxy, keto, carboxylic, and carboalkoxy radicals, and any two vicinal $R^{26'}$ substituents may combine to form a fused aryl, fused carbocyclic or fused heterocyclic ring; $R^{25'}$ may be a substituted or unsubstituted radical selected from the group consisting of H, alkyl, cycloalkyl, alkaryl, aryl, aralkyl, heterocyclic ring, silyl, nitro, halo, cyano, sulfonato, alkoxy, keto, carboxylic, and carboalkoxy radicals; the radical represented by the formula:

$$—T_o'—Z_p'^{\ominus}$$

where $Z'_p{}^-$ is covalently bonded to $T'_o$, and $Z'_p{}^-$ is selected from the group consisting of —$CO_2^-$, —$SO_3^-$, —$OSO_3^-$, $—SO_2^-$ and $—OSO_2^-$, and p is either 1 or 2; $T'_o$ is selected from the group consisting of:

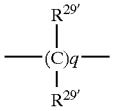

wherein q is an integer from 1 to 8; $R^{29'}$ is independently selected from substituted or unsubstituted radicals selected from the group consisting of linear or branched H, alkyl, cycloalkyl, alkaryl, aryl, aralkyl, alkylene, heterocyclic ring, alkoxy, arylcarbonyl, carboxyalkyl and amide groups, provided that all $R^{29'}$ groups are not independently selected to be H; G is selected from the group consisting of: (1) —O—; (2) $—N(R^{30'})—$; and (3) $—N(R^{30'}R^{31'})—$; $R^{27'}$, $R^{28'}$, $R^{30'}$ and $R^{31'}$ are substituted or unsubstituted radicals independently selected from the group consisting of H, oxygen, alkyl, cycloalkyl, alkaryl, aryl, aralkyl, alkylenes, heterocyclic ring, alkoxys, arylcarbonyl groups, carboxyalkyl groups and amide groups; any of $R^{25'}$, $R^{26'}$, $R^{27'}$, $R^{28'}$, $R^{30'}$ and $R^{31'}$ may be joined together with any other of $R^{25'}$, $R^{26'}$, $R^{27'}$, $R^{28'}$, $R^{30'}$ and $R^{31'}$ to form part of a common ring; any geminal $R^{27'}$–$R^{28'}$ may combine to form a carbonyl; any vicinal $R^{27'}$–$R^{31'}$ may join to form unsaturation; and wherein any one group of substituents $R^{27'}$–$R^{31'}$ may combine to form a substituted or unsubstituted fused unsaturated moiety; and provided that the radical represented by the formula:

$$—T_o'—Z_p'^{\ominus}$$

is not $CH_2CH(OSO_3^-)R^{41}$ wherein $R^{41}$ is selected from the group consisting of geminal dimethyl substituted alkyl, unsubstituted alkyl and phenyl.

More preferred aryliminium zwitterions having a net charge of from about +3 to about −3, as represented by the formula [XIV], include those of formula [XIV] where $R^{25'}$ is H or methyl, and for the radical represented by the formula:

$$—T_o'—Z_p'^{\ominus}$$

$Z'^-_p$ is $—CO_2^-$, $—SO_3^-$ or $—OSO_3^-$, and p is 1 or 2.

Modified Amine Compounds—The modified amine compounds of the present invention include, but are not limited to, modified amines and modified amine oxides having a net charge of from about +3 to about −3.

The modified amines are represented by formulas [V] and [VI]:

[V]

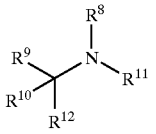

[VI]

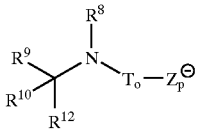

where $R^9$–$R^{10}$ are independently selected from substituted or unsubstituted radicals selected from the group consisting of H, alkyl, cycloalkyl, aryl, alkaryl, aralkyl, heterocyclic ring, silyl, nitro, halo, cyano, sulfonato, alkoxy, keto, carboxylic, and carboalkoxy radicals and anionic and/or cationic charge carrying radicals; $R^8$ and $R^{11}$ are radicals selected from the group consisting of substituted or unsubstituted, saturated or unsaturated, H, alkyl, cycloalkyl, aryl, alkaryl, aralkyl, heterocyclic ring, silyl, nitro, halo, cyano, alkoxy, keto and carboalkoxy radicals and anionic and/or cationic charge carrying radicals; $R^{12}$ is a leaving group, the protonated form of which has a $pK_\alpha$ value ($H_2O$ reference) that falls within the following range: $37>pK_\alpha>-2$; with the proviso that any $R_8$–$R^{12}$, when present, may combine to form a fused aryl, fused carbocyclic or fused heterocyclic ring; and the radical represented by the formula:

$$—T_o—Z_p^{\ominus}$$

where $Z_p^-$ is covalently bonded to $T_o$, and $Z_p^-$ is selected from the group consisting of $—CO_2^-$, $—SO_3^-$, $—OSO_3^-$, $—SO_2$- and $-OSO_2^-$ and p is either 1, 2 or 3; $T_o$ is selected from the group consisting of substituted or unsubstituted, saturated or unsaturated alkyl, cycloalkyl, aryl, alkaryl, aralkyl, and heterocyclic ring.

Preferably, the modified amines are represented by the formulas [XV] and [XVI]:

[XV]

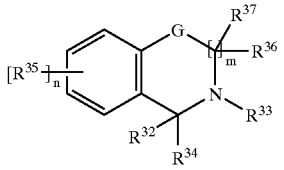

[XVI]

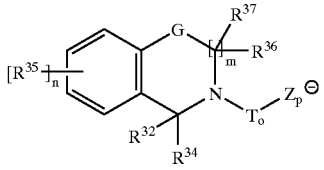

where m is 1 to 3 when G is present and m is 1 to 4 when G is not present; and n is an integer from 0 to 4; each $R^{35}$ is independently selected from a substituted or unsubstituted radical selected from the group consisting of H, alkyl, cycloalkyl, aryl, fused aryl, heterocyclic ring, fused heterocyclic ring, nitro, halo, cyano, sulfonato, alkoxy, keto, carboxylic, and carboalkoxy radicals, and any two vicinal $R^{35}$ substituents may combine to form a fused aryl, fused carbocyclic or fused heterocyclic ring; $R^{32}$ may be a substituted or unsubstituted radical selected from the group consisting of H, alkyl, cycloalkyl, alkaryl, aryl, aralkyl, heterocyclic ring, silyl, nitro, halo, cyano, sulfonato, alkoxy, keto, carboxylic, and carboalkoxy radicals; $R^{33}$ may be a substituted or unsubstituted, saturated or unsaturated, radical selected from the group consisting of H, alkyl, cycloalkyl, alkaryl, aryl, aralkyl, heterocyclic ring, and also present in this formula is the radical represented by the formula:

$$—T_o—Z_p^{\ominus}$$

where $Z_p^-$ is covalently bonded to $T_o$, and $Z_p^-$ is selected from the group consisting of $—CO_2^-$, $—SO_3^-$, $—OSO_3^-$, $—SO_2^-$ and $—OSO_2^-$, and p is either 1, 2 or 3; $T'_o$ is selected from the group consisting of:

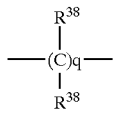

wherein q is an integer from 1 to 8; $R^{38}$ is independently selected from substituted or unsubstituted radicals selected from the group consisting of linear or branched H, alkyl, cycloalkyl, alkaryl, aryl, aralkyl, alkylene, heterocyclic ring, alkoxy, arylcarbonyl, carboxyalkyl and amide groups, provided that all $R^{38}$ groups are not independently selected to be H; G is selected from the group consisting of: (1) —O—; (2) $—N(R^{39})—$; and (3) $—N(R^{39}R^{40})—$; $R^{36}$, $R^{37}$, $R^{39}$ and $R^{40}$ are substituted or unsubstituted radicals independently selected from the group consisting of H, oxygen, alkyl, cycloalkyl, alkaryl, aryl, aralkyl, alkylenes, heterocyclic ring, alkoxys, arylcarbonyl groups, carboxyalkyl groups and amide groups; any of $R^{32}$, $R^{33}$, $R^{34}$, $R^{35}$, $R^{36}$, $R^{37}$, $R^{39}$ and $R^{40}$ may be joined together with any other of $R^{32}$, $R^{33}$, $R^{34}$, $R^{35}$, $R^{36}$, $^{37}$, $R^{39}$ and $R^{40}$ to form part of a common ring; any geminal $R^{36}$–$R^{37}$ may combine to form a carbonyl; any vicinal $R^{36}$, $R^{37}$, $R^{39}$ and $R^{40}$ may join to form unsaturation; and wherein any one group of substituents $R^{36}$, $R^{37}$, $R^{39}$ and $R^{40}$ may combine to form a substituted or unsubstituted fused unsaturated moiety.

More preferred modified amines, as represented by the formulas [XV] and [XVI], include those modified amines having a net charge of about +1 to about −1 where $R^{32}$ is H and/or $Z_p^-$ is $—CO_2^-$, $—SO_3^-$, or $—OSO_3^-$.

The modified amine oxides of the present invention are represented by formulas [VIII]–[X]:

[VII]

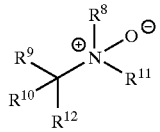

[VIII]

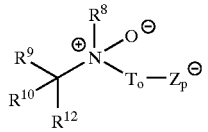

[IX]

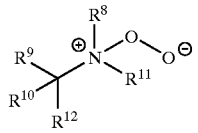

[X]

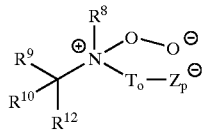

where $R^8$–$R^{10}$ are independently selected from substituted or unsubstituted radicals selected from the group consisting of H, alkyl, cycloalkyl, aryl, alkaryl, aralkyl, heterocyclic ring, silyl, nitro, halo, cyano, sulfonato, alkoxy, keto, carboxylic, and carboalkoxy radicals and anionic and/or cationic charge carrying radicals; $R^{11}$ is a radical selected from the group consisting of substituted or unsubstituted, saturated or unsaturated, H, alkyl, cycloalkyl, aryl, alkaryl, aralkyl, heterocyclic ring, silyl, nitro, halo, cyano, sulfonato, alkoxy, keto, carboxylic, and carboalkoxy radicals and anionic and/or cationic charge carrying radicals; $R^{12}$ is a leaving group, the protonated form of which has a $pK_\alpha$ value ($H_2O$ reference) that falls within the following range: $37>pK_\alpha>-2$; with the proviso that any $R^8$–$R^{12}$, when present, may combine to form a fused aryl, fused carbocyclic or fused heterocyclic ring; and also present in this formula is the radical represented by the formula:

$$—T_o—Z_p^{\ominus}$$

where $Z_p^-$ is covalently bonded to $T_o$, and $Z_p^-$ is selected from the group consisting of $—CO_2^-$, $—SO_3^-$, $—OSO_3^-$, $—SO_2^-$ and $—OSO_2^-$ and p is either 1, 2 or 3; $T_o$ is selected from the group consisting of substituted or unsubstituted, saturated or unsaturated alkyl, cycloalkyl, aryl, alkaryl, aralkyl, and heterocyclic ring.

Preferably, the modified amine oxides are represented by formulas [XVII]–[XX]:

[XVII]

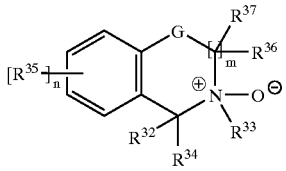

[XVIII]

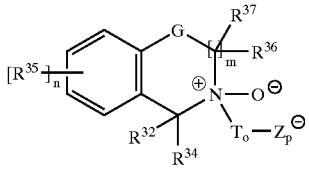

[XIX]

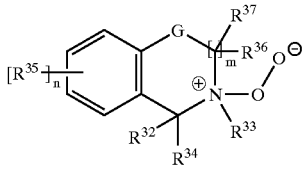

[XX]

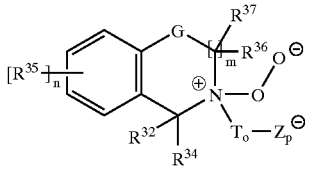

where m is 1 to 3 when G is present and m is 1 to 4 when G is not present; and n is an integer from 0 to 4; each $R^{35}$ is independently selected from a substituted or unsubstituted radical selected from the group consisting of H, alkyl, cycloalkyl, aryl, fused aryl, heterocyclic ring, fused heterocyclic ring, nitro, halo, cyano, sulfonato, alkoxy, keto, carboxylic, and carboalkoxy radicals, and any two vicinal $R^{35}$ substituents may combine to form a fused aryl, fused carbocyclic or fused heterocyclic ring; $R^{32}$ may be a substituted or unsubstituted radical selected from the group consisting of H, alkyl, cycloalkyl, alkaryl, aryl, aralkyl, heterocyclic ring, silyl, nitro, halo, cyano, sulfonato, alkoxy, keto, carboxylic, and carboalkoxy radicals; $R^{33}$ may be a substituted or unsubstituted, saturated or unsaturated, radical selected from the group consisting of H, alkyl, cycloalkyl, alkaryl, aryl, aralkyl, heterocyclic ring, and also present in this formula is the radical represented by the formula:

$$—T_o—Z_p^{\ominus}$$

where $Z_p^-$ is covalently bonded to $T_o$, and $Z_p^-$ is selected from the group consisting of $—CO_2^-$, $—SO_3^-$, $—OSO_3^-$, $—SO_2^-$ and $—OSO_2^-$, and p is either 1, 2 or 3; $T_o$ is selected from the group consisting of:

$$—\underset{\underset{R^{38}}{|}}{\overset{\overset{R^{38}}{|}}{(C)}}q—$$

wherein q is an integer from 1 to 8; $R^{38}$ is independently selected from substituted or unsubstituted radicals selected from the group consisting of linear or branched H, alkyl, cycloalkyl, alkaryl, aryl, aralkyl, alkylene, heterocyclic ring, alkoxy, arylcarbonyl, carboxyalkyl and amide groups, provided that all $R^{38}$ groups are not independently selected to be H; G is selected from the group consisting of: (1) —O—; (2) $—N(R^{39})—$; and (3) $—N(R^{39}R^{40})—$; $R^{36}$, $R^{37}$, $R^{39}$ and $R^{40}$ are substituted or unsubstituted radicals independently selected from the group consisting of H, oxygen, alkyl, cycloalkyl, alkaryl, aryl, aralkyl, alkylenes, heterocyclic ring, alkoxys, arylcarbonyl groups, carboxyalkyl groups and amide groups; any of $R^{32}$, $R^{33}$, $R^{34}$, $R^{35}$, $R^{36}$, $R^{37}$, $R^{39}$ and $R^{40}$ may be joined together with any other of $R^{32}$, $R^{33}$, $R^{34}$, $R^{35}$, $R^{36}$, $R^{37}$, $R^{39}$ and $R^{40}$ to form part of a common ring; any geminal $R^{36}$–$R^{37}$ may combine to form a carbonyl; any vicinal $R^{36}$, $R^{37}$, $R^{39}$ and $R^{40}$ may join to form unsaturation; and wherein any one group of substituents $R^{36}$, $R^{37}$, $R^{39}$ and $R^{40}$ may combine to form a substituted or unsubstituted fused unsaturated moiety;

Preferred modified amines, as represented by the formulas [XVII]–[XX], include those modified amines having a net charge of about +1 to about −1 where $R^{32}$ is H or methyl and/or $Z_p^-$ is $—CO_2^-$, $—SO_3^-$, or $—SO_3^-$.

For the modified amine compounds, $R^{12}$ is a leaving group (LG), the protonated form of which has a $pK_\alpha$ value ($H_2O$ reference) that fall within the following range: $37>pK_\alpha>-2$; preferably $30>pK_\alpha>0$; more preferably $23>pK_\alpha>3$; even more preferably $17>pK_\alpha>11$; most preferably $R^{12}$ is a leaving group consisting of substituted or unsubstituted, saturated or unsaturated hydroxy, perhydroxy, alkoxy and peralkoxy radicals, and any $R^8$–$R^{12}$ may combine to form a fused aryl, fused carbocyclic or fused heterocyclic ring.

Suitable examples of $X^-$, an anionic counterion, include, but are not limited to: $BF_4^-$, $OTS^{--}$, and other anionic counterions disclosed in WO 97/06147, WO 95/13352, WO 95/13353, WO 95/13351, WO 98/23717, U.S. Pat. Nos. 5,360,568, 5,360569, 5,482,515, 5,550,256, 5,478,357, 5,370,826, 5,442,066, EP 728 182 B1 and UK 1 215 656. Preferably, the anionic counterion is bleach-compatible.

For any structures that carry no net charge, no counterions are associated with the compound.

For any structures that carry a net negative charge, suitable examples of $X^+$, a cationic counterion include, but are not limited to $Na^+$, $K^+$, $H^+$.

For any structures that carry a net multiple charge, suitable examples of anionic and cationic counterions include, but are not limited to those described above.

Other Organic Catalyst Compounds—In addition to the bleach boosting compounds, bleaching species and modified amines and amine oxides disclosed above, organic catalyst compounds can be any compound known in the art that is capable of reacting with a peracid to form an oxygen transfer agent (a bleach).

Concentration of Organic Catalyst Compounds—The organic catalyst compounds of the present invention may be added to a wash solution in levels of from about 0.00001% (0.0001 ppm) to about 10% (100 ppm) by weight of the composition, and preferably from about 0.0001% (0.001 ppm) to about 2% (20 ppm) by weight of the composition, more preferably from about 0.005% (0.05 ppm) to about 0.5% (5 ppm), even more preferably from about 0.01% (0.1 ppm) to about 0.2% (2 ppm). Most preferably from about 0.02% (0.2 ppm) to about 0.1% (1 ppm).

Preferably, the bleaching compositions of the present invention bleach composition comprise an amount of organic catalyst compound such that the resulting concentration of the bleach boosting compound in a wash solution is from about 0.001 ppm to about 5 ppm.

Further, preferably the bleach compositions of the present invention comprise an amount of peroxygen compound, when present, and an amound of organic catalyst compound, such that the resulting molar ratio of said peroxygen compound to organic catalyst compound in a wash solution is preferably greater than 1:1, more preferably greater than 10:1, even more preferably greater than 50:1. The preferred molar ratio ranges of peroxygen compound to cationic organic catalyst compound range from about 30,000:1 to about 10:1, even more preferably from about 10,000:1 to about 50:1, yet even more preferably from about 5,000:1 to about 100:1, still even more preferably from about 3,500:1 to about 150:1.

The conversion values (in ppm) are provided for exemplary purposes, based on an in-use product concentration of 1000 ppm. A 1000 ppm wash solution of a product containing 0.2% organic catalyst compound by weight results in a organic catalyst compound concentration of 2 ppm. Similarly, a 3500 ppm wash solution of a product containing 0.2% organic catalyst compound by weight results in a organic catalyst compound concentration of 6.5 ppm.

The method for delivering organic catalyst compounds of the present invention and the method for delivering bleaching compositions (products) containing such organic catalyst compounds that are particularly useful in the methods of the present invention are the organic catalyst compounds and compositions containing same that satisfy the preferred method for bleaching a stained substrate in an aqueous medium with a peroxygen source and with an organic catalyst compound whose structures is defined herein and wherein said medium contains active oxygen from the peroxygen compound from about 0.05 to about 250 ppm per liter of medium, and said organic catalyst compound from 0.001 ppm to about 5 ppm, preferably from about 0.01 ppm to about 3 ppm, more preferably from about 0.1 ppm to about 2 ppm, and most preferably from about 0.2 ppm to about 1 ppm.

Such a preferred method for bleaching a stained substrate in an aqueous medium with a peroxygen source and with an organic catalyst compound is of particular value for those applications in which the color safety of the stained substrate in need of cleaning is a concern. In such applications the preferred embodiment (e.g., 0.01 ppm to about 3 ppm) is of particular importance in terms of achieving acceptable fabric color safety. For other applications in which color safety of the stained substrate in need of cleaning is of less concern, a higher in-use concentration may be preferred.

Decomposition of Organic Catalysts

The organic catalysts, specifically the bleach boosting compounds of the present invention are susceptible to decomposition by various decomposition pathways including, but not limited to, the aromatization pathway. The aromatization (decomposition) reaction of 6-membered ring boosters is well known in the art, as exemplified, without being limited by theory, in Hanquet et al., *Tetrahedron* 1993, 49, pp. 423–438. Other means of decomposition include, but are not limited to, attack on the bleach boosting compound and/or on the bleaching species by nucleophiles, including but not limited to attack by hydroxide anion, perhydroxide anion, carboxylate anion, percarboxylate anion and other nucleophiles present under in-wash conditions. For example, and without intending to be bound by theory, the decomposition reaction of a 6-membered ring oxaziridinium, the overall process of which can lead to reduced bleaching efficiency, is exemplified as set forth below:

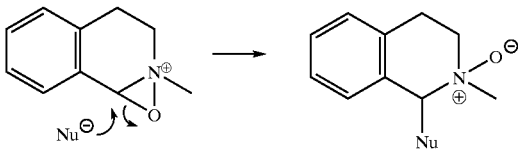

Methods for Delayed (Controlled) Addition of Organic Catalyst Compounds it has surprisingly been found with organic catalyst compounds of limited lifetime, that the addition of organic catalyst compounds by a delivery means to a wash solution after a fabric has been added to a wash solution provides enhanced bleaching compared to the addition of such organic catalyst compounds to the wash solution before a fabric has been added to the wash solution. It is believed, without being limited by theory, that the organic catalyst compound undergoes decomposition in the wash solution prior to the introduction of the fabric load. One method for improving the performance of organic catalyst compounds is to delay the addition of the organic catalyst compound of the present invention to the wash solution. Another method of improving the performance of organic catalyst compounds is to use an organic catalyst compound with increased stability to the wash conditions. The present invention is directed to the latter method, although additional benefits can be achieved by using both the latter and the former method. Methods for delayed (controlled) addition of organic catalyst compounds are more fully described in copending and co-owned U.S. Provisional Patent Application entitled "Controlled Availability of Formulation Components, Compositions and Laundry Methods Employing Same" filed Aug. 27, 1999.

Bleaching Compositions Comprising Organic Catalyst Compounds

In addition to the use of organic catalyst compounds discussed above, the organic catalyst compounds of the present invention may be employed in conjunction with a peroxygen source in other bleaching compositions, regardless of their form. For example, the organic catalyst compounds may be employed in a laundry additive product.

In the bleaching compositions of the present invention, the peroxygen source may be present in levels of from about 0.1% (1 ppm) to about 60% (600 ppm) by weight of the composition, and preferably from about 1% (10 ppm) to about 40% (400 ppm) by weight of the composition, and the organic catalyst compound may be present from about 0.00001% (0.0001 ppm) to about 10% (100 ppm) by weight of the composition, and preferably from about 0.0001% (0.001 ppm) to about 1% (10 ppm) by weight of the composition, more preferably from about 0.001% (0.01 ppm) to about 0.5% (5 ppm), even more preferably from about 0.004% (0.04 ppm) to about 0.25% (2.5 ppm). Most preferably from about 0.01% (0.1 ppm) to about 0.1% (1 ppm).

The organic catalyst compounds and bleaching compositions comprising the organic catalyst compounds of the present invention may be advantageously employed in laundry applications, hard surface cleaning, automatic dishwashing applications, whitening and/or bleaching applications associated with wood pulp and/or textiles, antimicrobial and/or disinfectant applications, as well as cosmetic applications such as dentures, teeth, hair and skin. However, due to the unique advantages of increased effectiveness in cold and possibly warm water solutions due to possible increased stability, the organic catalyst compounds of the present invention are ideally suited for laundry applications such as the bleaching of fabrics through the use of bleach-containing detergents or laundry bleach additives. Furthermore, the bleach boosting compounds of the present invention may be employed in granular, powder, bar, paste, foam, gel and liquid compositions.

Accordingly, the bleaching compositions of the present invention may include various additional ingredients which are desirable in laundry applications. Such ingredients include detersive surfactants, bleach catalysts, builders, chelating agents, enzymes, polymeric soil release agents, brighteners and various other ingredients. Compositions including any of these various additional ingredients preferably have a pH of about 6 to about 12, preferably from about 8 to about 10.5 in a 1% solution of the bleaching composition. The bleaching compositions preferably include at least one detersive surfactant, at least one chelating agent, at least one detersive enzyme and preferably has a pH of about 6 to about 12, preferably from about 8 to about 10.5 in a 1% solution of the bleaching composition.

In another embodiment of the present invention, a method for laundering a fabric in need of laundering is provided. The preferred method comprises contacting the fabric with a laundry solution. The fabric may comprise most any fabric capable of being laundered in normal consumer use conditions. The laundry solution comprises a bleaching composition, as fully described herein. The water temperatures preferably range from about 0° C. to about 50° C. or higher. The water to fabric ratio is preferably from about 1:1 to about 15:1. The laundry solution may further include at least one additional ingredient selected from the group consisting of detersive surfactants, chelating agents, detersive enzymes and mixtures thereof. Preferably, the laundry solution has a pH of about 6 to about 12, preferably from about 8 to about 10.5 in a 1% solution of the bleaching composition.

In accordance with another aspect of the present invention, a laundry additive product is provided. The laundry additive product comprises an organic catalyst compound, as fully described above. Such a laundry additive product would be ideally suited for inclusion in a wash process when additional bleaching effectiveness is desired. Such instances may include, but are not limited to, low-temperature and medium temperature solution laundry application.

It is desirable that the laundry additive product further includes a peroxygen source, as fully described above. The laundry additive product can also include powdered or liquid compositions containing a hydrogen peroxide source or a peroxygen source as fully defined above.

Furthermore, if the laundry additive product includes a hydrogen peroxide source, it is desirable that the laundry additive product further includes a bleach activator, as fully described above.

Preferably, the laundry additive product is packaged in dosage form for addition to a laundry process where a source of peroxygen is employed and increased bleaching effectiveness is desired. Such single dosage form may comprise a pill, tablet, gelcap or other single dosage unit such as pre-measured powders or liquids. A filler or carrier material may be included to increase the volume of composition if desired. Suitable filler or carrier materials may be selected from but not limited to various salts of sulfate, carbonate and silicate as well as talc, clay and the like. Filler or carrier materials for liquid compositions may be water or low molecular weight primary and secondary alcohols including polyols and diols. Examples include methanol, ethanol, propanol and isopropanol. Monohydric alcohols may also be employed. The compositions may contain from about 5% to about 90% of such materials. Acidic fillers can be used to reduce pH.

A preferred bleaching composition is a bleaching composition comprising:

(a) a peroxygen source; and (b) one or more organic catalyst compounds;

wherein the organic catalyst compounds becomes active in a wash solution containing said bleaching composition a period of time after said peroxygen source becomes active. The peroxygen source, like discussed above, is preferably selected from the group consisting of:

(i) preformed peracid compounds selected from the group consisting of percarboxylic acids and salts, percarbonic acids and salts, perimidic acids and salts, peroxymonosulfuric acids and salts, and mixtures thereof, and (ii) hydrogen peroxide sources selected from the group consisting of perborate compounds, percarbonate compounds, perphosphate compounds and mixtures thereof, and a bleach activator.

Preferably, the peroxygen source is selected from hydrogen peroxide sources selected from the group consisting of perborate compounds, percarbonate compounds, perphosphate compounds and mixtures thereof, and a bleach activator.

More preferably, the bleach activator is selected from the group consisting of hydrophobic bleach activators as disclosed herein.

The period of time between the peracid becoming active in a wash solution and the organic catalyst compounds becoming active can be in the range of from about 1 second to about 24 hours. Alternatively, since the organic catalyst compounds are relatively stable in the wash solution, the peracid can become active in the wash solution after the organic catalyst compound becomes active or available.

The purpose of a delayed addition bleaching composition (which may or may not be used in conjunction with this invention) is to allow the peracid to achieve maximum bleaching performance on a fabric in need of cleaning, such as a stained fabric, in a wash solution prior to the introduction of the organic catalyst compound. In other words, a bleaching composition comprising a organic catalyst compound which becomes active in a wash solution after a fabric in need of cleaning has been added to the wash solution. Alternatively, since the organic catalyst compounds can have increased stability, a bleaching composition comprising an organic catalyst compound which becomes active in a wash solution prior to a fabric in need of cleaning has been added to the wash solution may be used.

The bleaching compositions of the present invention also comprise, in addition to one or more organic catalysts, described hereinbefore, one or more cleaning adjunct materials, preferably compatible with the organic catalyst(s) and/or any enzymes present in the bleaching composition. The term "compatible", as used herein, means the bleaching composition materials do not reduce the bleaching activity of the organic catalyst and/or any enzymatic activity of any enzyme present in the bleaching composition to such an extent that the organic catalyst and/or enzyme is not effective as desired during normal use situations. The term "cleaning adjunct materials", as used herein, means any liquid, solid or gaseous material selected for the particular type of bleaching composition desired and the form of the product (e.g., liquid; granule; powder; bar; paste; spray; tablet; gel; foam composition), which materials are also preferably compatible with the protease enzyme(s) and bleaching agent(s) used in the composition. Granular compositions can also be in "compact" form and the liquid compositions can also be in a "concentrated" form.

The specific selection of cleaning adjunct materials are readily made by considering the surface, item or fabric to be cleaned, and the desired form of the composition for the cleaning conditions during use (e.g., through the wash detergent use). Examples of suitable cleaning adjunct materials include, but are not limited to, surfactants, builders, bleaches, bleach activators, bleach catalysts, other enzymes, enzyme stabilizing systems, chelants, optical brighteners, soil release polymers, dye transfer agents, dispersants, suds suppressors, dyes, perfumes, colorants, filler salts, hydrotropes, photoactivators, fluorescers, fabric conditioners, hydrolyzable surfactants, preservatives, antioxidants, anti-shrinkage agents, anti-wrinkle agents, germicides, fungicides, color speckles, silvercare, anti-tarnish and/or anti-corrosion agents, alkalinity sources, solubilizing agents, carriers, processing aids, pigments and pH control agents as described in U.S. Pat. Nos. 5,705,464, 5,710,115, 5,698,504, 5,695,679, 5,686,014 and 5,646,101. Specific bleaching composition materials are exemplified in detail hereinafter.

If the cleaning adjunct materials are not compatible with the protease variant(s) in the bleaching compositions, then suitable methods of keeping the cleaning adjunct materials and the protease variant(s) separate (not in contact with each other) until combination of the two components is appropriate can be used. Suitable methods can be any method known in the art, such as gelcaps, encapulation, tablets, physical separation, etc.

Such bleaching compositions include detergent compositions for cleaning hard surfaces, unlimited in form (e.g., liquid, granular, paste, foam, spray, etc.); detergent compositions for cleaning fabrics, unlimited in form (e.g., granular, liquid, bar formulations, etc.); dishwashing compositions (unlimited in form and including both granular and liquid automatic dishwashing); oral bleaching compositions, unlimited in form (e.g., dentifrice, toothpaste and mouthwash formulations); and denture bleaching compositions, unlimited in form (e.g., liquid, tablet).

The fabric bleaching compositions of the present invention are mainly intended to be used in the wash cycle of a washing machine; however, other uses can be contemplated, such as pretreatment product for heavily-soiled fabrics, or soaking product; the use is not necessarily limited to the washing-machine context, and the compositions of the present invention can be used alone or in combination with compatible handwash compositions.

The bleaching compositions may include from about 1% to about 99.9% by weight of the composition of the cleaning adjunct materials.

As used herein, "non-fabric bleaching compositions" include hard surface bleaching compositions, dishwashing compositions, oral bleaching compositions, denture bleaching compositions and personal cleansing compositions.

When the bleaching compositions of the present invention are formulated as compositions suitable for use in a laundry machine washing method, the compositions of the present invention preferably contain both a surfactant and a builder compound and additionally one or more cleaning adjunct materials preferably selected from organic polymeric compounds, bleaching agents, additional enzymes, suds suppressors, dispersants, lime-soap dispersants, soil suspension and anti-redeposition agents and corrosion inhibitors. Laundry compositions can also contain softening agents, as additional cleaning adjunct materials.

The compositions of the present invention can also be used as detergent additive products in solid or liquid form. Such additive products are intended to supplement or boost the performance of conventional detergent compositions and can be added at any stage of the cleaning process.

When formulated as compositions for use in manual dishwashing methods the compositions of the invention preferably contain a surfactant and preferably other cleaning adjunct materials selected from organic polymeric compounds, suds enhancing agents, group II metal ions, solvents, hydrotropes and additional enzymes.

If needed the density of the laundry detergent compositions herein ranges from 400 to 1200 g/liter, preferably 500 to 950 g/liter of composition measured at 20° C.

The "compact" form of the bleaching compositions herein is best reflected by density and, in terms of composition, by the amount of inorganic filler salt; inorganic filler salts are conventional ingredients of detergent compositions in powder form; in conventional detergent compositions, the filler salts are present in substantial amounts, typically 17–35% by weight of the total composition. In the compact compositions, the filler salt is present in amounts not exceeding 15% of the total composition, preferably not exceeding 10%, most preferably not exceeding 5% by weight of the composition. The inorganic filler salts, such as meant in the present compositions are selected from the alkali and alkaline-earth-metal salts of sulfates and chlorides. A preferred filler salt is sodium sulfate.

Liquid bleaching compositions according to the present invention can also be in a "concentrated form", in such case, the liquid bleaching compositions according the present invention will contain a lower amount of water, compared to conventional liquid detergents. Typically the water content of the concentrated liquid bleaching composition is preferably less than 40%, more preferably less than 30%, most preferably less than 20% by weight of the bleaching composition.

Cleaning Adjunct Materials

While not essential for the purposes of the present invention, several conventional cleaning adjunct materials illustrated hereinafter are suitable for use in the instant bleaching compositions and may be desirably incorporated in preferred embodiments of the invention, for example to assist or enhance cleaning performance, for treatment of the substrate to be cleaned, or to modify the aesthetics of the bleaching composition as is the case with perfumes, colorants, dyes or the like. The precise nature of these additional components, and levels of incorporation thereof, will depend on the physical form of the composition and the nature of the cleaning operation for which it is to be used. Unless otherwise indicated, the bleaching compositions of the invention may for example, be formulated as granular or powder-form all-purpose or "heavy-duty" washing agents, especially laundry detergents; liquid, gel or paste-form all-purpose washing agents, especially the so-called heavy-duty liquid types; liquid fine-fabric detergents; hand dishwashing agents or light duty dishwashing agents, especially those of the high-foaming type; machine dishwashing agents, including the various tablet, granular, liquid and rinse-aid types for household and institutional use; liquid cleaning and disinfecting agents, including antibacterial hand-wash types, laundry bars, mouthwashes, denture cleaners, car or carpet shampoos, bathroom cleaners; hair shampoos and hair-rinses; shower gels and foam baths and metal cleaners; as well as cleaning auxiliaries such as bleach additives and "stain-stick" or pre-treat types.

Bleaching System—In addition to the organic catalyst of the present invention, the bleaching compositions of the present invention preferably comprise a bleaching system. Bleaching systems typically comprise a peroxygen source. Peroxygen sources are well-known in the art and the peroxygen source employed in the present invention may comprise any of these well known sources, including peroxygen compounds as well as compounds which under consumer use conditions provide an effective amount of peroxygen in situ. The peroxygen source may include a hydrogen peroxide source, the in situ formation of a peracid anion through the reaction of a hydrogen peroxide source and a bleach activator, preformed peracid compounds or mixtures of suitable peroxygen sources. Of course, one of ordinary skill in the art will recognize that other sources of peroxygen may be employed without departing from the scope of the invention. Preferably, the peroxygen source is selected from the group consisting of:

(i) preformed peracid compounds selected from the group consisting of percarboxylic acids and salts, percarbonic acids and salts, perimidic acids and salts, peroxymonosulfuric acids and salts, and mixtures thereof, and (ii) hydrogen peroxide sources selected from the group consisting of perborate compounds, percarbonate compounds, perphosphate compounds and mixtures thereof, and a bleach activator.

When present, peroxygen sources (peracids and/or hydrogen peroxide sources) will typically be at levels of from about 1%, preferably from about 5% to about 30%, preferably to about 20% by weight of the composition. If present, the amount of bleach activator will typically be from about 0.1%, preferably from about 0.5% to about 60%, preferably to about 40% by weight, of the bleaching composition comprising the bleaching agent-plus-bleach activator.

a. Preformed Peracids—The preformed peracid compound as used herein is any convenient compound which is stable and which under consumer use conditions provides an effective amount of peracid anion. The organic catalyst compounds of the present invention may of course be used in conjunction with a preformed peracid compound selected from the group consisting of percarboxylic acids and salts, percarbonic acids and salts, perimidic acids and salts, peroxymonosulfuric acids and salts, and mixtures thereof, examples of which are described in U.S. Pat. No. 5,576,282 to Miracle et al.

One class of suitable organic peroxycarboxylic acids have the general formula:

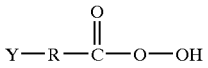

wherein R is an alkylene or substituted alkylene group containing from 1 to about 22 carbon atoms or a phenylene or substituted phenylene group, and Y is hydrogen, halogen, alkyl, aryl, —C(O)OH or —C(O)OOH.

Organic peroxyacids suitable for use in the present invention can contain either one or two peroxy groups and can be either aliphatic or aromatic. When the organic peroxycarboxylic acid is aliphatic, the unsubstituted peracid has the general formula:

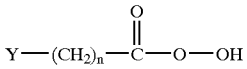

where Y can be, for example, H, $CH_3$, $CH_2Cl$, C(O)OH, or C(O)OOH; and n is an integer from 0 to 20. When the organic peroxycarboxylic acid is aromatic, the unsubstituted peracid has the general formula:

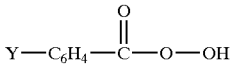

wherein Y can be, for example, hydrogen, alkyl, alkylhalogen, halogen, C(O)OH or C(O)OOH.

Typical monoperoxy acids useful herein include alkyl and aryl peroxyacids such as:

(i) peroxybenzoic acid and ring-substituted peroxybenzoic acid, e.g. peroxy-a-naphthoic acid, monoperoxyphthalic acid (magnesium salt hexahydrate), and o-carboxybenzamidoperoxyhexanoic acid (sodium salt);

(ii) aliphatic, substituted aliphatic and arylalkyl monoperoxy acids, e.g. peroxylauric acid, peroxystearic acid, N-nonanoylaminoperoxycaproic acid (NAPCA), N,N-(3-octylsuccinoyl)aminoperoxycaproic acid (SAPA) and N,N-phthaloylaminoperoxycaproic acid (PAP);

(iii) amidoperoxyacids, e.g. monononylamide of either peroxysuccinic acid (NAPSA) or of peroxyadipic acid (NAPAA).

Typical diperoxyacids useful herein include alkyl diperoxyacids and aryldiperoxyacids, such as:

(iv) 1,1 2-diperoxydodecanedioic acid;

(v) 1,9-diperoxyazelaic acid;

(vi) diperoxybrassylic acid; diperoxysebacic acid and diperoxyisophthalic acid;

(vii) 2-decyidiperoxybutane-1,4-dioic acid;

(viii) 4,4'-sulfonylbisperoxybenzoic acid.

Such bleaching agents are disclosed in U.S. Pat. No. 4,483,78 1, Hartman, issued Nov. 20, 1984, U.S. Pat. No. 4,634,551 to Burns et al., European Patent Application 0,133,354, Banks et al. published Feb. 20, 1985, and U.S. Pat. No. 4,412,934, Chung et al. issued Nov. 1, 1983. Sources also include 6nonylamino-6-oxoperoxycaproic acid as fully described in U.S. Pat. No. 4,634,551, issued Jan. 6, 1987 to Burns et al. Persulfate compounds such as for example OXONE, manufactured commercially by E.I. DuPont de Nemours of Wilmington, Del. can also be employed as a suitable source of peroxymonosulfuric acid.

b. Hydrogen Peroxide Sources—The hydrogen peroxide source may be any suitable hydrogen peroxide source and present at such levels as fully described in U.S. Pat. No. 5,576,282. For example, the hydrogen peroxide source may be selected from the group consisting of perborate compounds, percarbonate compounds, perphosphate compounds and mixtures thereof.

Hydrogen peroxide sources are described in detail in the herein incorporated Kirk Othmer's Encyclopedia of Chemical Technology, 4th Ed (1992, John Wiley & Sons), Vol. 4, pp. 271–300 "Bleaching Agents (Survey)", and include the various forms of sodium perborate and sodium percarbonate, including various coated and modified forms.

The preferred source of hydrogen peroxide used herein can be any convenient source, including hydrogen peroxide itself. For example, perborate, e.g., sodium perborate (any hydrate but preferably the mono- or tetra-hydrate), sodium carbonate peroxyhydrate or equivalent petcarbonate salts, sodium pyrophosphate peroxyhydrate, urea peroxyhydrate, or sodium peroxide can be used herein. Also useful are sources of available oxygen such as persulfate bleach (e.g., OXONE, manufactured by DuPont). Sodium perborate monohydrate and sodium percarbonate are particularly preferred. Mixtures of any convenient hydrogen peroxide sources can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with a silicate, borate or water-soluble surfactants. Percarbonate is available from various commercial sources such as FMC, Solvay and Tokai Denka Compositions of the present invention may also comprise as the bleaching agent a chlorine-type bleaching material. Such agents are well known in the art, and include for example sodium dichloroisocyanurate ("NaDCC"). However, chlorine-type bleaches are less preferred for compositions which comprise enzymes.

b. Bleach Activators—Preferably, the peroxygen source in the composition is formulated with an activator (peracid precursor). The activator is present at levels of from about 0.01%, preferably from about 0.5%, more preferably from about 1% to about 15%, preferably to about 10%, more preferably to about 8%, by weight of the composition. A bleach activator as used herein is any compound which when used in conjunction with a hydrogen peroxide source leads to the in situ production of the peracid corresponding to the bleach activator. Various non limiting examples of activators are fully disclosed in U.S. Pat. Nos. 5,576,282, 4,915,854 and 4,412,934. See also U.S. Pat. No. 4,634,551 for other typical bleaches and activators useful herein.

Preferred activators are selected from the group consisting of tetraacetyl ethylene diamine (TAED), benzoylcaprolactam (BzCL), 4-nitrobenzoylcaprolactam, 3-chlorobenzoylcaprolactam, benzoyloxybenzenesulphonate (BOBS), nonanoyloxybenzenesulphonate (NOBS), phenyl benzoate (PhBz), decanoyloxybenzenesulphonate ($C_{10}$-OBS), benzoylvalerolactam (BZVL), octanoyloxybenzenesulphonate ($C_8$-OBS), perhydrolyzable esters and mixtures thereof, most preferably benzoylcaprolactam and benzoylvalerolactam. Particularly preferred bleach activators in the pH range from about 8 to about 9.5 are those selected having an OBS or VL leaving group.

Preferred hydrophobic bleach activators include, but are not limited to, nonanoyloxybenzenesulphonate (NOBS), 4-[N-(nonanoyl) amino hexanoyloxy]-benzene sulfonate sodium salt (NACA-OBS) an example of which is described in U.S. Pat. No. 5,523,434, lauroyloxybenzenesulphonate (LOBS or $C_{12}$-OBS), 10-undecenoyloxybenzenesulfonate (UDOBS or $C_{11}$-OBS with unsaturation in the 10 position), and decanoyloxybenzoic acid (DOBA).

Preferred bleach activators are those described in U.S. Pat. No. 5,698,504 Christie et al., issued Dec. 16, 1997; U.S. Pat. No. 5,695,679 Christie et al. issued Dec. 9, 1997; U.S. Pat. No. 5,686,401 Willey et al., issued Nov. 11, 1997; U.S. Pat. No. 5,686,014 Hartshorn et al., issued Nov. 11, 1997; U.S. Pat. No. 5,405,412 Willey et al., issued Apr. 11, 1995; U.S. Pat. No. 5,405,413 Willey et al., issued Apr. 11, 1995; U.S. Pat. No. 5,130,045 Mitchel et al., issued Jul. 14, 1992; and U.S. Pat. No. 4,412,934 Chung et al., issued Nov. 1, 1983, and copending patent applications U.S. Ser. Nos. 08/709,072, 08/064,564, all of which are incorporated herein by reference.

The mole ratio of peroxygen bleaching compound (as AvO) to bleach activator in the present invention generally ranges from at least 1:1, preferably from about 20:1, more preferably from about 10:1 to about 1:1, preferably to about 3:1.

Quaternary substituted bleach activators may also be included. The present bleaching compositions preferably comprise a quaternary substituted bleach activator (QSBA) or a quaternary substituted peracid (QSP); more preferably, the former. Preferred QSBA structures are further described in U.S. Pat. No. 5,686,015 Willey et al., issued Nov. 11, 1997; U.S. Pat. No. 5,654,421 Taylor et al., issued Aug. 5, 1997; U.S. Pat. No. 5,460,747 Gosselink et al., issued Oct. 24, 1995; U.S. Pat. No. 5,584,888 Miracle et al., issued Dec. 17, 1996; and U.S. Pat. No. 5,578,136 Taylor et al., issued Nov. 26, 1996; all of which are incorporated herein by reference.

Highly preferred bleach activators useful herein are amide-substituted as described in U.S. Pat. Nos. 5,698,504, 5,695,679, and 5,686,014 each of which are cited herein above. Preferred examples of such bleach activators include: (6-octanamidocaproyl) oxybenzenesulfonate, (6-nonanamidocaproyl)oxybenzenesulfonate, (6-decanamido caproyl)oxybenzenesulfonate and mixtures thereof.

Other useful activators, disclosed in U.S. Pat. Nos. 5,698,504, 5,695,679, 5,686,014 each of which is cited herein above and U.S. Pat. No. 4,966,723Hodge et al., issued Oct. 30, 1990, include benzoxazin-type activators, such as a $C_6H_4$ ring to which is fused in the 1,2-positions a moiety ——C(O)OC($R^1$)═N—.

Depending on the activator and precise application, good bleaching results can be obtained from bleaching systems having with in-use pH of from about 6 to about 13, preferably from about 9.0 to about 10.5. Typically, for example, activators with electron-withdrawing moieties are used for near-neutral or sub-neutral pH ranges. Alkalis and buffering agents can be used to secure such pH.

Acyl lactam activators, as described in U.S. Pat. Nos. 5,698,504, 5,695,679 and 5,686,014, each of which is cited herein above, are very useful herein, especially the acyl caprolactams (see for example WO 94-28102 A) and acyl valerolactams (see U.S. Pat. No. 5,503,639 Willey et al., issued Apr. 2, 1996 incorporated herein by reference).

d. Organic Peroxides, especially Diacyl Peroxides—In addition to the bleaching agents described above, the bleaching compositions of the present invention can optionally include organic peroxides. Organic peroxides are extensively illustrated in Kirk Othmer, Encyclopedia of Chemical Technology, Vol. 17, John Wiley and Sons, 1982 at pages 27–90 and especially at pages 63–72, all incorporated herein by reference. If a diacyl peroxide is used, it will preferably be one which exerts minimal adverse impact on spotting/filming.

e. Metal-containing Bleach Catalysts—The bleaching compositions can also optionally include metal-containing bleach catalysts, preferably manganese and cobalt-containing bleach catalysts.

One type of metal-containing bleach catalyst is a catalyst system comprising a transition metal cation of defined bleach catalytic activity, such as copper, iron, titanium, ruthenium tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra (methylenephosphonic acid) and water-soluble salts thereof. Such catalysts are disclosed in U.S. Pat. No. 4,430,243 Bragg, issued Feb. 2, 1982.

i. Manganese Metal Complexes—If desired, the compositions herein can be catalyzed by means of a manganese compound. Such compounds and levels of use are well known in the art and include, for example, the manganese-based catalysts disclosed in U.S. Pat. No. 5,576,282 Miracle et al., issued Nov. 19, 1996; U.S. Pat. No. 5,246,621 Favre et al., issued Sep. 21, 1993; U.S. 5,244,594 Favre et al., issued Sep. 14, 1993; U.S. Pat. No. 5,194,416 Jureller et al., issued Mar. 16, 1993; U.S. Pat. No. 5,114,606 van Vliet et al., issued May 19, 1992; and European Pat. App. Pub. Nos. 549,271 A1, 549,272 A1, 544,440 A2, and 544,490 A1; Preferred examples of these catalysts include $Mn^{IV}{}_2$(u-O)$_3$(1,4,7-trimethyl-1,4,7-triazacyclononane)$_2$-($PF_6$)$_2$, $Mn^{III}{}_2$(u-O)$_1$(u-OAc)$_2$(1,4,7-trimethyl-1,4,7-triazacyclononane)$_2$($ClO_4$)$_2$, $Mn^{IV}{}_4$(u-O)$_6$(1,4,7-triazacyclononane)$_4$($ClO_4$)$_4$, $Mn^{III}Mn^{IV}{}_4$(u-O)$_1$(u-OAc)$_2$-(1,4,7-trimethyl-1,4,7-triazacyclononane)$_2$($ClO_4$)$_3$, $Mn^{IV}$(1,4,7-trimethyl-1,4,7-triazacyclononane)-($OCH_3$)$_3$($PF_6$), and mixtures thereof. Other metal-based bleach catalysts include those disclosed in U.S. Pat. No. 4,430,243 included by reference herein above and U.S. Pat. No. 5,114,611 van Kralingen, issued May 19, 1992. The use of manganese with various complex ligands to enhance bleaching is also reported in the following: U.S. Pat. No. 4,728,455 Rerek, issued Mar. 1, 1988; U.S. Pat. No. 5,284,944 Madison, issued Feb. 8, 1994; U.S. Pat. No. 5,246,612 van Dijk et al., issued Sep. 21, 1993; U.S. Pat. No. 5,256,779 Kerschner et al., issued Oct. 26, 2993; U.S. Pat. No. 5,280,117 Kerschner et al., issued Jan. 18, 1994; U.S. Pat. No. 5,274,147 Kerschner et al., issued Dec. 28, 1993; U.S. Pat. No. 5,153,161 Kerschner et al., issued Oct. 6, 1992; and U.S. Pat. No. 5,227,984 Martens et al., issued Jul. 13, 1993.

ii. Cobalt Metal Complexes—Cobalt bleach catalysts useful herein are known, and are described, for example, in U.S. Pat. No. 5,597,936 Perkins et al., issued Jan. 28, 1997; U.S. Pat. No. 5,595,967 Miracle et al., Jan. 21, 1997; U.S. Pat. No. 5,703,030 Perkins et al., issued Dec. 30, 1997; and M. L. Tobe, "Base Hydrolysis of Transition-Metal Complexes", *Adv. Inorg. Bioinorg. Mech.,* (1983), 2, pages 1–94. The most preferred cobalt catalyst useful herein are cobalt pentaamine acetate salts having the formula [Co($NH_3$)$_5$OAc] Ty, wherein "OAc" represents an acetate moiety and "Ty" is an anion, and especially cobalt pentaamine acetate chloride, [Co($NH_3$)$_5$OAc]$Cl_2$; as well as [Co($NH_3$)$_5$OAc]($OAc$)$_2$; [Co($NH_3$)$_5$OAc]($PF_6$)$_2$; [CO $(NH_3)_5OAc](SO_4)$; $[Co(NH_3)_5OAc](BF_4)_2$; and $[Co(NH_3)_5OAc](NO_3)_2$ (herein "PAC").

These cobalt catalysts are readily prepared by known procedures, such as taught for example in U.S. Pat. Nos. 5,597,936, 5,595,967, 5,703,030, cited herein above, the Tobe article and the references cited therein, and in U.S. Pat. No. 4,810,410, to Diakun et al, issued Mar. 7, 1989, *J. Chem. Ed.* (1989), 66 (12), 1043–45; The Synthesis and Characterization of Inorganic Compounds, W. L. Jolly (Prentice-Hall; 1970), pp. 461–3; *Inorg. Chem.,* 18, 1497–1502 (1979); *Inorg. Chem.,* 21, 2881–2885 (1982); *Inorg. Chem.,* 18, 2023–2025 (1979); Inorg. Synthesis, 173–176 (1960); and *Journal of Physical Chemistry,* 56, 22–25 (1952).

iii. Transition Metal Complexes of Macropolyclic Rigid Ligands—Compositions herein may also suitably include as bleach catalyst a transition metal complex of a macropolycyclic rigid ligand. The phrase "macropolycyclic rigid ligand" is sometimes abbreviated as "MRL" in discussion below. The amount used is a catalytically effective amount, suitably about 1 ppb or more, for example up to about 99.9%, more typically about 0.001 ppm or more, preferably from about 0.05 ppm to about 500 ppm (wherein "ppb" denotes parts per billion by weight and "ppm" denotes parts per million by weight).

Suitable transition metals e.g., Mn are illustrated hereinafter. "Macropolycyclic" means a MRL is both a macrocycle and is polycyclic. "Polycyclic" means at least bicyclic. The term "rigid" as used herein herein includes "having a superstructure" and "cross-bridged". "Rigid" has been defined as the constrained converse of flexibility: see D. H. Busch., *Chemical Reviews.,* (1993), 93, 847–860, incorporated by reference. More particularly, "rigid" as used herein means that the MRL must be determinably more rigid than a macrocycle ("parent macrocycle") which is otherwise identical (having the same ring size and type and number of atoms in the main ring) but lacking a superstructure (especially linking moieties or, preferably cross-bridging moieties) found in the MRL's. In determining the comparative rigidity of macrocycles with and without superstructures, the practitioner will use the free form (not the metal-bound form) of the macrocycles. Rigidity is well-known to be useful in comparing macrocycles; suitable tools for determining, measuring or comparing rigidity include computational methods (see, for example, Zimmer, *Chemical Reviews,* (1995), 95(38), 2629–2648 or Hancock et al., *Inorganica Chimica Acta,* (1989), 164, 73–84.

Preferred MRL's herein are a special type of ultra-rigid ligand which is cross-bridged. A "cross-bridge" is nonlimitingly illustrated in 1.11 hereinbelow. In 1.11, the cross-bridge is a $—CH_2CH_2—$ moiety. It bridges $N^1$ and $N^8$ in the illustrative structure. By comparison, a "same-side" bridge, for example if one were to be introduced across $N^1$ and $N^{12}$ in 1.11, would not be sufficient to constitute a "cross-bridge" and accordingly would not be preferred.

Suitable metals in the rigid ligand complexes include Mn(II), Mn(III), Mn(IV), Mn(V), Fe(II), Fe(III), Fe(IV), Co(I), Co(II), Co(III), Ni(I), Ni(II), Ni(III), Cu(I), Cu(II), Cu(III), Cr(II), Cr(III), Cr(IV), Cr(V), Cr(VI), V(III), V(IV), V(V), Mo(IV), Mo(V), Mo(VI), W(IV), W(V), W(VI), Pd(II), Ru(II), Ru(III), and Ru(IV). Preferred transition-metals in the instant transition-metal bleach catalyst include manganese, iron and chromium.

More generally, the MRL's (and the corresponding transition-metal catalysts) herein suitably comprise:

(a) at least one macrocycle main ring comprising four or more heteroatoms; and (b) a covalently connected non-metal superstructure capable of increasing the rigidity of the macrocycle, preferably selected from (i) a bridging superstructure, such as a linking moiety;

(ii) a cross-bridging superstructure, such as a cross-bridging linking moiety; and (iii) combinations thereof.

The term "superstructure" is used herein as defined in the literature by Busch et al., see, for example, articles by Busch in "Chemical Reviews".

Preferred superstructures herein not only enhance the rigidity of the parent macrocycle, but also favor folding of the macrocycle so that it co-ordinates to a metal in a cleft. Suitable superstructures can be remarkably simple, for example a linking moiety such as any of those illustrated in FIG. 1 and FIG. 2 below, can be used.

FIG. 1

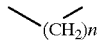

wherein n is an integer, for example from 2 to 8, preferably less than 6, typically 2 to 4, or

FIG. 2

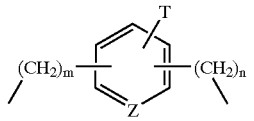

wherein m and n are integers from about 1 to 8, more preferably from 1 to 3; Z is N or CH; and T is a compatible substituent, for example H, alkyl, trialkylammonium, halogen, nitro, sulfonate, or the like. The aromatic ring in 1.10 can be replaced by a saturated ring, in which the atom in Z connecting into the ring can contain N, O, S or C.

Suitable MRL's are further nonlimitingly illustrated by the following compound:

FIG. 3

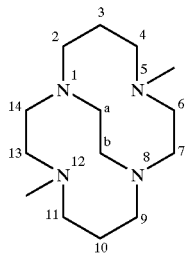

This is a MRL in accordance with the invention which is a highly preferred, cross-bridged, methyl-substituted (all nitrogen atoms tertiary) derivative of cyclam. Formally, this ligand is named 5,12-dimethyl-1,5,8,12-tetraazabicyclo[6.6.2]hexadecane using the extended von Baeyer system. See "A Guide to IUPAC Nomenclature of Organic Compounds: Recommendations 1993", R. Panico, W. H. Powell and J-C Richer (Eds.), Blackwell Scientific Publications, Boston, 1993; see especially section R-2.4.2.1.

Transition-metal bleach catalysts of Macrocyclic Rigid Ligands which are suitable for use in the invention compositions can in general include known compounds where they conform with the definition herein, as well as, more preferably, any of a large number of novel compounds expressly designed for the present laundry or cleaning uses, and non-limitingly illustrated by any of the following:

Dichloro-5,12-dimethyl- 1,5,8,12-tetraazabicyclo[6.6.2] hexadecane Manganese(II)

Diaquo-5,12-dimethyl-1,5,8,12-tetraazabicyclo[6.6.2] hexadecane Manganese(II) Hexafluorophosphate Aquo-hydroxy-5,12-dimethyl-1,5,8,12-tetraazabicyclo [6.6.2]hexadecane Manganese(III) Hexafluorophosphatc Diaquo-5,12-dimethyl-1,5,8,12-tetraazabicyclo[6.6.2] hexadecane Manganese(II) Tetrafluoroborate Dichloro-5,12-dimethyl-1,5,8,12-tetraazabicyclo[6.6.2] hexadecane Manganese(III) Hexafluorophosphate Dichloro-5,12-di-n-butyl-1,5,8,12-tetraaza bicyclo[6.6.2] hexadecane Manganese(II)

Dichloro-5,12-dibenzyl-1,5,8,12-tetraazabicyclo[6.6.2] hexadecane Manganese(II)

Dichloro-5-n-butyl-12-methyl-1,5,8,12-tetraaza-bicyclo [6.6.2]hexadecane Manganese(II)

Dichloro-5-n-octyl-12-methyl-1,5,8,12-tetraaza-bicyclo [6.6.2]hexadecane Manganese(II) Dichloro-5-n-butyl-12-methyl-1,5,8,12-tetraaza-bicyclo[6.6.2]hexadecane Manganese(II).

As a practical matter, and not by way of limitation, the compositions and cleaning processes herein can be adjusted to provide on the order of at least one part per hundred million of the active bleach catalyst species in the aqueous washing medium, and will preferably provide from about 0.01 ppm to about 25 ppm, more preferably from about 0.05 ppm to about 10 ppm, and most preferably from about 0.1 ppm to about 5 ppm, of the bleach catalyst species in the wash liquor. In order to obtain such levels in the wash liquor of an automatic washing process, typical compositions herein will comprise from about 0.0005% to about 0.2%, more preferably from about 0.004% to about 0.08%, of bleach catalyst, especially manganese or cobalt catalysts, by weight of the cleaning compositions.

Preferably, the peroxygen source is selected from hydrogen peroxide sources selected from the group consisting of perborate compounds, percarbonate compounds, perphosphate compounds and mixtures thereof, and a bleach activator.

Preferably, the bleach activator is selected from the group consisting of hydrophobic bleach activators as disclosed herein.

The purpose of such a bleaching composition is to mitigate unwanted decomposition of the organic catalyst, and to allow the peracid to achieve bleaching performance on a fabric in need of cleaning, such as a stained fabric, in a wash solution prior to the availability of the organic catalyst.

Surfactant System—Detersive surfactants included in the fully-formulated bleaching compositions afforded by the present invention comprises at least 0.01%, preferably at least about 0.1%, more preferably at least about 0.5%, most preferably at least about 1% to about 60%, more preferably to about 35%, most preferably to about 30% by weight of bleaching composition depending upon the particular surfactants used and the desired effects.

The detersive surfactant can be nonionic, anionic, ampholytic, zwitterionic, cationic, semi-polar nonionic, and mixtures thereof, nonlimiting examples of which are disclosed in U.S. Pat. Nos. 5,707,950 and 5,576,282. Preferred detergent and bleaching compositions comprise anionic detersive surfactants or mixtures of anionic surfactants with other surfactants, especially nonionic surfactants.

Anionic surfactants are highly preferred for use with the organic catalyst and bleaching compositions of the present invention.

Nonlimiting examples of surfactants useful herein include the conventional $C_{11}$–$C_{18}$ alkyl benzene sulfonates and primary, secondary and random alkyl sulfates, the $C_{10}$–$C_{18}$ alkyl alkoxy sulfates, the $C_{10}$–$C_{18}$ alkyl polyglycosides and their corresponding sulfated polyglycosides, $C_{12}$–$C_{18}$ alpha-sulfonated fatty acid esters, $C_{12}$–$C_{18}$ alkyl and alkyl phenol alkoxylates (especially ethoxylates and mixed ethoxy/propoxy), $C_{12}$–$C_{18}$ betaines and sulfobetaines ("sultanas"), $C_{10}$–$C_{18}$ amine oxides, and the like. Other conventional useful surfactants are listed in standard texts.

The surfactant is preferably formulated to be compatible with enzyme components present in the composition. In liquid or gel compositions the surfactant is most preferably formulated such that it promotes, or at least does not degrade, the stability of any enzyme in these compositions.

Nonionic Surfactants—Polyethylene, polypropylene, and polybutylene oxide condensates of alkyl phenols are suitable for use as the nonionic surfactant of the surfactant systems of the present invention, with the polyethylene oxide condensates being preferred. Commercially available nonionic surfactants of this type include Igepal™ CO-630, marketed by the GAF Corporation; and Triton™ X45, X114, X-100 and X-102, all marketed by the Rohm & Haas Company. These surfactants are commonly referred to as alkylphenol alkoxylates (e.g., alkyl phenol ethoxylates).

The condensation products of primary and secondary aliphatic alcohols with from about 1 to about 25 moles of ethylene oxide are suitable for use as the nonionic surfactant of the nonionic surfactant systems of the present invention. Examples of commercially available nonionic surfactants of this type include Tergitol™ 15-S-9 (the condensation product of $C_1$–$C_{15}$ linear alcohol with 9 moles ethylene oxide), Tergitol™ 24-L-6 NMW (the condensation product of $C_{12}$–$C_{14}$ primary alcohol with 6 moles ethylene oxide with a narrow molecular weight distribution), both marketed by Union Carbide Corporation; Neodol™ 45-9 (the condensation product of $C_{14}$–$C_{15}$ linear alcohol with 9 moles of ethylene oxide), Neodol™ 23-3 (the condensation product of $C_{12}$–$C_{13}$ linear alcohol with 3.0 moles of ethylene oxide), Neodo™ 45-7 (the condensation product of $C_{14}$–$C_{15}$ linear alcohol with 7 moles of ethylene oxide), Neodol™ 45-5 (the condensation product of($C_{14}$–$C_{15}$ linear alcohol with 5 moles of ethylene oxide) marketed by Shell Chemical Company, Kyro™ EOB (the condensation product of $C_{13}$–$C_{15}$ alcohol with 9 moles ethylene oxide), marketed by The Procter & Gamble Company, and Genapol LA O3O or O5O (the condensation product of $C_{12}$–$C_{14}$ alcohol with 3 or 5 moles of ethylene oxide) marketed by Hoechst. Preferred range of HLB in these products is from 8–11 and most preferred from 8–10.

Also useful as the nonionic surfactant of the surfactant systems of the present invention are the alkylpolysaccharides disclosed in U.S. Pat. No. 4,565,647.

Preferred alkylpolyglycosides have the formula: $R^2O(C_nH_{2n}O)_t(\text{glycosyl})_x$ wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7.

The condensation products of ethylene oxide with a hydrophobic base formed by the condensation of propylene oxide with propylene glycol are also suitable for use as the additional nonionic surfactant systems of the present invention. Examples of compounds of this type include certain of the commercially-available Plurafac™ LF404 and Pluronic™ surfactants, marketed by BASF.

Also suitable for use as the nonionic surfactant of the nonionic surfactant system of the present invention, are the condensation products of ethylene oxide with the product resulting from the reaction of propylene oxide and ethylenediamine. Examples of this type of nonionic surfactant include certain of the commercially available Tetronic™ compounds, marketed by BASF.

Preferred for use as the nonionic surfactant of the surfactant systems of the present invention are polyethylene oxide condensates of alkyl phenols, condensation products of primary and secondary aliphatic alcohols with from about 1 to about 25 moles of ethylene oxide, alkylpolysaccharides, and mixtures thereof. Most preferred are $C_8$–$C_{14}$ alkyl phenol ethoxylates having from 3 to 15 ethoxy groups and $C_8$–$C_{18}$ alcohol ethoxylates (preferably $C_{10}$ avg.) having from 2 to 10 ethoxy groups, and mixtures thereof.

Highly preferred nonionic surfactants are polyhydroxy fatty acid amide surfactants of the formula: $R^2$—C(O)—N($R^1$)—Z wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or $C_{16-18}$ alkyl or alkenyl chain such as coconut alkyl or mixtures thereof, and Z is derived from a reducing sugar such as glucose, fructose, maltose, lactose, in a reductive amination reaction.

Anionic Surfactants—Suitable anionic surfactants to be used are linear alkyl benzene sulfonate, alkyl ester sulfonate surfactants including linear esters of $C_8$–$C_{20}$ carboxylic acids (i.e., fatty acids) which are sulfonated with gaseous $SO_3$ according to "The Journal of the American Oil Chemists Society", 52 (1975), pp. 323–329. Suitable starting materials would include natural fatty substances as derived from tallow, palm oil, etc.

The preferred alkyl ester sulfonate surfactant, especially for laundry applications, comprise alkyl ester sulfonate surfactants of the structural formula:

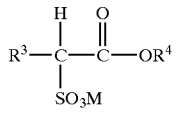

wherein $R^3$ is a $C_8$–$C_{20}$ hydrocarbyl, preferably an alkyl, or combination thereof, $R^4$ is a $C_1C_6$ hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations, such as monoethanolamine, diethanolamine, and triethanolamine. Preferably, $R^3$ is $C_{10}$–$C_{16}$ alkyl, and $R^4$ is methyl, ethyl or isopropyl. Especially preferred are the methyl ester sulfonates wherein $R^3$ is $C_{10}$–$C_{16}$ alkyl.

Other suitable anionic surfactants include the alkyl sulfate surfactants which are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation. Typically, alkyl chains of $C_{12}$–$C_{16}$ are preferred for lower wash temperatures (e.g. below about 50° C.) and $C_{16-18}$ alkyl chains are preferred for higher wash temperatures (e.g. above about 50° C.).

Other anionic surfactants useful for detersive purposes include salts of soap, $C_8$–$C_{22}$ primary of secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl glycerol sulfonates, fatty acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinates (especially saturated and unsaturated $C_{12}$–$C_{18}$ monoesters) and diesters of sulfosuccinates (especially saturated and unsaturated $C_6$–$C_{12}$ diesters), acyl sarcosinates, sulfates of alkylpolysaccharides such as the sulfates of alkylpolyglucoside (the nonionic nonsulfated compounds being described below), branched primary alkyl sulfates, and alkyl polyethoxy carboxylates such as those of the formula $RO(CH_2CH_2O)_k$—$CH_2COO$—M+wherein R is a $C_8$–$C_{22}$ alkyl, k is an integer from 1 to 10, and M is a soluble salt-forming cation. Resin acids and hydrogenated resin acids are also suitable, such as rosin, hydrogenated rosin, and resin acids and hydrogenated resin acids present in or derived from tall oil.

Further examples are described in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

Highly preferred anionic surfactants include alkyl alkoxylated sulfate surfactants hereof are water soluble salts or acids of the formula $RO(A)_mSO3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl, trimethylammonium cations and quaternary ammonium cations such as tetramethyl-ammonium and dimethyl piperdinium cations and those derived from alkylamines such as ethylamine, diethylamine, triethylamine, mixtures thereof, and the like. Exemplary surfactants are $C_{12}$–$C_{18}$ alkyl polyethoxylate (1.0) sulfate ($C_{12}$–$C_{18}$E(1.0)M), $C_{12}$–$C_{18}$ alkyl polyethoxylate (2.25) sulfate ($C_{12}$–$C_{18}$E(2.25)M), $C_{12}$–$C_{18}$ alkyl polyethoxylate (3.0) sulfate ($C_{12}$–$C_{12}$–$C_{18}$E(3.0)M), and $C_{12}$–$C_{18}$ alkyl polyethoxylate (4.0) sulfate ($C_{12}$–$C_{18}$E(4.0)M), wherein M is conveniently selected from sodium and potassium.

When included therein, the bleaching compositions of the present invention typically comprise from about 1%, preferably from about 3% to about 40%, preferably about 20% by weight of such anionic surfactants.

Cationic Surfactants—Cationic detersive surfactants suitable for use in the bleaching compositions of the present invention are those having one long-chain hydrocarbyl group. Examples of such cationic surfactants include the ammonium surfactants such as alkyltrimethylammonium halogenides, and those surfactants having the formula: $[R^2(OR^3)_y][R^4(OR^3)_y]_2R^5N+X$— wherein $R^2$ is an alkyl or alkyl benzyl group having from about 8 to about 18 carbon atoms in the alkyl chain, each $R^3$ is selected from the group consisting of —$CH_2CH_2$—, —$CH_2CH(CH_3)$—, —$CH_2CH(CH_2OH)$—, —$CH_2CH_2CH_2$—, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, —$CH_2CHOH$—$CHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Highly preferred cationic surfactants are the water-soluble quaternary ammonium compounds useful in the present composition having the formula (i): $R_1R_2R_3R^4N^+X^-$ wherein $R_1$ is $C_8$–$C_{16}$ alkyl, each of $R_2$, $R_3$ and $R_4$ is independently $C_1$–$C_4$ alkyl, $C_1$–$C_4$ hydroxy alkyl, benzyl, and —$(C_2H_{40})_xH$ where x has a value from 2 to 5, and X is an anion. Not more than one of $R_2$, $R_3$ or $R^4$ should be benzyl. The preferred alkyl chain length for $R^1$ is $C_{12}$–$C_{15}$ particularly where the alkyl group is a mixture of chain lengths derived from coconut or palm kernel fat or is derived synthetically by olefin build up or OXO alcohols synthesis. Preferred groups for $R_2$, $R_3$ and $R^4$ are methyl and hydroxyethyl groups and the anion X may be selected from halide, methosulfate, acetate and phosphate ions.

Examples of suitable quaternary ammonium compounds of formulae (i) for use herein are include, but are not limited to: coconut trimethyl ammonium chloride or bromide; coconut methyl dihydroxyethyl ammonium chloride or bromide; decyl triethyl ammonium chloride; decyl dimethyl hydroxyethyl ammonium chloride or bromide; $C_{12-15}$ dimethyl hydroxyethyl ammonium chloride or bromide; coconut dimethyl hydroxyethyl ammonium chloride or bromide; myristyl trimethyl ammonium methyl sulphate; lauryl dimethyl benzyl ammonium chloride or bromide; lauryl dimethyl $(ethenoxy)_4$ ammonium chloride or bromide; choline esters (compounds of formula (i) wherein $R_1$ is

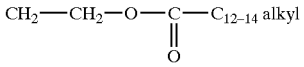

and $R_2R_3R^4$ are methyl); and di-alkyl imidazolines [(i)].

Other cationic surfactants useful herein are also described in U.S. Pat. No. 4,228,044, Cambre, issued Oct. 14, 1980 and in European Patent Application EP 000,224.

When included therein, the bleaching compositions of the present invention typically comprise from about 0.2%, preferably from about 1% to about 25%, preferably to about 8% by weight of such cationic surfactants.

Ampholytic Surfactants—Ampholytic surfactants, examples of which are described in U.S. Pat. No. 3,929,678, are also suitable for use in the bleaching compositions of the present invention.

When included therein, the bleaching compositions of the present invention typically comprise from about 0.2%, preferably from about 1% to about 15%, preferably to about 10% by weight of such ampholytic surfactants.

Zwitterionic Surfactants—Zwitterionic surfactants, examples of which are described in U.S. Pat. No. 3,929,678, are also suitable for use in bleaching compositions.

When included therein, the bleaching compositions of the present invention typically comprise from about 0.2%, preferably from about 1% to about 15%, preferably to about 10% by weight of such zwitterionic surfactants.

Semi-polar Nonionic Surfactants—Semi-polar nonionic surfactants are a special category of nonionic surfactants which include water-soluble amine oxides having the formula:

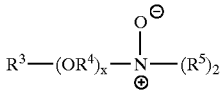

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups (the $R^5$ groups can be attached to each other, e.g., through an oxygen or nitrogen atom, to form a ring structure); water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

The amine oxide surfactants in particular include $C_{10}$–$C_{18}$ alkyl dimethyl amine oxides and $C_8$–$C_{12}$ alkoxy ethyl dihydroxy ethyl amine oxides.

When included therein, the cleaning compositions of the present invention typically comprise from about 0.2%, preferably from about 1% to about 15%, preferably to about 10% by weight of such semi-polar nonionic surfactants.

Cosurfactants—The bleaching compositions of the present invention may further comprise a cosurfactant selected from the group of primary or tertiary amines. Suitable primary amines for use herein include amines according to the formula $R_1NH_2$ wherein $R^1$ is a $C_6$–$C_{12}$, preferably $C_6$–$C_{10}$ alkyl chain or $R^4X(CH_2)_n$, X is —O—, —C(O)NH— or —NH—, $R_4$ *a is a* $C_6$–$C_{12}$ alkyl chain n is between 1 to 5, preferably 3. $R_1$ alkyl chains may be straight or branched and may be interrupted with up to 12, preferably less than 5 ethylene oxide moieties.

Preferred amines according to the formula herein above are n-alkyl amines. Suitable amines for use herein may be selected from 1-hexylamine, 1-octylamine 1-decylamine and laurylamine. Other preferred primary amines include C8–C10 oxypropylamine, octyloxypropylamine, 2-ethylhexyl-oxypropylamine, lauryl amido propylamine and amido propylamine. The most preferred amines for use in the compositions herein are 1-hexylamine, 1-octylamine, 1-decylamine, 1-dodecylamine. Especially desirable are n-dodecyldimethylamine and bishydroxyethylcoconutalkylamine and oleylamine 7 times ethoxylated, lauryl amido propylamine and cocoamido propylamine.

LFNIs—Particularly preferred surfactants in the automatic dishwashing compositions (ADD) of the present invention are low foaming nonionic surfactants (LFNI) which are described in U.S. Pat. Nos. 5,705,464 and 5,710,115. LFNI may be present in amounts from 0.01% to about 10% by weigh t,preferably from about 0.1% to about 10%, and most preferably from about 0.25% to about 4%. LFNIs are most typically used in ADDs on account of the improved water-sheeting action (especially from glass) which they confer to the ADD product. They also encompass non-silicone, nonphosphate polymeric materials further illustrated hereinafter which are known to defoam food soils encountered in automatic dishwashing.

Preferred LFNIs include nonionic alkoxylated surfactants, especially ethoxylates derived from primary alcohols, and blends thereof with more sophisticated surfactants, such as the polyoxypropylene/polyoxyethylene/polyoxypropylene (PO/EO/PO) reverse block polymers as described in U.S. Pat. Nos. 5,705,464 and 5,710,115.

LFNIs which may also be used include those POLY-TERGENT™ SLF-18 nonionic surfactants from Olin Corp., and any biodegradable LFNI having the melting point properties discussed hereinabove.

These and other nonionic surfactants are well known in the art, being described in more detail in Kirk Othmer's Encyclopedia of Chemical Technology, 3rd Ed., Vol. 22, pp. 360–379, "Surfactants and Detersive Systems", incorporated by reference herein.

Optional Detersive Enzymes—The detergent and bleaching compositions herein may also optionally contain one or more types of detergent enzymes. Such enzymes can include other proteases, amylases, cellulases and lipases. Such materials are known in the art and are commercially available under such trademarks as. They may be incorporated into the non-aqueous liquid detergent compositions herein in the form of suspensions, "marumes" or "prills". Another suitable type of enzymes comprises those in the form of slurries of enzymes in nonionic surfactants, e.g., the enzymes marketed by Novo Nordisk under the tradename "SL" or the microencapsulated enzymes. marketed by Novo Nordisk under the tradename "LDP." Suitable enzymes and levels of use are described in U.S. Pat. Nos. 5,576,282, 5,705,464 and 5,710,115.

Enzymes added to the compositions herein in the form of conventional enzyme prills are especially preferred for use herein. Such prills will generally range in size from about 100 to 1,000 microns, more preferably from about 200 to 800 microns and will be suspended throughout the non-aqueous liquid phase of the composition. Prills in the compositions of the present invention have been found, in comparison with other enzyme forms, to exhibit especially desirable enzyme stability in terms of retention of enzymatic activity over time. Thus, compositions which utilize enzyme prills need not contain conventional enzyme stabilizing such as must frequently be used when enzymes are incorporated into aqueous liquid detergents.

However, enzymes added to the compositions herein may be in the form of granulates, preferably T-granulates.

"Detersive enzyme", as used herein, means any enzyme having a cleaning, stain removing or otherwise beneficial effect in a laundry, bard surface cleaning or personal care detergent composition. Preferred detersive enzymes are hydrolases such as proteases, amylases and lipases. Preferred enzymes for laundry purposes include, but are not limited to, proteases, cellulases, lipases and peroxidases. Highly preferred for automatic dishwashing are amylases and/or proteases, including both current commercially available types and improved types which, though more and more bleach compatible though successive improvements, have a remaining degree of bleach deactivation susceptibility.

Examples of suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, and known amylases, or mixtures thereof.

Examples of such suitable enzymes are disclosed in U.S. Pat. Nos. 5,705,464, 5,710,115, 5,576,282, 5,728,671 and 5,707,950.

The cellulases useful in the present invention include both bacterial or fungal cellulases. Preferably, they will have a pH optimum of between 5 and 12 and a specific activity above 50 CEVU/mg (Cellulose Viscosity Unit). Suitable cellulases are disclosed in U.S. Pat. No. 4,435,307, J61078384 and WO96/02653 which discloses fungal cellulase produced respectively from Humicola. insolens, Trichoderma, Thielavia and Sporotrichum. EP 739 982 describes cellulases isolated from novel Bacillus species. Suitable cellulases are also disclosed in GB-A-2,075,028; GB-A-2,095,275; DE-OS-2,247,832 and WO95/26398.

Examples of such cellulases are cellulases produced by a strain of Humicola insolens (Humicola grisea var. thermoidea), particularly the Humicola strain DSM 1800.

Other suitable cellulases are cellulases originated from Humicola insolens having a molecular weight of about 50 KDa, an isoelectric point of 5.5 and containing 415 amino acids; and a ~43 kD endoglucanase derived from Humicola insolens, DSM 1800, exhibiting cellulase activity; a preferred endoglucanase component has the amino acid sequence disclosed in WO 91/17243. Also suitable cellulases are the EGIII cellulases from Trichoderma longibrachiatum described in WO94/21801 to Genencor. Especially suitable. cellulases are the cellulases having color care benefits. Examples of such cellulases are cellulases described in European patent application No. 91202879.2, filed Nov. 6, 1991 (Novo). Carezyme and Celluzyme (Novo Nordisk A/S) are especially useful. See also WO91/17244 and WO91/21801. Other suitable cellulases for fabric care and/or cleaning properties are described in WO96/34092, WO96/17994 and WO95/24471.

Cellulases, when present, are normally incorporated in the cleaning composition at levels from 0.0001% to 2% of pure enzyme by weight of the cleaning composition.

Peroxidase enzymes are used in combination with oxygen sources, e.g. percarbonate, perborate, persulfate, hydrogen peroxide, etc. and with a phenolic substrate as bleach enhancing molecule. They are used for "solution bleaching", i.e. to prevent transfer of dyes or pigments removed from substrates during wash operations to other substrates in the wash solution. Peroxidase enzymes are known in the art, and include, for example, horseradish peroxidase, ligninase and haloperoxidase such as chloro- and bromo-peroxidase. Suitable peroxidases and peroxidase-containing detergent compositions are disclosed, for example, in U.S. Pat. Nos. 5,705,464, 5,710,115, 5,576,282, 5,728,671 and 5,707,950, PCT International Application WO 89/099813, WO89/09813 and in European Patent application EP No. 91202882.6, filed on Nov. 6, 1991 and EP No. 96870013.8, filed Feb. 20, 1996. Also suitable is the laccase enzyme.

Enhancers are generally comprised at a level of from 0.1% to 5% by weight of total composition. Preferred enhancers are substituted phenthiazine and phenoxasine 10-Phenothiazinepropionicacid (PPT), 10-ethylphenothiazine-4-carboxylic acid (EPC), 10-phenoxazinepropionic acid (POP) and 10-methylpbenoxazine (described in WO 94/12621) and substituted syringates (C3–C5 substituted alkyl syringates) and phenols. Sodium percarbonate or perborate are preferred sources of hydrogen peroxide.

Said peroxidases are normally incorporated in the cleaning composition at levels from 0.0001% to .2% of pure enzyme by weight of the cleaning composition.

Enzymatic systems may be used as bleaching agents. The hydrogen peroxide may also be present by adding an enzymatic system (i.e. an enzyme and a substrate therefore) which is capable of generating hydrogen peroxide at the beginning or during the washing and/or rinsing process.

Such enzymatic systems are disclosed in EP Patent Application 91202655.6 filed Oct. 9, 1991.

Other preferred enzymes that can be included in the cleaning compositions of the present invention include lipases. Suitable lipase enzymes for detergent usage include those produced by microorganisms of the *Pseudomonas* group, such as *Pseudomonas stutzeri* ATCC 19.154, as disclosed in British Patent 1,372,034. Suitable lipases include those which show a positive immunological cross-reaction with the antibody of the lipase, produced by the microorganism Pseudomonas fluorescent IAM 1057. This lipase is available from Amano Pharmaceutical Co. Ltd., Nagoya, Japan, under the trade name Lipase P "Amano," hereinafter referred to as "Amano-P". Other suitable commercial lipases include Amano-CES, lipases ex *Chromobacter viscosum,* e.g. *Chromobacter viscosum* var. *lipolyticum* NRRLB 3673 from Toyo Jozo Co., Tagata, Japan; *Chromobacter viscosum lipases* from U.S. Biochemical Corp., U.S.A. and Disoynth Co., The Netherlands, and lipases ex *Pseudomonas gladioli.* Especially suitable lipases are lipases such as Ml Lipase$^R$ and Lipomax$^R$ (Gist-Brocades) and Lipolase$^R$ and Lipolase Ultra$^R$ (Novo) which have found to be very effective when used in combination with the compositions of the present invention. Also suitable are the lipolytic enzymes described in EP 258 068, WO 92/05249 and WO 95/22615 by Novo Nordisk and in WO 94/03578, WO 95/35381 and WO 96/00292 by Unilever.

Also suitable are cutinases [EC 3.1.1.50] which can be considered as a special kind of lipase, namely lipases which do not require interfacial activation. Addition of cutinases to cleaning compositions have been described in e.g. WO-A-88/09367 (Genencor); WO 90/09446 (Plant Genetic System) and WO 94/14963 and WO 94/14964 (Unilever).

Lipases and/or cutinases, when present, are normally incorporated in the cleaning composition at levels from 0.0001% to 2% of pure enzyme by weight of the cleaning composition.

In addition to the above referenced lipases, phospholipases may be incorporated into the cleaning compositions of the present invention. Nonlimiting examples of suitable phospholipases included: EC 3.1.1.32 Phospholipase A1; EC 3.1.1.4 Phospholipase A2; EC 3.1.1.5 Lysopholipase; EC 3.1.4.3 Phospholipase C; EC 3.1.4.4. Phospolipase D. Commercially available phospholipases include LECITASE® from Novo Nordisk A/S of Denmark and Phospholipase A2 from Sigma. When Phospolipase are included in the compositions of the present invention, it is preferred that amylases are also included. Without desiring to be bound by theory, it is believed that the combined action of the phospholipase and amylase provide substantive stain removal, especially on greasy/oily, starchy and highly colored stains and soils. Preferably, the phospholipase and amylase, when present, are incorporated into the compositions of the present invention at a pure enzyme weight ratio between 4500:1 and 1:5, more preferably between 50:1 and 1:1.

Suitable proteases are the subtilisins which are obtained from particular strains of *B. subtilis* and *B. licheniformis* (subtilisin BPN and BPN'). One suitable protease is obtained from a strain of *Bacillus,* having maximum activity throughout the pH range of 8–12, developed and sold as ESPERASE® by Novo Industries A/S of Denmark, hereinafter "Novo". The preparation of this enzyme and analogous enzymes is described in GB 1,243,784 to Novo. Proteolytic enzymes also encompass modified bacterial serine proteases, such as those described in European Patent Application Serial Number 87 303761.8, filed Apr. 28, 1987 (particularly pages 17, 24 and 98), and which is called herein "Protease B", and in European Patent Application 199,404, Venegas, published Oct. 29, 1986, which refers to a modified bacterial serine protealytic enzyme which is called "Protease A" herein. Suitable is the protease called herein "Protease C", which is a variant of an alkaline serine protease from *Bacillus* in which Lysine replaced arginine at position 27, tyrosine replaced valine at position 104, serine replaced asparagine at position 123, and alanine replaced threonine at position 274. Protease C is described in EP 90915958:4, corresponding to WO 91/06637, Published May 16, 1991. Genetically modified variants, particularly of Protease C, are also included herein.

A preferred protease referred to as "Protease D" is a carbonyl hydrolase as described in U.S. Pat. No. 5,677,272, and WO95/10591. Also suitable is a carbonyl hydrolase variant of the protease described in WO95/10591, having an amino acid sequence derived by replacement of a plurality of amino acid residues replaced in the precursor enzyme corresponding to position +210 in combination with one or more of the following residues +33, +62, +67, +76, +100, +101, +103, +104, +107, +128, +129, +130, +132, +135, +156, +158, +164, +166, +167, +170, +209, +215, +217, +218, and +222, where the numbered position corresponds to naturally-occurring subtilisin from *Bacillus amyloliquefaciens* or to equivalent amino acid residues in other carbonyl hydrolases or subtilisins, such as *Bacillus lentus* subtilisin (co-pending patent application U.S. Ser. No. 60/048,550, filed Jun. 4, 1997. and PCT International Application Serial No. PCT/IB98100853).

Also suitable for the present invention are proteases described in patent applications EP 251 446 and WO 91/06637, protease BLAP® described in WO91/02792 and their variants described in WO 95/23221.

See also a high pH protease from *Bacillus* sp. NCIMB 40338 described in WO 93/18140 A to Novo. Enzymatic detergents comprising protease, one or more other enzymes, and a reversible protease inhibitor are described in WO 92/03529 A to Novo. When desired, a protease having decreased adsorption and increased hydrolysis is available as described in WO 95/07791 to Procter & Gamble. A recombinant trypsin-like protease for detergents suitable herein is described in WO 94/25583 to Novo. Other suitable proteases are described in EP 516 200 by Unilever.

Particularly useful proteases are. described in PCT publications: WO 95130010; WO 95/30011; and WO 95/29979. Suitable proteases are commercially available as ESPERASE®, ALCALASE®, DURAZYM®, SAVINASE®, EVERLASE® and KANNASE® all from Novo Nordisk A/S of Denmark, and as MAXATASE®, MAXACAL®, PROPERASE® and MAXAPEM® all from Genencor International (formerly Gist-Brocades of The Netherlands).

Other particularly useful proteases are multiply-substituted protease variants comprising a substitution of an amino acid residue with another naturally occurring amino acid residue at an amino acid residue position corresponding to position 103 of *Bacillus amyloliquefaciens* subtilisin in combination with a substitution of an amino acid residue with another naturally occurring amino acid residue at one or more amino acid residue positions corresponding to positions 1, 3, 4, 8, 9, 10, 12, 13, 16, 17, 18, 19, 20, 21, 22, 24, 27, 33, 37, 38, 42, 43, 48, 55, 57, 58, 61, 62, 68, 72, 75, 76, 77, 78, 79, 86, 87, 89, 97, 98, 99, 101, 102, 104, 106, 107, 109, 111, 114, 116, 117, 119, 121, 123, 126, 128, 130, 131, 133, 134, 137, 140, 141, 142, 146, 147, 158, 159, 160, 166, 167, 170, 173, 174, 177, 181, 182, 183, 184, 185, 188, 192, 194, 198, 203, 204, 205, 206, 209, 210, 211, 212, 213, 214, 215, 216, 217, 218, 222, 224, 227, 228, 230, 232, 236, 237, 238, 240, 242, 243, 244, 245, 246, 247, 248, 249, 251, 252, 253, 254, 255, 256, 257, 258, 259, 260, 261, 262, 263, 265, 268, 269, 270, 271, 272, 274 and 275 of *Bacillus amyloliquefaciens* subtilisin; wherein when said protease variant includes a substitution of amino acid residues at positions corresponding to positions 103 and 76, there is also a substitution of an amino acid residue at one or more amino acid residue positions other than amino acid residue positions corresponding to positions 27, 99, 101, 104, 107, 109, 123, 128, 166, 204, 206, 210, 216, 217, 218, 222, 260, 265 or 274 of *Bacillus amyloliquefaciens* subtilisin and/or multiply-substituted protease variants comprising a substitution of an amino acid residue with another naturally occurring amino acid residue at one or more amino acid residue positions corresponding to positions 62, 212, 230, 232, 252 and 257 of *Bacillus amyloliquefaciens* subtilisin as described in PCT Published Application Nos. WO 99/20727, WO 99/20726, and WO 99/20723 all owned by The Procter & Gamble Company.

More preferably the protease variant includes a substitution set selected from the group consisting of:

12/76/103/104/130/222/245/261;
62/103/104/159/232/236/245/248/252;
62/103/104/159/213/232/236/245/248/252;
62/101/103/104/159/212/213/232/236/245/248/252;
68/103/104/159/232/236/245;
68/103/104/159/230/232/236/245;
68/103/104/159/209/232/236/245;
68/103/104/159/232/236/245/257;
68/76/103/104/159/213/232/236/245/260;
68/103/104/159/213/232/236/245/248/252;
68/103/104/159/183/232/236/245/248/252;
68/103/104/159/185/232/236/245/248/252;
68/103/104/159/185/210/232/236/245/248/252;
68/103/104/159/210/232/236/245/248/252;
68/103/104/159/213/232/236/245;
98/103/104/159/232/236/245/248/252;
98/102/103/104/159/212/232/236/245/248/252;
101/103/104/159/232/236/245/248/252;
102/103/104/159/232/236/245/248/252;
103/104/159/230/236/245;
103/104/159/232/236/245/248/252;
103/104/159/217/232/236/245/248/252;
103/104/130/159/232/236/245/248/252;
103/104/131/159/232/236/245/248/252;
103/104/159/213/232/236/245/248/252; and
103/104/159/232/236/245.

Still even more preferably the protease variant includes a substitution set selected from the group consisting of:

12R/76D/103A/104T/130T/222S/245R/261D;
62D/103A/104I/159D/232V/236H/245R/248D/252K;
62D/103A/104I/159D/213R/232V/236H/245R/248D/252K;
68A/103A/104I/159D/209W/232V/236H/245R;
68A/76D/103A/104I/159D/213R/232V/236H/245R/260A;
68A/103A/104I/159D/213E/232V/236H/245R/248D/252K;
68A/103A/104I/159D/183D/232V/236H/245R/248D/252K;
68A/103A/104I/159D/232V/236H/245R;
68A/103A/104I/159D/230V/232V/236H/245R;
68A/103A/104I/159D/232V/236H/245R/257V;
68A/103A/104I/159D/213G/232V/236H/245R/248D/252K;
68A/103A/104I/159D/185D/232V/236H/245R/248D/252K;
68A/103A/104I/159D/185D/210L/232V/236H/245R/248D/252K;
68A/103A/104I/159D/210L/232V/236H/245R/248D/252K;
68A/103A/104I/159D/213G/232V/236H/245R;
98L/103A/104I/159D/232V/236H/245R/248D/252K;

-continued

98L/102A/103A/104I/159D/212G/232V/236H/245R/248D/252K;
101G/103A/104I/159D/232V/236H/245R/248D/252K;
102A/103A/104I/159D/232V/236H/245R/248D/252K;
103A/104I/159D/230V/236H/245R;
103A/104I/159D/232V/236H/245R/248D/252K;
103A/104I/159D/217E/232V/236H/245R/248D/252K;
103A/104I/130G/159D/232V/236H/245R/248D/252K;
103A/104I/131V/159D/232V/236H/245R/248D/252K;
103A/104I/159D/213R/232V/236H/245R/248D/252K; and
103A/104I/159D/232V/236H/245R.

Most preferably the protease variant includes the substitution set 101/103/104/1591232/236/245/248/252, preferably 101G/103A/1041/159D/232V/236H/245R/248D/252K.

Such proteolytic enzymes, when present, are incorporated in the cleaning compositions of the present invention a level of from 0.0001% to 2%, preferably from 0.001% to 0.2%, more preferably from 0.005% to 0.1% pure enzyme by weight of the composition.

Amylases (α and/or β) can be included for removal of carbohydrate-based stains. WO94/02597 describes cleaning compositions which incorporate mutant amylases. See also WO95/10603. Other amylases known for use in cleaning compositions include both α- and β-amylases. α-Amylases are known in the art and include those disclosed in U.S. Pat. No. 5,003,257; EP 252,666; WO/91/00353; FR 2,676,456; EP 285,123; EP 525,610; EP 368,341; and British Patent specification no. 1,296,839 (Novo). Other suitable amylases are stability-enhanced amylases described in WO94/18314 and WO96/05295, Genencor, and amylase variants having additional modification in the immediate parent available from Novo Nordisk A/S, disclosed in WO 95/10603. Also suitable are amylases described in EP 277 216.

Examples of commercial α-amylases products are Purafect Ox Am® from Genencor and Termamyl®, Ban®, Fungamyl® and Duramyl®, all available from Novo Nordisk A/S Denmark. WO95/26397 describes other suitable amylases: α-amylases characterized by having a specific activity at least 25% higher than the specific activity of Termamyl® at a temperature range of 25° C. to 55° C. and at a pH value in the range of 8 to 10, measured by the Phadebas® α-amylase activity assay. Suitable are variants of the above enzymes, described in WO96/23873 (Novo Nordisk). Other amylolytic enzymes with improved properties with respect to the activity level and the combination of thermostability and a higher activity level are described in WO95/35382.

Such amylolytic enzymes, when present, are incorporated in the cleaning compositions of the present invention a level of from 0.0001% to 2%, preferably from 0.00018% to 0.06%, more preferably from 0.00024% to 0.048% pure enzyme by weight of the composition.

The above-mentioned enzymes may be of any suitable origin, such as vegetable, animal, bacterial, fungal and yeast origin. Origin can further be mesophilic or extremophilic (psychrophilic, psychrotrophic, thermophilic, barophilic, alkalophilic, acidophilic, halophilic, etc.). Purified or non-purified forms of these enzymes may be used. Nowadays, it is common practice to modify wild-type enzymes via protein/genetic engineering techniques in order to optimize their performance efficiency in the laundry detergent and/or fabric care compositions of the invention. For example, the variants may be designed such that the compatibility of the enzyme to commonly encountered ingredients of such compositions is increased. Alternatively, the variant may be designed such that the optimal pH, bleach or chelant stability, catalytic activity and the like, of the enzyme variant is tailored to suit the particular cleaning application.

In particular, attention should be focused on amino acids sensitive to oxidation in the case of bleach stability and on surface charges for the surfactant compatibility. The isoelectric point of such enzymes may be modified by the substitution of some charged amino acids, e.g. an increase in isoelectric point may help to improve compatibility with anionic surfactants. The stability of the enzymes may be further enhanced by the creation of e.g. additional salt bridges and enforcing calcium binding sites to increase chelant stability.

These optional detersive enzymes, when present, are normally incorporated in the cleaning composition at levels from 0.0001% to 2% of pure enzyme by weight of the cleaning composition. The enzymes can be added as separate single ingredients (prills, granulates, stabilized liquids, etc. . . . containing one enzyme ) or as mixtures of two or more enzymes ( e.g. cogranulates).

Other suitable detergent ingredients that can be added are enzyme oxidation scavengers. Examples of such enzyme oxidation scavengers are ethoxylated tetraethylene polyamines.

A range of enzyme materials and means for their incorporation into synthetic detergent compositions is also disclosed in WO 9307263 and WO 9307260 to Genencor International, WO 8908694, and U.S. Pat. No. 3,553,139, Jan. 5, 1971 to McCarty et al. Enzymes are further disclosed in U.S. Pat. Nos. 4,101,457, and in 4,507,219. Enzyme materials useful for liquid detergent formulations, and their incorporation into such formulations, are disclosed in U.S. Pat. No. 4,261,868.

Enzyme Stabilizers—Enzymes for use in detergents can be stabilized by various techniques. Enzyme stabilization techniques are disclosed and exemplified in U.S. Pat. No. 3,600,319, EP 199,405 and EP 200,586. Enzyme stabilization systems are also described, for example, in U.S. Pat. No. 3,519,570. A useful *Bacillus,* sp. AC13 giving proteases, xylanases and cellulases, is described in WO 9401532. The enzymes employed herein can be stabilized by the presence of water-soluble sources of calcium and/or magnesium ions in the finished compositions which provide such ions to the enzymes. Suitable enzyme stabilizers and levels of use are described in U.S. Pat. Nos. 5,705,464, 5,710,115 and 5,576,282.

Builders—The detergent and bleaching compositions described herein preferably comprise one or more detergent builders or builder systems. When present, the compositions will typically comprise at least about 1% builder, preferably from about 5%, more preferably from about 10% to about 80%, preferably to about 50%, more preferably to about 30% by weight, of detergent builder. Lower or higher levels of builder, however, are not meant to be excluded.

Preferred builders for use in the detergent and bleaching compositions, particularly dishwashing compositions, described herein include, but are not limited to, water-soluble builder compounds, (for example polycarboxylates) as described in U.S. Pat. Nos. 5,695,679, 5,705,464 and 5,710,115. Other suitable polycarboxylates are disclosed in U.S. Pat. Nos. 4,144,226, 3,308,067 and 3,723,322. Preferred polycarboxylates are hydroxycarboxylates containing up to three carboxy groups per molecule, more particularly titrates.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates (see, for example, U.S. Pat. Nos. 3,159,581; 3,213,030; 3,422,021; 3,400,148 and 3,422,137), phytic acid, silicates, carbonates (including bicarbonates and sesquicarbonates), sulphates, and aluminosilicates.

However, non-phosphate builders are required in some locales. Importantly, the compositions herein function surprisingly well even in the presence of the so-called "weak" builders (as compared with phosphates) such as citrate, or in the so-called "underbuilt" situation hat may occur with zeolite or layered silicate builders.

Suitable silicates include the water-soluble sodium silicates with an $SiO_2$:$Na_2O$ ratio of from about 1.0 to 2.8, with ratios of from about 1.6 to 2.4 being preferred, and about 2.0 ratio being most preferred. The silicates may be in the form of either the anhydrous salt or a hydrated salt. Sodium silicate with an $SiO_2$:$Na_2O$ ratio of 2.0 is the most preferred. Silicates, when present, are preferably present in the detergent and bleaching compositions described herein at a level of from about 5% to about 50% by weight of the composition, more preferably from about 10% to about 40% by weight.

Partially soluble or insoluble builder compounds, which are suitable for use in the detergent and bleaching compositions, particularly granular detergent compositions, include, but are not limited to, crystalline layered silicates, preferably crystalline layered sodium silicates (partially water-soluble) as described in U.S. Pat. No. 4,664,839, and sodium aluminosilicates (water-insoluble). When present in detergent and bleaching compositions, these builders are typically present at a level of from about 1% to 80% by weight, preferably from about 10% to 70% by weight, most preferably from about 20% to 60% by weight of the composition.

Crystalline layered sodium silicates having the general formula $NaMSi_xO_{2x+1}.yH_2O$ wherein M is sodium or hydrogen, x is a number from about 1.9 to about 4, preferably from about 2 to about 4, most preferably 2, and y is a number from about 0 to about 20, preferably 0 can be used in the compositions described herein. Crystalline layered sodium silicates of this type. are disclosed in EP-A-0164514 and methods for their preparation are disclosed in DE-A-3417649 and DE-A-3742043. The most preferred material is delta-$Na_2SiO_5$, available from Hoechst AG as NaSKS-6 (commonly abbreviated herein as "SICS-6"). Unlike zeolite builders, the Na SKS-6 silicate builder does not contain aluminum. NaSKS-6 has the delta-$Na_2SiO_5$ morphology form of layered silicate. SKS-6 is a highly preferred layered silicate for use in the compositions described herein herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used in the compositions described herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

The crystalline layered sodium silicate material is preferably present in granular detergent compositions as a particulate in intimate admixture with a solid, water-soluble ionizable material. The solid, water-soluble ionizable material is preferably selected from organic acids, organic and inorganic acid salts and mixtures thereof.

Aluminosilicate builders are of great importance in most currently marketed heavy duty granular detergent compositions, and can also be a significant builder ingredient in liquid detergent formulations. Aluminosilicate builders have the empirical formula:

$$[M_z(AlO_2)_y].xH_2O$$

wherein z and y are integers of at least 6, the molar ratio of z to y is in the range from 1.0 to about 0.5, and x is an integer from about 15 to about 264. Preferably, the aluminosilicate builder is an aluminosilicate zeolite having the unit cell formula:

$$Na_z[(AlO_2)(SiO_2)_y].xH_2O$$

wherein z and y are at least 6; the molar ratio of z to y is from 1.0 to 0.5 and x is at least 5, preferably 7.5 to 276, more preferably from 10 to 264. The aluminosilicate builders are preferably in hydrated form and are preferably crystalline, containing from about 10% to about 28%, more preferably from about 18% to about 22% water in bound form.

These aluminosilicate ion exchange materials can be crystalline or amorphous in structure and can be naturally-occurring aluminosilicates or synthetically derived. A method for producing aluminosilicate ion exchange materials is disclosed in U.S. Pat. No. 3,985,669. Preferred synthetic crystalline aluminosilicate ion exchange materials useful herein are available under the designations Zeolite A, Zeolite B, Zeolite P, Zeolite X, Zeolite MAP and Zeolite HS and mixtures thereof. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter. Zeolite X has the formula:

$$Na_{86}[(AlO_2)_{86}(SiO_2)_{106}].276H_2O$$

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions described herein are the 3,3-dicarboxy-4oxa-1,6hexanedioates and the related compounds disclosed in U.S. Pat. No. 4,566,984. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

Dispersants—One or more suitable polyalkyleneimine dispersants may be incorporated into the cleaning compositions of the present invention. Examples of such suitable dispersants can be found in European Patent Application Nos. 111,965, 111,984, and 112,592; U.S. Pat. Nos. 4,597,898, 4,548,744, and 5,565,145. However, any suitable clay/soil dispersing or anti-redeposition agent can be used in the laundry compositions of the present invention.

In addition, polymeric dispersing agents which include polymeric polycarboxylates and polyethylene glycols, are suitable for use in the present invention. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type arc known materials. Use of polyacrylates of this type in detergent compositions has been disclosed, for example, in U.S. Pat. No. 3,308,067.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982, as well as in EP 193,360, published Sep. 3, 1986, which also describes such polymers comprising hydroxypropylacrylate. Still other useful dispersing agents include the maleic/acrylic/vinyl alcohol terpolymers. Such materials are also disclosed in EP 193,360, including, for example. the 45/45/10 terpolymer of acrylic/maleic/vinyl alcohol.

Another polymeric material which can be included is polyethylene glycol (PEG). PEG can exhibit dispersing agent performance as well as act as a clay soil removal-antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used, especially in conjunction with zeolite builders. Dispersing agents such as polyaspartate preferably have a molecular weight (avg.) of about 10,000.

Soil Release Agents—The compositions according to the present invention may optionally comprise one or more soil release agents. If utilized, soil release agents will generally comprise from about 0.01%, preferably from about 0.1%, more preferably from about 0.2% to about 10%, preferably to about 5%, more preferably to about 3% by weight, of the composition. Nonlimiting examples of suitable soil release polymers are disclosed in: U.S. Pat. Nos. 5,728,671; 5,691,298; 5,599,782; 5,415,807; 5,182,043; 4,956,447; 4,976,879; 4,968,451; 4,925,577; 4,861,512; 4,877,896; 4,771,730; 4,711,730; 4,721,580; 4,000,093; 3,959,230; and 3,893,929; and European Patent Application 0 219 048.

Further suitable soil release agents are described in U.S. Pat. Nos. 4,201,824; 4,240,918; 4,525,524; 4,579,681; 4,220,918; and 4,787,989; EP 279,134 A; EP 457,205 A; and DE 2,335,044.

Chelating Agents—The compositions of the present invention herein may also optionally contain a chelating agent which serves to chelate metal ions and metal impurities which would otherwise tend to deactivate the bleaching agent(s). Useful chelating agents can include amino carboxylates, phosphonates, amino phosphonates, polyfunctionally-substituted aromatic chelating agents and mixtures thereof. Further examples of suitable chelating agents and levels of use are described in U.S. Pat. Nos. 5,705,464, 5,710,115, 5,728,671 and 5,576,282.

The compositions herein may also contain water-soluble methyl glycine diacetic acid (MGDA) salts (or acid form) as a chelant or co-builder useful with, for example, insoluble builders such as zeolites, layered silicates and the like.

If utilized, these chelating agents will generally comprise from about 0.1% to about 15%, more preferably from about 0.1% to about 3.0% by weight of the detergent compositions herein.

Suds suppresser—Another optional ingredient is a suds suppresser, exemplified by silicones, and silica-silicone mixtures. Examples of suitable suds suppressors are disclosed in U.S. Pat. Nos. 5,707,950 and 5,728,671. These suds suppressors are normally employed at levels of from 0.001% to 2% by weight of the composition, preferably from 0.01% to 1% by weight.

Softening agents—Fabric softening agents can also be incorporated into laundry detergent compositions in accordance with the present invention. Inorganic softening agents are exemplified by the smectite clays disclosed in GB-A-1 400 898 and in U.S. Pat. No. 5,019,292. Organic softening agents include the water insoluble tertiary amines as disclosed in GB-A-1 514 276 and EP-B-011 340 and their combination with mono C12–C14 quaternary ammonium salts are disclosed in EP-B-026 527 and EP-B-026 528 and di-long-chain amides as disclosed in EP-B-0 242 919. Other useful organic ingredients of fabric softening systems include high molecular weight polyethylene oxide materials as disclosed in EP-A-0 299 575 and 0 313 146.

Particularly suitable fabric softening agents are disclosed in U.S. Pat. Nos. 5,707,950 and 5,728,673.

Levels of smectite clay are normally in the range from 2% to 20%, more preferably from 5% to 15% by weight, with the material being added as a dry mixed component to the remainder of the formulation. Organic fabric softening agents such as the water-insoluble tertiary amines or dilong chain amide materials are incorporated at levels of from 0.5% to 5% by weight, normally from 1% to 3% by weight whilst the high molecular weight polyethylene oxide materials and the water soluble cationic materials are added at levels of from 0.1% to 2%, normally from 0.15% to 1.5% by weight. These materials are normally added to the spray dried portion of the composition, although in some instances it may be more convenient to add them as a dry mixed particulate, or spray them as molten liquid on to other solid components of the composition.

Biodegradable quaternary ammonium compounds as described in EP-A-040 562 and EP-A-239 910 have been presented as alternatives to the traditionally used di-long alkyl chain ammonium chlorides and methyl sulfates.

Non-limiting examples of softener-compatible anions for the quaternary ammonium compounds and amine precursors include chloride or methyl sulfate.

Dye transfer inhibition—The detergent compositions of the present invention can also include compounds for inhibiting dye transfer from one fabric to another of solubilized and suspended dyes encountered during fabric laundering and conditioning operations involving colored fabrics.

Polymeric Dye Transfer Inhibiting Agents

The detergent compositions according to the present invention can also comprise from 0.001% to 10%, preferably from 0.01% to 2%, more preferably from 0.05% to 1% by weight of polymeric dye transfer inhibiting agents. Said polymeric dye transfer inhibiting agents are normally incorporated into detergent compositions in order to inhibit the transfer of dyes from colored fabrics onto fabrics washed therewith. These polymers have the ability to complex or adsorb the fugitive dyes washed out of dyed fabrics before the dyes have the opportunity to become attached to other articles in the wash.

Especially suitable polymeric dye transfer inhibiting agents are polyamine N-oxide polymers, copolymers of N-vinylpyrrolidone and N-vinylimidazole, polyvinylpyrrolidone polymers, polyvinyloxazolidones and polyvinylimidazoles or mixtures thereof. Examples of such dye transfer inhibiting agents are disclosed in U.S. Pat. Nos. 5,707,950 and 5,707,951.

Additional suitable dye transfer inhibiting agents include, but are not limited to, cross-linked polymers. Cross-linked polymers are polymers whose backbone are interconnected to a certain degree; these links can be of chemical or physical nature, possibly with active groups n the backbone or on branches; cross-linked polymers have been described in the Journal of Polymer Science, volume 22, pages 1035–1039.

In one embodiment, the cross-linked polymers are made in such a way that they form a three-dimensional rigid structure, which can entrap dyes in the pores formed by the three-dimensional structure. In another embodiment, the cross-linked polymers entrap the dyes by swelling. Such cross-linked polymers are described in the co-pending European patent application 94870213.9.

Addition of such polymers also enhances the performance of the enzymes according the invention.

pH and Buffering Variation—Many of the detergent and bleaching compositions described herein will be buffered, i.e., they are relatively resistant to pH drop in the presence of acidic soils. However, other compositions herein may have exceptionally low buffering capacity, or may be substantially unbuffered. Techniques for controlling or varying pH at recommended usage levels more generally include the use of not only buffers, but also additional alkalis, acids, pH-jump systems, dual compartment containers, etc., and are well known to those skilled in the art The preferred ADD compositions herein comprise a pH-adjusting component selected from water-soluble alkaline inorganic salts and water-soluble organic or inorganic builders as described in U.S. Pat. Nos. 5,705,464 and 5,710,115.

Material Care Agents—The preferred ADD compositions may contain one or more material care agents which are effective as corrosion inhibitors and/or anti-tarnish aids as described in U.S. Pat. Nos. 5,705,464, 5,710,115 and 5,646,101.

When present, such protecting materials are preferably incorporated at low levels, e.g., from about 0.01% to about 5% of the ADD composition.

Other Materials—Detersive ingredients or adjuncts optionally included in the instant compositions can include one or more materials for assisting or enhancing cleaning performance, treatment of the substrate to be cleaned, or designed to improve the aesthetics of the compositions. Adjuncts which can also be included in compositions of the present invention, at their conventional art-established levels for use (generally, adjunct materials comprise, in total, from about 30% to about 99.9%, preferably from about 70% to about 95%, by weight of the compositions), include other active ingredients such as non-phosphate builders, color speckles, silvercare, anti-tarnish and/or anti-corrosion agents, dyes, fillers, germicides, alkalinity sources, hydrotropes, anti-oxidants, perfumes, solubilizing agents, carriers, processing aids, pigments, and pH control agents as described in U.S. Pat. Nos. 5,705,464, 5,710,115, 5,698,504, 5,695,679, 5,686,014 and 5,646,101.

Methods of Cleaning—In addition to the methods for cleaning fabrics, dishes and other hard surfaces, and body parts by personal cleansing, described herein, the invention herein also encompasses a laundering pretreatment process for fabrics which have been soiled or stained comprising directly contacting said stains and/or soils with a highly concentrated form of the bleaching composition set forth above prior to washing such fabrics using conventional aqueous washing solutions. Preferably, the bleaching composition remains in contact with the soil/stain for a period of from about 30 seconds to 24 hours prior to washing the pretreated soiled/stained substrate in conventional manner. More preferably, pretreatment times will range from about 1 to 180 minutes.

Organic Catalyst Product

The organic catalyst compound and/or bleaching compositions of the present invention may be employed in various products for use in the laundering process.

In a preferred embodiment, a product comprising the organic catalyst compound and/or bleaching compositions of the present invention is provided. The product further includes instructions for using the organic catalyst compound and/or bleaching composition to clean a fabric in need of cleaning, preferably a stained fabric,. The instructions include the steps, preferably sequential steps, of:

(i) contacting the fabric with a wash solution, preferably containing a peracid; and (ii) delivering the organic catalyst compound and/or bleaching composition by a delivery means to the wash solution.

The delivering step of step (ii) can be accomplished by various delivery means as discussed herein.

The result of following these instructions is that the organic catalyst compound and/or bleaching compositions are added to the wash solution after the fabric has been added to the wash solution.

Benefits may still be achieved by adding the longer lasting organic catalyst compound and/or bleaching compositions to the wash solution after the fabric has been added to the wash solution, however, the increased stability of the longer lasting organic catalysts make the order of addition less important.

Determination of Longer Lasting Organic Catalyst—To facilitate the determination of which organic catalysts fall within the scope of the present invention, a test protocol, Test Protocol I, is provided below.

Test Protocol I:

General/Parameters: All solutions are maintained at 20° C. Adjustments of pH as required are accomplished using either sodium carbonate or sulfuric acid as appropriate. All solutions are continuously stirred at 500 rpm, except small (1–5 mL) dye bleaching solution (DBS) aliquots removed to measure absorbance. Absorbance values are measures at the $\lambda_{max}$ of the reference dye solution (RDS). Peracetic acid, 32 wt. % solution in dilute acetic acid is purchased from Aldrich (#26,933-6).

OC is the Organic Catalyst.

OCS is the organic catalyst containing solution prepared by dissolving 0.010 mmoles (typically about 2–3 mg, depending on the molecular weight) of an organic catalyst (OC) at 20° C. in 5 mL of deionized water immediately prior (within one minute) of the time at which the OCS is added to the base solution. If the organic catalyst is not soluble in 5 mL of deionized water, an additional 5 mL of an organic solvent is added to 5 mL of deionized water to aid in the dissolution of the organic catalyst. Organic solvents used are methanol, ethanol, dimethylformamide, or acetonitrile. If the organic catalyst is not soluble in a 1:1 mixture of deionized water and organic solvent, the organic catalyst is dissolved in 100% organic solvent. If the organic catalyst is found to be insoluble in the above solvent media, the organic catalyst is added to the base solution in pure form.

BS is the base solution to which the OCS is added. The base solution is prepared by mixing 1.0 L of deionized water with 10 mg (10 ppm) of a chelant (capable of sequestering transition metal ions in order to avoid decomposition of peracetic acid and/or bleaching species) and a sufficient quantity of sodium carbonate such that upon the addition of 76 mg (76 ppm, 1.0 mmol) of peracetic acid (based on 100% activity), the solution pH is 10.0 (between 9.9 and 10.1). At one minute of stirring, the BS preparation is complete.

OCBS is the organic catalyst containing base solution prepared by the addition of the OCS to 1 L of the just prepared BS. Upon addition of OCS to BS, the OCBS preparation is complete. The OCBS should now have a pH of 10.0 (between 9.9 and 10.1). If the pH is not within this range, the OCBS preparation will need to be repeated, such that the addition of the OCS to the BS is performed along with the addition of sodium carbonate or sulfuric acid in a manner that results in the preparation of an OCBS with a pH of 10.0 (between 9.9 and 10.1).

CDS is the concentrated dye solution, defined as a 90 ppm solution of Tropaeolin O dye (Aldrich 19,968-0) in deionized water.

DBS is the dye bleaching solution formed from the addition of a 100 mL aliquot of the OCBS to 10 mL of CDS. The DBS should have an initial pH of 10.0. If (in the unlikely event) the pH of the DBS drops below 9.6 at time=$t_D$ (defined below), the pH must be controlled such that during the interval $t_D$ the pH must remain between 9.8 and 10.1.

$w_{OC}$ is a parameter in the final test protocol used to describe the weight of organic catalyst (OC), based on 100% purity, used to form the organic catalyst solution (OCS). The default value of the parameter is 0.0 0 mmoles, added to 1.0 L of BS.

Determination of $A_{max}$. 100 mL of deionized water at pH 10 is added to 10 mL of CDS. The absorbance of the resulting homogeneous reference dye solution (RDS) determined by UV-Visible Spectroscopy at the $\lambda_{max}$ (approximately 518 nm) is $A_{max}$.*

$d_{dec}$ is a parameter in the test protocol describing the time that elapses between the formation of the OCBS and the formation of the dye bleaching solution (DBS) via the addition of the OCBS to the CDS. This value is the decomposition duration of the organic catalyst in the OCBS prior to addition to the CDS. The default value of the parameter $d_{dec}$ (e.g., $d_{dec}$=45 min) is defined in the claim set. The value of the parameter $d_{dec}$ is defined to be equal to the value of the parameter $d_{ref}$.

$d_{ref}$ is a parameter in the test protocol describing the time that elapses between the completion of the BS preparation and the formation of the dye bleaching solution (DBS) via the addition of the BS to the CDS. This value is the reference duration. of peracid in the BS prior to addition to the CDS. The default value of the parameter $d_{ref}$ (e.g., $d_{ref}$=45 min) is defined in the claim set. The value of the parameter $d_{ref}$ is defined to be equal to the value of the parameter $d_{dec}$.

$d_{bleach}$ is a parameter in the test protocol describing the time that elapses between the formation of the dye bleaching solution (DBS) and data acquisition. This value is the bleaching duration of the DBS formed from either the addition of BS or OCBS to the CDS. The default value of the parameter $d_{bleach}$ is 5 min.

Test Protocol (Part I):

The initial step is the preparation of the BS as described. The time of completion of the BS preparation is set to t=0. A 100 mL aliquot of the BS is withdrawn at $d_{ref}$ and added all at once to 10.0 mL of CDS. A 1–5 mL aliquot, R, of the resulting DBS is withdrawn immediately prior to the absorbance determination (data acquisition). Absorbance of R is measured at the $\lambda_{max}$ at the conclusion of $d_{bleach}$.

The time at which the absorbance determination (data acquisition) of aliquot R is measured is defined as $t_R$. Therefore, it is required that $t_R=d_{ref}+d_{bleach}$. The absorbance value measured at $t_R$ is defined as $A_{t(R)}$. The symbol $\delta A_{t(R)}$ is defined as $A_{max}-A_{t(R)}$.

Test Protocol (Part II):

The initial step is the preparation of the OCBS as described. The time of completion of the OCBS preparation is set to t=0. A 100 mL aliquot of the OCBS is withdrawn at $d_{dec}$ and added all at once to 10.0 mL of CDS. A 1–5 mL aliquot, D, of the resulting DBS is withdrawn immediately prior to the absorbance determination (data acquisition). Absorbance of D is measured at the $\lambda_{max}$ at the conclusion of $d_{bleach}$.

The time at which the absorbance determination (data acquisition) of aliquot D is measured is defined as $t_D$. Therefore, it is required that $t_D=d_{dec}+d_{bleach}$. The absorbance value measured at $t_D$ is defined as $A_{t(D)}$. The symbol $\delta A_{t(D)}$ is defined as $A_{max}-A_{t(D)}$.

Organic catalyst lifetime (OCL) is defined as the value of $d_{dec}$ (or the time the OC spends in the OCBS) such that the value of $\delta A_{t(D)}=3\times\delta A_{t(R)}$.

Two cases exist, depending upon the values of $\delta A_{t(D)}$ compared to the value of $\delta A_{t(R)}$.

Case A: If the value of $\delta A_{t(D)} \geqq m_f \times \delta A_{t(R)}$, where $m_f$ is 3, then a long-lasting organic catalyst is indicated, and the OC falls within the boundaries of this invention.

Case B: If the value of $\delta A_{t(D)} < m_f \times \delta A_{t(R)}$, where $m_f$ (the final multiplier) is 3, then a long-last organic catalyst is not indicated, and the OC does not fall within the boundaries of this invention.

Finally, if the value of the determined final multiplier ($m_f$), relating the value of $\delta A_{t(D)}$ with the value of $\delta A_{t(R)}$, remains constant over a 30 min period, and if the determined value of $m_f$ at $d_{dec}$=2 min is found to be greater than 1.5 times the value of $m_f$ that has remained constant over the 30 min interval, then the OCL is defined as the $d_{dec}$ at which the value of $m_f$ first becomes constant.

The following examples are meant to exemplify compositions of the present invention, but are not necessarily meant to limit or otherwise define the scope of the invention. Some of the organic catalyst compounds synthesized in the following examples (e.g., structure 6 possess stereogenic centers, such that more than one isomeric organic catalyst compound can be synthesized depending on the choice of isomeric starting materials. As such, it is understood by one skilled in the art, that organic catalyst compounds with different isomeric configuration can possess different properties, including organic catalyst lifetime.

SYNTHESIS EXAMPLES

Example I

Preparation of N-(1-cyclohexylethyl)-3,4-dihydroisoquinolinium tetraphenylborate (1)

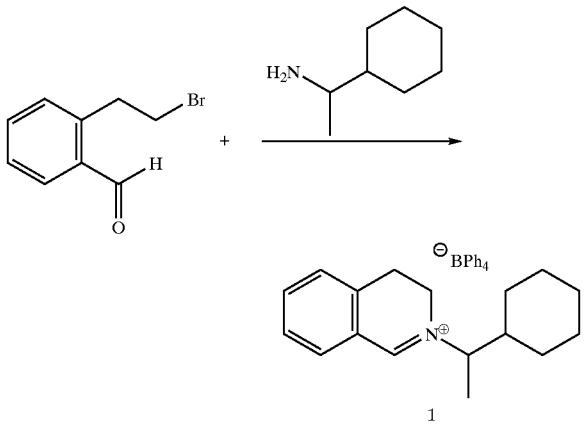

1

Typical procedure for the synthesis of dihydroisoquinolinium salts is as described in the art, as in Page, P. C B. et al. *J. Org. Chem.* 1998, 63, 2774. The parent amine used in this reaction was 1-cyclohexylethylamine.

Example II

Preparation of N-tert-butyl-3,4-dihydroisoquinolinium tetraphenylborate (2)

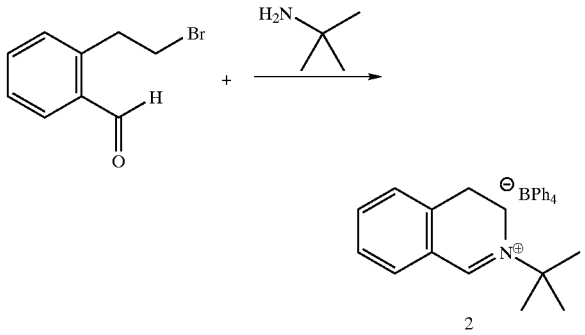

2

Typical procedure for the synthesis of dihydroisoquinolinium salts is as described in the art, as in Page, P. C B. et. al. *J. Org. Chem.* 1998, 63, 2774. The parent amine used in this reaction was cyclohexanemethylamine.

Example III

Preparation of 3-(3,4-dihydroisoquinolinium)-butane-2-sulfate (6)

Step 1: Preparation of 3,4-dihydroisoquinoline (2) is as described in U.S. Pat. No. 5,576,282.

Step 2: Preparation of 2,3-butanediol cyclic sulfate (5):

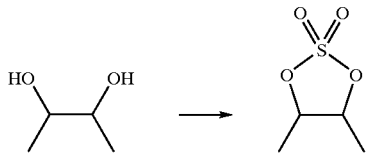

4 5

A three-neck, 500 mL round bottom flask equipped with mechanical stirrer, pressure equalizing addition funnel, and reflux condenser with Drierite® filled drying tube is charged with 2,3-butanediol (4, 4.51 g, 50.0 mmol) and 50 mL of carbon tetrachloride. When the 2,3-butanediol is dissolved, thionyl chloride (5.5 mL, 75 mmol) is added dropwise at room temperature and the reaction is heated to approximately 60° C. After two hours, the reaction is slowly cooled to about 0° C. Deionized water (50 mL) and acetonitrile (75 mL) are added. Ruthenium chloride hydrate (0.13 g, 0.50 mmol) and sodium periodate (21.4 g, 100 mmol) are added and the reaction mixture is stirred at room temperature for 1 h. The mixture is extracted with diethyl ether (4×175 mL), the organics are washed with deionized water (5×100 mL), saturated sodium bicarbonate solution (3×100 mL), and brine (2×100 mL), then filtered through celite/silica gel. The filtrate is dried over magnesium sulfate, filtered and concentrated via rotary evaporation to a clear oil.

Step 3: Preparation of 3,4-dihydroisoquinolinium)-butane-2-sulfate (6)

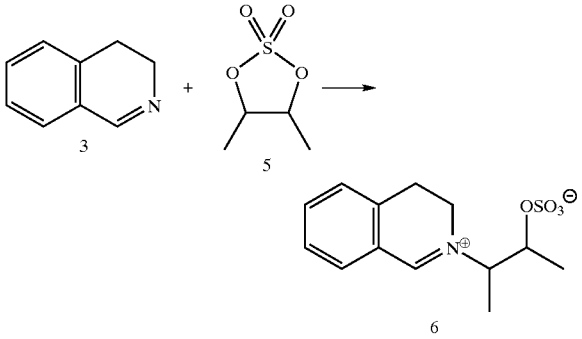

A 100 mL round bottom flask equipped with magnetic stir bar is charged with 3,4-dihydroisoquinoline (2.02 g, 15.4 mmol) and acetonitrile (15.2 mL). To this is added all at once 2,3-butanediol cyclic sulfate (2.43 g, 16.0 mmol). As the reaction mixture thickens, additional acetonitrile (60 mL) is added and the reaction is stirred overnight. The precipitate is collected, washed five times with acetone, and allowed to air dry.

Example IV

Preparation of 3-(3,4-dihydroisoquinolinium)-propane-1-sulfate (8)

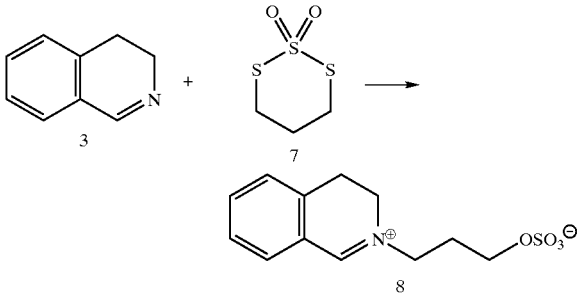

A 100 mL round bottom flask equipped with magnetic stir bar is charged with 3,4-dihydroisoquinoline (2.02 g, 15.4 mmol) and acetonitrile (1 5.2 mL). To this is added all at once 1,3-propanediol cyclic sulfate (2.21 g, 16.0 mmol). As the reaction mixture thickens, additional acetonitrile (60 mL) is added and the reaction is stirred overnight. The precipitate is collected, washed five times with acetone, and allowed to air dry.

The following examples are meant to exemplify compositions of the present invention, but are not necessarily meant to limit or otherwise define the scope of the invention.

In the following examples some abbreviations known to those of ordinary skill in the art are used, consistent with the disclosure set forth herein.

The organic catalyst in the following examples can be any of the organic catalysts described hereinbefore including Examples I–IV, preferably the organic catalysts are represented by the following structures (with substituent groups defined above).

[XI]

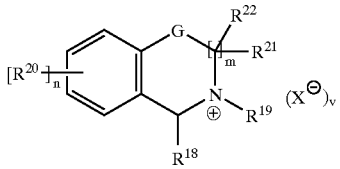

[XII]

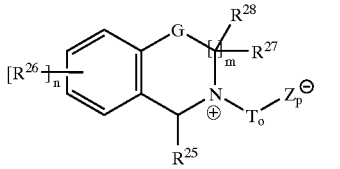

[XIII]

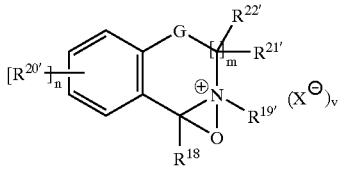

[XIV]

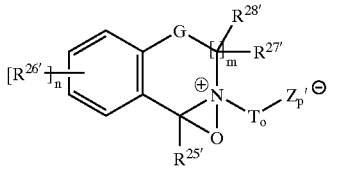

[XV]

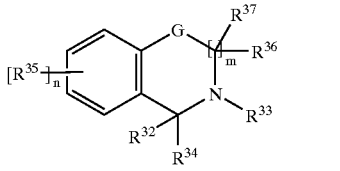

[XVI]

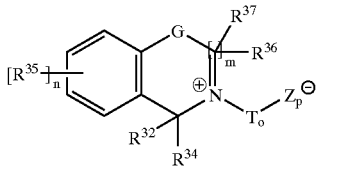

[XVII]

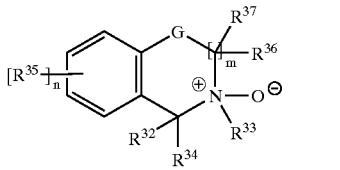

-continued

[XVIII]

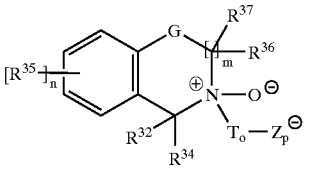

[XIX]

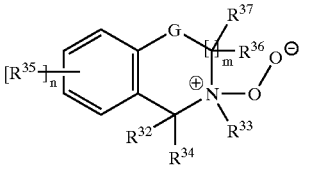

[XX]

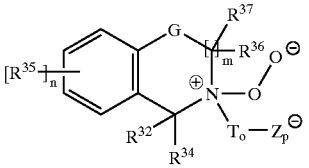

[XXVIIIa]

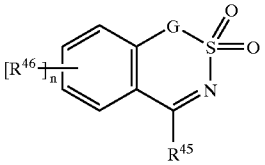

[XXVIIIb]

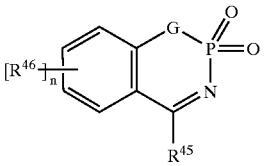

[XXIX]

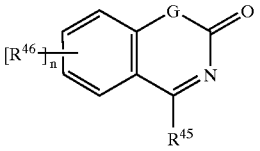

[XXXIa]

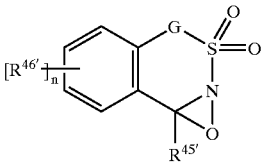

[XXXIb]

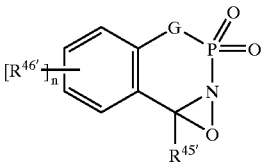

[XXXII]

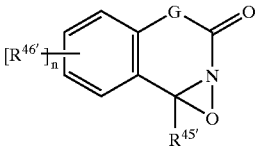

Preferably the organic catalysts are iminium-based organic catalysts, as represented by the following structures (with substituent groups defined above).

[XI]

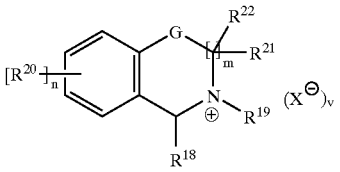

[XII]

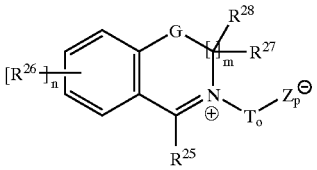

[XIII]

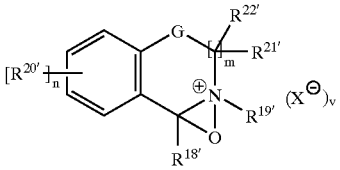

[XIV]

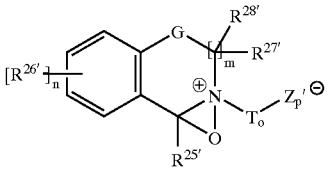

Example V

Granular Automatic Dishwashing Composition

| Component | A | B | C |
|---|---|---|---|
| Citric Acid | 15.0 | — | — |
| Citrate | 4.0 | 29.0 | 15.0 |
| Acrylate/methacrylate copolymer | 6.0 | — | 6.0 |
| Acrylic acid maleic acid copolymer | — | 3.7 | — |
| Dry add carbonate | 9.0 | — | 20.0 |
| Alkali metal silicate | 8.5 | 17.0 | 9.0 |
| Paraffin | — | 0.5 | — |
| Benzotriazole | — | 0.3 | — |
| Amylase | 1.6 | 1.6 | 1.6 |
| Protease | 0.2 | 0.1 | 0.06 |
| Percarbonate (AvO) | 1.5 | — | — |
| Perborate monohydrate | — | 0.3 | 1.5 |
| Perborate tetrahydrate | — | 0.9 | — |
| NOBS | — | — | 2.40 |
| TAED | 3.8 | 4.4 | — |
| Organic Catalyst | 0.2 | 1 | 0.005 |
| Diethylene triamine penta methyl phosphonic acid (Mg salt) | 0.13 | 0.13 | 0.13 |
| Alkyl ethoxy sulphate - 3 times ethoxylated | 3.0 | — | — |
| Alkyl ethoxy propoxy nonionic surfactant | — | 1.5 | — |
| Suds suppressor | 2.0 | — | — |
| Olin SLF 18 nonionic surfactant | — | — | 2.0 |
| Sulfate (Balance 100%) | | | |

Example VI

Compact high density (0.96 Kg/l) dishwashing detergent compositions A to F in accordance with the invention:

| Component | A | B | C | D | E | F |
|---|---|---|---|---|---|---|
| STPP | — | 51.4 | 51.4 | — | — | 44.3 |
| Citrate | 17.05 | — | — | 49.6 | 40.2 | — |
| Carbonate | 17.50 | 14.0 | 20.0 | | 8.0 | 33.6 |
| Bicarbonate | — | — | — | 26.0 | — | — |
| Silicate | 14.81 | 15.0 | 8.0 | — | 25.0 | 3.6 |
| Metasilicate | 2.50 | 4.5 | 4.5 | — | — | — |
| PB1 | 9.74 | 7.79 | 7.79 | — | — | — |
| PB4 | — | — | — | 9.6 | — | — |
| Percarbonate | — | — | — | — | 11.8 | 4.8 |
| Nonionic | 2.00 | 1.50 | 1.50 | 2.6 | 1.9 | 5.9 |
| TAED | 2.39 | — | — | 3.8 | — | 1.4 |
| HEDP | 1.00 | — | — | — | — | — |
| DETPMP | 0.65 | — | — | — | — | — |
| Mn TACN | — | — | — | — | 0.008 | — |
| NOBS | — | 2.40 | — | — | — | — |
| PAAC | — | — | 0.008 | — | — | — |
| Organic Catalyst | 0.0001 | 0.01 | 0.6 | 3 | 1 | 2 |
| Paraffin | 0.50 | 0.38 | 0.38 | 0.6 | — | — |
| Protease | 0.1 | 0.06 | 0.05 | 0.03 | 0.07 | 0.01 |
| Amylase | 1.5 | 1.5 | 1.5 | 2.6 | 2.1 | 0.8 |
| BTA | 0.30 | 0.22 | 0.22 | 0.3 | 0.3 | 0.3 |
| Polycarboxylate | 6.0 | — | — | — | 4.2 | 0.9 |
| Perfume | 0.2 | 0.12 | 0.12 | 0.2 | 0.2 | 0.2 |
| Sulfate/Water | 20.57 | 1.97 | 2.97 | 3.6 | 4.5 | 3.9 |
| pH (1% solution) | 11.0 | 11.0 | 11.3 | 9.6 | 10.8 | 10.9 |

Example VII

Granular dishwashing detergent compositions examples A to F of bulk density 1.02 Kg/L in accordance with the invention:

| Component | A | B | C | D | E | F |
|---|---|---|---|---|---|---|
| STPP | 30.00 | 33.5 | 27.9 | 29.62 | 33.8 | 22.0 |
| Carbonate | 30.50 | 30.50 | 30.5 | 23.00 | 34.5 | 45.0 |
| Silicate | 7.40 | 7.50 | 12.6 | 13.3 | 3.2 | 6.2 |
| Metasilicate | — | 4.5 | | | | |
| Percarbonate | — | — | | — | 4.0 | |
| PB1 | 4.4 | 4.5 | 4.3 | — | — | |
| NaDCC | — | — | | 2.00 | — | 0.9 |
| Nonionic | 1.0 | 0.75 | 1.0 | 1.90 | 0.7 | 0.5 |
| TAED | 1.00 | — | | — | — | |
| NOBS | — | — | — | — | 2.0 | — |
| PAAC | — | 0.004 | | — | — | |
| Organic Catalyst | 0.05 | 0.00001 | 10 | 7 | 5 | 0.8 |
| Paraffin | 0.25 | 0.25 | | — | — | |
| Protease | 0.05 | 0.06 | 0.025 | 0.1 | 0.02 | 0.07 |
| Amylase | 0.38 | 0.64 | 0.46 | — | 0.6 | |
| BTA | 0.15 | 0.15 | | — | 0.2 | |
| Perfume | 0.2 | 0.2 | 0.05 | 0.1 | 0.2 | |
| Sulfate/water | 23.45 | 16.87 | 22.26 | 30.08 | 21.7 | 25.4 |
| pH (1% solution) | 10.80 | 11.3 | 11.0 | 10.70 | 11.5 | 10.9 |

Example VIII

Tablet detergent composition examples A to H in accordance with the present invention are prepared by compression of a granular dishwashing detergent composition at a pressure of 13 $KN/cm^2$ using a standard 12 head rotary press:

| Component | A | B | C | D | E | F | G | H |
|---|---|---|---|---|---|---|---|---|
| STPP | — | 48.8 | 54.7 | 38.2 | — | 52.4 | 56.1 | 36.0 |
| Citrate | 20.0 | — | — | — | 35.9 | — | — | — |
| Carbonate | 20.0 | 5.0 | 14.0 | 15.4 | 8.0 | 23.0 | 20.0 | 28.0 |
| Silicate | 15.0 | 14.8 | 15.0 | 12.6 | 23.4 | 2.9 | 4.3 | 4.2 |
| Protease | 0.05 | 0.09 | 0.05 | 0.03 | 0.06 | 0.03 | 0.03 | 0.1 |
| Amylase | 1.5 | 1.5 | 1.5 | 0.85 | 1.9 | 0.4 | 2.1 | 0.3 |
| PB1 | 14.3 | 7.8 | 11.7 | 12.2 | — | — | 6.7 | 8.5 |
| PB4 | — | — | — | — | 22.8 | — | 3.4 | — |
| Percarbonate | — | — | — | — | — | 10.4 | — | — |
| Nonionic | 1.5 | 2.0 | 2.0 | 2.2 | 1.0 | 4.2 | 4.0 | 6.5 |
| PAAC | — | — | 0.016 | 0.009 | — | — | — | — |
| MnTACN | — | — | — | — | 0.007 | — | — | — |
| TAED | 2.7 | 2.4 | — | — | — | 2.1 | 0.7 | 1.6 |
| Organic Catalyst | 1 | 1.4 | 5 | 0.7 | 0.02 | 1 | 2 | 0.4 |
| HEDP | 1.0 | — | — | 0.93 | — | 0.4 | 0.2 | — |
| DETPMP | 0.7 | — | — | — | — | — | — | — |
| Paraffin | 0.4 | 0.5 | 0.5 | 0.55 | — | — | 0.5 | — |
| BTA | 0.2 | 0.3 | 0.3 | 0.33 | 0.3 | 0.3 | 0.3 | — |
| Polycarboxylate | 4.0 | — | — | — | 4.9 | 0.6 | 0.8 | — |
| PEG | — | — | — | — | — | 2.0 | — | 2.0 |
| Glycerol | — | — | — | — | — | 0.4 | — | 0.5 |
| Perfume | — | — | — | 0.05 | 0.20 | 0.2 | 0.2 | 0.2 |
| Sulfate/water | 17.4 | 14.7 | — | 15.74 | — | — | — | 11.3 |
| weight of tablet | 20 g | 25 g | 20 g | 30 g | 18 g | 20 g | 25 g | 24.0 |
| pH (1% solution) | 10.7 | 10.60 | 10.7 | 10.7 | 10.9 | 11.2 | 11.0 | 10.8 |

Example IX

Granular Fabric Cleaning Compositions

| | A | B |
|---|---|---|
| Linear alkyl benzene sulphonate | 11.4 | 10.70 |
| Tallow alkyl sulphate | 1.80 | 2.40 |
| $C_{14-15}$ alkyl sulphate | 3.00 | 3.10 |
| $C_{14-15}$ alcohol 7 times ethoxylated | 4.00 | 4.00 |
| Tallow alcohol 11 times ethoxylated | 1.80 | 1.80 |
| Dispersant | 0.07 | 0.1 |
| Silicone fluid | 0.80 | 0.80 |
| Trisodium citrate | 14.00 | 15.00 |
| Citric acid | 3.00 | 2.50 |
| Zeolite | 32.50 | 32.10 |
| Maleic acid acrylic acid copolymer | 5.00 | 5.00 |
| Diethylene triamine penta methylene phosphonic acid | 1.00 | 0.20 |
| Protease | 0.1 | 0.01 |
| Lipase | 0.36 | 0.40 |
| Amylase | 0.30 | 0.30 |
| Sodium silicate | 2.00 | 2.50 |
| Sodium sulphate | 3.50 | 5.20 |
| Polyvinyl pyrrolidone | 0.30 | 0.50 |
| Perborate | 0.5 | 1 |
| TAED | 1.0 | — |
| NOBS | — | 1.0 |
| Organic Catalyst | 0.1 | 1 |
| Phenol sulphonate | 0.1 | — |
| Peroxidase | 0.1 | 0.1 |
| Minors | Up to 100 | Up to 100 |

Example X

Granular Fabric Cleaning Compositions

| | Example No. | |
|---|---|---|
| Components | A | B |
| Sodium linear $C_{12}$ alkyl benzene-sulfonate | 6.5 | 8.0 |
| Sodium sulfate | 15.0 | 18.0 |
| Zeolite A | 26.0 | 22.0 |
| Sodium nitrilotriacetate | 5.0 | 5.0 |
| Polyvinyl pyrrolidone | 0.5 | 0.7 |
| TAED | 3.0 | — |
| NOBS | — | 2.4 |
| Organic Catalyst | 1 | 0.5 |
| Boric acid | 4.0 | — |
| Perborate | 0.5 | 1 |
| Phenol sulphonate | 0.1 | — |
| Protease | 0.02 | 0.05 |
| Fillers (e.g., silicates; carbonates; perfumes; water) | Up to 100 | Up to 100 |

Example XI

Compact Granular Fabric Cleaning Composition

| Components | Weight % |
|---|---|
| Alkyl Sulphate | 8.0 |
| Alkyl Ethoxy Sulphate | 2.0 |
| Mixture of C25 and C45 alcohol 3 and 7 times ethoxylated | 6.0 |
| Polyhydroxy fatty acid amide | 2.5 |
| Zeolite | 17.0 |
| Layered silicate/citrate | 16.0 |
| Carbonate | 7.0 |

-continued

| Components | Weight % |
|---|---|
| Maleic acid acrylic acid copolymer | 5.0 |
| Soil release polymer | 0.4 |
| Carboxymethyl cellulose | 0.4 |
| Poly (4-vinylpyridine)-N-oxide | 0.1 |
| Copolymer of vinylimidazole and vinylpyrrolidone | 0.1 |
| PEG2000 | 0.2 |
| Protease | 0.03 |
| Lipase | 0.2 |
| Cellulase | 0.2 |
| TAED | 6.0 |
| Percarbonate | 22.0 |
| Organic Catalyst | 0.1 |
| Ethylene diamine disuccinic acid | 0.3 |
| Suds suppressor | 3.5 |
| Disodium-4,4'-bis (2-morpholino-4-anilino-s-triazin-6-ylamino) stilbene-2,2'-disulphonate | 0.25 |
| Disodium-4,4'-bis (2-sulfostyril) biphenyl | 0.05 |
| Water, Perfume and Minors | Up to 100 |

Example XII

Granular Fabric Cleaning Composition

| Component | Weight % |
|---|---|
| Linear alkyl benzene sulphonate | 7.6 |
| $C_{16}$–$C_{18}$ alkyl sulfate | 1.3 |
| $C_{14-15}$ alcohol 7 times ethoxylated | 4.0 |
| Coco-alkyl-dimethyl hydroxyethyl ammonium chloride | 1.4 |
| Dispersant | 0.07 |
| Silicone fluid | 0.8 |
| Trisodium citrate | 5.0 |
| Zeolite 4A | 15.0 |
| Maleic acid acrylic acid copolymer | 4.0 |
| Diethylene triamine penta methylene phosphonic acid | 0.4 |
| Perborate | 15.0 |
| TAED | 5.0 |
| Organic Catalyst | 2 |
| Smectite clay | 10.0 |
| Poly (oxy ethylene) (MW 300,000) | 0.3 |
| Protease | 0.02 |
| Lipase | 0.2 |
| Amylase | 0.3 |
| Cellulase | 0.2 |
| Sodium silicate | 3.0 |
| Sodium carbonate | 10.0 |
| Carboxymethyl cellulose | 0.2 |
| Brighteners | 0.2 |
| Water, perfume and minors | Up to 100 |

Example XIII

Granular Fabric Cleaning Composition

| Component | Weight % |
|---|---|
| Linear alkyl benzene sulfonate | 6.92 |
| Tallow alkyl sulfate | 2.05 |
| $C_{14-15}$ alcohol 7 times ethoxylated | 4.4 |
| $C_{12-15}$ alkyl ethoxy sulfate - 3 times ethoxylated | 0.16 |
| Zeolite | 20.2 |
| Citrate | 5.5 |
| Carbonate | 15.4 |
| Silicate | 3.0 |
| Maleic acid acrylic acid copolymer | 4.0 |
| Carboxymethyl cellulase | 0.31 |
| Soil release polymer | 0.30 |

-continued

| Component | Weight % |
|---|---|
| Protease | 0.1 |
| Lipase | 0.36 |
| Cellulase | 0.13 |
| Perborate tetrahydrate | 11.64 |
| Perborate monohydrate | 8.7 |
| TAED | 5.0 |
| Organic Catalyst | 0.05 |
| Diethylene triamine penta methyl phosphonic acid | 0.38 |
| Magnesium sulfate | 0.40 |
| Brightener | 0.19 |
| Perfume, silicone, suds suppressors | 0.85 |
| Minors | Up to 100 |

Example XIV

Granular Fabric Cleaning Composition

| Component | A | B | C |
|---|---|---|---|
| Base Granule Components | | | |
| LAS/AS/AES (65/35) | 9.95 | — | — |
| LAS/AS/AES (70/30) | — | 12.05 | 7.70 |
| Alumino silicate | 14.06 | 15.74 | 17.10 |
| Sodium carbonate | 11.86 | 12.74 | 13.07 |
| Sodium silicate | 0.58 | 0.58 | 0.58 |
| NaPAA Solids | 2.26 | 2.26 | 1.47 |
| PEG Solids | 1.01 | 1.12 | 0.66 |
| Brighteners | 0.17 | 0.17 | 0.11 |
| DTPA | — | — | 0.70 |
| Sulfate | 5.46 | 6.64 | 4.25 |
| DC-1400 Deaerant | 0.02 | 0.02 | 0.02 |
| Moisture | 3.73 | 3.98 | 4.33 |
| Minors | 0.31 | 0.49 | 0.31 |
| B.O.T. Spray-on | | | |
| Nonionic surfactant | 0.50 | 0.50 | 0.50 |
| Agglomerate Components | | | |
| LAS/AS (25/75) | 11.70 | 9.60 | 10.47 |
| Alumino silicate | 13.73 | 11.26 | 12.28 |
| Carbonate | 8.11 | 6.66 | 7.26 |
| PEG 4000 | 0.59 | 0.48 | 0.52 |
| Moisture/Minors | 4.88 | 4.00 | 4.36 |
| Functional Additives | | | |
| Sodium carbonate | 7.37 | 6.98 | 7.45 |
| Perborate | 1.03 | 1.03 | 2.56 |
| AC Base Coating | — | 1.00 | — |
| NOBS | — | — | 2.40 |
| Organic Catalyst | 1 | 0.001 | 0.01 |
| Soil release polymer | 0.41 | 0.41 | 0.31 |
| Cellulase | 0.33 | 0.33 | 0.24 |
| Protease | 0.1 | 0.05 | 0.15 |
| AE-Flake | 0.40 | 0.40 | 0.29 |
| Liquid Spray-on | | | |
| Perfume | 0.42 | 0.42 | 0.42 |
| Nonionic spray-on | 1.00 | 1.00 | 0.50 |
| Minors | Up to 100 | | |

Example XV

Granular Fabric Cleaning Composition

| | A | B |
|---|---|---|
| Surfactant | | |
| Na LAS | 6.40 | — |
| KLAS | — | 9.90 |
| AS/AE3S | 6.40 | 4.39 |
| TAS | 0.08 | 0.11 |
| C24AE5 | 3.48 | — |
| Genagen | — | 1.88 |
| N-cocoyl N-methyl glucamine (lin) | 1.14 | 2.82 |
| $C_{8-10}$ dimethyl hydroxyethyl ammonium chloride | 1.00 | 1.40 |
| Builder | | |
| Zeolite | 20.59 | 13.39 |
| SKS-6 | 10.84 | 10.78 |
| Citric Acid | 2.00 | — |
| Buffer | | |
| Carbonate | 9.60 | 12.07 |
| Bicarbonate | 2.00 | 2.00 |
| Sulphate | 2.64 | — |
| Silicate | 0.61 | 0.16 |
| Polymer | | |
| Acrylic acid/maleic acid copolymer (Na) | 1.17 | 1.12 |
| CMC | 0.45 | 0.24 |
| Polymer | 0.34 | 0.18 |
| Hexamethylene-diamine tetra-E24 ethoxylate, diquaternized with methyl chloride | 1.00 | 1.00 |
| Enzyme | | |
| Protease (% pure enzyme) | 0.03 | 0.03 |
| Cellulase | 0.26 | 0.26 |
| Amylase | 0.65 | 0.73 |
| Lipase | 0.27 | 0.15 |
| Bleach | | |
| TAED (100%) | 3.85 | 3.50 |
| Phenolsulfonate ester of N-nonanoyl-6-aminocaproic acid | — | 2.75 |
| Percarbonate | 16.20 | 18.30 |
| Organic Catalyst | 0.0005 | 3 |
| HEDP | 0.48 | 0.48 |
| EDDS | 0.30 | 0.30 |
| Miscellaneous | | |
| Malic particle | | 2.20 + bicarb |
| Brightener 15/49 | 0.077/0.014 | 0.07/0.014 |
| Zinc phthalocyanine sulfonate | 0.0026 | 0.0026 |
| Polydimethylsiloxane with trimethylsilyl end blocking units | 0.25 | 0.24 |
| Soap | — | 1.00 |
| Perfume | 0.45 | 0.55 |
| TOTAL | 100 | 100 |

Example XVI

Granular Fabric Cleaning Composition

| | A | B |
|---|---|---|
| Surfactant | | |
| NaLAS | 6.8 | 0.4 |
| KLAS | — | 10.9 |
| FAS | 0.9 | 0.1 |
| AS | 0.6 | 1.5 |
| C25AE3S | 0.1 | — |
| AE5 | 4.2 | — |
| N-Cocoyl-N-Methyl Glucamine | — | 1.8 |
| Genagen | — | 1.2 |
| $C_{8-10}$ dimethyl hydroxyethyl ammonium chloride | — | 1.0 |
| Builder | | |
| SKS-6 | 3.3 | 9.0 |
| Zeolite | 17.2 | 18.9 |
| Citric Acid | 1.5 | — |
| Buffer | | |
| Carbonate | 21.1 | 15.0 |
| Sodium Bicarbonate | — | 2.6 |
| Sulphate | 15.2 | 5.5 |
| Malic Acid | — | 2.9 |
| Silicate | 0.1 | — |
| Polymer | | |
| Acrylic acid/maleic acid copolymer (Na) | 2.2 | 0.9 |
| Hexamethylene-diamine tetra-E24 ethoxylate, diquaternized with methyl chloride | 0.5 | 0.7 |
| Polymer | 0.1 | 0.1 |
| CMC | 0.2 | 0.1 |
| Enzymes | | |
| Protease (% pure enzyme) | 0.02 | 0.05 |
| Lipase | 0.18 | 0.14 |
| Amylase | 0.64 | 0.73 |
| Cellulase | 0.13 | 0.26 |
| Bleach | | |
| TAED | 2.2 | 2.5 |
| Phenolsulfonate ester of N-nonanoyl-6-aminocaproic acid | — | 1.96 |
| Sodium Percarbonate | — | 13.1 |
| PB4 | 15.6 | — |
| Organic Catalyst | 1 | 0.5 |
| EDDS | 0.17 | 0.21 |
| MgSO4 | 0.35 | 0.47 |
| HEDP | 0.15 | 0.34 |
| Brightener | 0.06 | 0.04 |
| - Zinc phthalocyanine sulfonate | 0.0015 | 0.0020 |
| - Polydimethylsiloxane with trimethylsilyl end blocking units | 0.04 | 0.14 |
| Soap | 0.5 | 0.7 |
| Perfume | 0.35 | 0.45 |
| Speckle | 0.5 | 0.6 |

Examples XVII

Granular laundry detergent compositions XVII A–C in accordance with the present invention are of particular utility under European machine wash conditions:

| Component | A | B | C |
|---|---|---|---|
| LAS | 7.0 | 5.61 | 4.76 |
| TAS | — | — | 1.57 |

-continued

| Component | A | B | C |
|---|---|---|---|
| C45AS | 6.0 | 2.24 | 3.89 |
| C25E3S | 1.0 | 0.76 | 1.18 |
| C45E7 | — | — | 2.0 |
| C25E3 | 4.0 | 5.5 | — |
| QAS | 0.8 | 2.0 | 2.0 |
| STPP | — | — | — |
| Zeolite A | 25.0 | 19.5 | 19.5 |
| Citric acid | 2.0 | 2.0 | 2.0 |
| NaSKS-6 | 8.0 | 10.6 | 10.6 |
| Carbonate I | 8.0 | 10.0 | 8.6 |
| MA/AA | 1.0 | 2.6 | 1.6 |
| CMC | 0.5 | 0.4 | 0.4 |
| PB4 | — | 12.7 | — |
| Percarbonate | — | — | 19.7 |
| TAED | — | 3.1 | 5.0 |
| Organic Catalyst | 10 | 0.04 | 3 |
| Citrate | 7.0 | — | — |
| DTPMP | 0.25 | 0.2 | 0.2 |
| HEDP | 0.3 | 0.3 | 0.3 |
| QEA 1 | 0.9 | 1.2 | 1.0 |
| Protease | 0.02 | 0.05 | 0.035 |
| Lipase | 0.15 | 0.25 | 0.15 |
| Cellulase | 0.28 | 0.28 | 0.28 |
| Amylase | 0.4 | 0.7 | 0.3 |
| PVPI/PVNO | 0.4 | — | 0.1 |
| Photoactivated bleach (ppm) | 15 ppm | 27 ppm | 27 ppm |
| Brightener 1 | 0.08 | 0.19 | 0.19 |
| Brightener 2 | — | 0.04 | 0.04 |
| Perfume | 0.3 | 0.3 | 0.3 |
| Effervescent granules (malic acid 40%, sodium bicarbonate 40%, sodium carbonate 20%) | 15 | 15 | 5 |
| Silicone antifoam | 0.5 | 2.4 | 2.4 |
| Minors/inerts to 100% | | | |

Example XVIII

The following formulations are examples of compositions in accordance with the invention, which may be in the form of granules or in the form of a tablet.

| Component | 14 |
|---|---|
| C45 AS/TAS | 3.0 |
| LAS | 8.0 |
| C25AE3S | 1.0 |
| NaSKS-6 | 9.0 |
| C25AE5/AE3 | 5.0 |
| Zeolite A | 10.0 |
| SKS-6 (I) (dry add) | 2.0 |
| MA/AA | 2.0 |
| Citric acid | 1.5 |
| EDDS | 0.5 |
| HEDP | 0.2 |
| PB1 | 10.0 |
| NACA OBS | 2.0 |
| TAED | 2.0 |
| Organic Catalyst | 1 |
| Carbonate | 8.0 |
| Sulphate | 2.0 |
| Amylase | 0.3 |
| Lipase | 0.2 |
| Protease[1] | 0.02 |
| Minors (Brightener/SRP1/CMC/Photobleach/MgSO4/PVPVI/Suds suppressor/PEG) | 0.5 |
| Perfume | 0.5 |

Example XIX

Liquid Fabric Cleaning Compositions

| Component | Example No. A | Example No. B |
|---|---|---|
| $C_{12-14}$ alkenyl succinic acid | 3.0 | 8.0 |
| Citric acid monohydrate | 10.0 | 15.0 |
| Sodium $C_{12-15}$ alkyl sulphate | 8.0 | 8.0 |
| Sodium sulfate of $C_{12-15}$ alcohol 2 times ethoxylated | — | 3.0 |
| $C_{12-15}$ alcohol 7 times ethoxylated | — | 8.0 |
| $C_{12-15}$ alcohol 5 times ethoxylated | 8.0 | — |
| Diethylene triamine penta (methylene phosphonic acid) | 0.2 | — |
| Oleic acid | 1.8 | — |
| Ethanol | 4.0 | 4.0 |
| Propanediol | 2.0 | 2.0 |
| Protease | 0.01 | 0.02 |
| Suds suppressor | 0.15 | 0.15 |
| NaOH | up to pH 7.5 | |
| Perborate | 0.5 | 1 |
| Organic Catalyst | 0.01 | 0.5 |
| Phenol sulphonate | 0.1 | 0.2 |
| Peroxidase | 0.4 | 0.1 |
| Waters and minors | up to 100% | |

Example XX

Liquid Fabric Cleaning Compositions

| Component | Example No. 17 |
|---|---|
| NaLAS (100% am) | 16 |
| Neodol | 21.5 |
| EDDS | 1.2 |
| Dispersant | 1.3 |
| Perborate | 12 |
| Organic Catalyst | 0.1 |
| Phenolsulfonate ester of N-nonanoyl-6-aminocaproic acid | 6 |
| Protease (% pure enzyme) | 0.03 |
| Cellulase | 0.03 |
| Solvent (BPP) | 18.5 |
| Polymer | 0.1 |
| Carbonate | 10 |
| FWA 15 | 0.2 |
| $TiO_2$ | 0.5 |
| PEG 8000 | 0.4 |
| Perfume | 1.0–1.2 |
| Suds suppressor | 0.06 |
| Waters and minors | up to 100% |

Example XXI

Two-layer Effervescent Denture Cleansing Tablet

| Component | Example No. A | B | C | D |
|---|---|---|---|---|
| Acidic Layer | | | | |
| Protease | 1.0 | 1.5 | 0.01 | 0.05 |
| Tartaric acid | 24.0 | 24.0 | 24.00 | 24.00 |
| Sodium carbonate | 4.0 | 4.0 | 4.00 | 4.00 |
| Sulphamic acid | 10.0 | 10.0 | 10.00 | 10.00 |
| PEG 20,000 | 4.0 | 4.0 | 4.00 | 4.00 |
| Sodium bicarbonate | 24.5 | 24.5 | 24.50 | 24.50 |

-continued

| Component | Example No. A | B | C | D |
|---|---|---|---|---|
| Potassium persulfate | 15.0 | 15.0 | 15.00 | 15.00 |
| Sodium acid pyrophosphate | 7.0 | 7.0 | 7.00 | 7.00 |
| Pyrogenic silica | 2.0 | 2.0 | 2.00 | 2.00 |
| Tetracetylethylene diamine | 7.0 | 7.0 | 7.00 | 7.00 |
| Flavor | 1.0 | 1.0 | 1.00 | 1.00 |
| Alkaline Layer | | | | |
| Sodium perborate monohydrate | 32.0 | 32.0 | 32.00 | 32.00 |
| Organic Catalyst | 1 | 0.05 | 0.5 | 2 |
| Sodium bicarbonate | 19.0 | 19.0 | 19.00 | 19.00 |
| EDTA | 3.0 | 3.0 | 3.00 | 3.00 |
| Sodium tripolyphosphate | 12.0 | 12.0 | 12.00 | 12.00 |
| PEG 20,000 | 2.0 | 2.0 | 2.00 | 2.00 |
| Sodium carbonate | 2.0 | 2.0 | 2.00 | 2.00 |
| Pyrogenic silica | 2.0 | 2.0 | 2.00 | 2.00 |
| Dye/flavor | 2.0 | 2.0 | 2.00 | 2.00 |

Example XXII

Granular laundry detergent compositions XXII A–E are of particular utility under Japanese machine wash conditions and are prepared in accordance with the invention:

| Component | A | B | C | D | E |
|---|---|---|---|---|---|
| LAS | 23.57 | 23.57 | 21.67 | 21.68 | 21.68 |
| FAS | 4.16 | 4.16 | 3.83 | 3.83 | 3.83 |
| Nonionic surfactant | 3.30 | 3.30 | 2.94 | 3.27 | 3.27 |
| Bis (hydroxyethyl) methyl alkyl ammonium chloride | 0.47 | 0.47 | 1.20 | 1.20 | 1.20 |
| SKS-6 | 7.50 | 7.50 | 5.17 | 5.76 | 5.06 |
| Polyacrylate copolymer (MW 11000) (maleic/acrylate ratio of 4:6) | 7.03 | 7.03 | 14.36 | 14.36 | 14.36 |
| Zeolite | 11.90 | 11.40 | 10.69 | 11.34 | 11.34 |
| Carbonate | 14.90 | 14.82 | 11.71 | 11.18 | 11.18 |
| Silicate | 12.00 | 12.00 | 12.37 | 12.38 | 12.38 |
| Protease | 0.016 | 0.016 | 0.046 | 0.046 | 0.046 |
| Lipase | — | — | 0.28 | — | — |
| Amylase | — | — | 0.62 | — | — |
| Cellulase | — | — | 0.48 | — | 0.70 |
| NOBS | 3.75 | 3.75 | 2.70 | 2.70 | 2.70 |
| PB1 | 3.53 | — | 2.60 | — | — |
| Sodium percarbonate | — | 4.21 | — | 3.16 | 3.16 |
| Organic Catalyst | 0.1 | 0.01 | 2 | 5 | 0.5 |
| SRP | 0.52 | 0.52 | 0.70 | 0.70 | 0.70 |
| Brightener | 0.31 | 0.31 | 0.28 | 0.28 | 0.50 |
| AE-coflake | 0.17 | 0.20 | 0.17 | 0.17 | 0.17 |
| Polydimethylsiloxane | — | — | 0.68 | 0.68 | 0.68 |
| Perfume | 0.06 | 0.06 | 0.08 | — | — |
| Perfume | — | — | — | 0.23 | 0.23 |
| Hydrophobic precipitated silica | 0.30 | 0.30 | 0.30 | 0.30 | 0.30 |
| PEG4000 | 0.19 | 0.19 | 0.17 | 0.17 | 0.17 |
| Minors/inerts to 100% | | | | | |

Example XXIII

Bleaching detergent compositions having the form of granular laundry detergents are exemplified by the following formulations.

| | A | B | C | D | E |
|---|---|---|---|---|---|
| Organic Catalyst | 0.05 | 0.01 | 0.13 | 0.04 | 0.07 |
| Conventional Activator (NOBS) | 0.00 | 2.00 | 1.20 | 0.70 | 0.00 |
| Conventional Activator (TAED) | 3.00 | 0.00 | 2.00 | 0.00 | 0.00 |
| Conventional Activator (NACA-OBS) | 3.00 | 0.00 | 0.00 | 0.00 | 2.20 |
| Sodium Percarbonate | 5.30 | 0.00 | 0.00 | 4.00 | 0.00 |
| Sodium Perborate Monohydrate | 0.00 | 5.30 | 3.60 | 0.00 | 4.30 |
| Linear Alkylbenzenesulfonate | 12.00 | 0.00 | 12.00 | 0.00 | 21.00 |
| C45AE0.6S | 0.00 | 15.00 | 0.00 | 15.00 | 0.00 |
| C2 Dimethylamine N-Oxide | 0.00 | 2.00 | 0.00 | 2.00 | 0.00 |
| C12 Coco Amidopropyl Betaine | 1.50 | 0.00 | 1.50 | 0.00 | 0.00 |
| Palm N-Methyl Glucamide | 1.70 | 2.00 | 1.70 | 2.00 | 0.00 |
| C12 Dimethylhydro-xyethyl-ammonium Chloride AE23-6.5T | 1.50 | 0.00 | 1.50 | 0.00 | 0.00 |
| C25E3S | 2.50 | 3.50 | 2.50 | 3.50 | 1.00 |
| Sodium Tripolyphosphate | 4.00 | 0.00 | 4.00 | 0.00 | 0.00 |
| Zeolite A | 25.00 | 25.00 | 15.00 | 15.00 | 25.00 |
| Acrylic Acid/Maleic Acid Copolymer | 0.00 | 0.00 | 0.00 | 0.00 | 0.00 |
| Polyacrylic Acid, partially neutralized | 0.00 | 0.00 | 0.00 | 0.00 | 1.00 |
| Soil Release Agent | 3.00 | 3.00 | 3.00 | 3.00 | 0.00 |
| Carboxymethylcellulose | 0.00 | 0.00 | 0.50 | 0.40 | 0.00 |
| Sodium Carbonate | 0.40 | 0.40 | 0.40 | 0.40 | 0.40 |
| Sodium Silicate | 2.00 | 2.00 | 2.00 | 0.00 | 8.00 |
| Sodium Bicarbonate | 3.00 | 3.00 | 3.00 | 3.00 | 6.00 |
| Savinase (4T) | 5.00 | 5.00 | 5.00 | 5.00 | 5.00 |
| Termamyl (60T) | 1.00 | 1.00 | 1.00 | 1.00 | 0.60 |
| Lipolase (100T) | 0.40 | 0.40 | 0.40 | 0.40 | 0.40 |
| Carezyme(5T) | 0.12 | 0.12 | 0.12 | 0.12 | 0.12 |
| Diethylenetriaminepenta (methylenephosphonic Acid) | 0.15 | 0.15 | 0.15 | 0.15 | 0.15 |
| Brightener | 1.60 | 1.60 | 1.60 | 1.60 | 0.40 |
| Sulfonated Zinc Phthalocyanine Photobleach | 0.20 | 0.20 | 0.20 | 0.05 | 0.20 |
| $MgSO_4$ | 0.50 | 0.00 | 0.25 | 0.00 | 0.00 |
| $Na_2SO_4$ | 2.20 | 2.20 | 2.20 | 2.20 | 0.64 |
| | balance | balance | balance | balance | balance |

Any of the above compositions is used to launder fabrics at a concentration of 3500 ppm in water, 25° C., and a 15:1 water:cloth ratio. The typical pH is about 9.5 but can be can be adjusted by altering the proportion of acid to Na- salt form of alkylbenzenesulfonate.

Example XXIV

Bleaching detergent compositions having the form of granular laundry detergents are exemplified by the following formulations.

| | A | B | C | D | E |
|---|---|---|---|---|---|
| Organic Catalyst | 0.06 | 0.34 | 0.14 | 0.14 | 0.20 |
| Sodium Percarbonate | 5.30 | 0.00 | 0.00 | 0.00 | 0.00 |

-continued

| | A | B | C | D | E |
|---|---|---|---|---|---|
| Sodium Perborate Monohydrate | 0.00 | 9.00 | 17.60 | 9.00 | 9.00 |
| Linear Alkylbenzenesulfonate | 21.00 | 12.00 | 0.00 | 12.00 | 12.00 |
| C45AE0.6S | 0.00 | 0.00 | 15.00 | 0.00 | 0.00 |
| C2 Dimethylamine N-Oxide | 0.00 | 0.00 | 2.00 | 0.00 | 0.00 |
| C12 Coco Amidopropyl Betaine | 0.00 | 1.50 | 0.00 | 1.50 | 1.50 |
| Palm N-Methyl Glucamide | 0.00 | 1.70 | 2.00 | 1.70 | 1.70 |
| C12 Dimethylhydro-xyethylamm onium Chloride | 1.00 | 1.50 | 0.00 | 1.50 | 1.50 |
| AE23-6.5T | 0.00 | 2.50 | 3.50 | 2.50 | 2.50 |
| C25E3S | 0.00 | 4.00 | 0.00 | 4.00 | 4.00 |
| Conventional Activator (NOBS) | 0.00 | 0.00 | 0.00 | 1.00 | 0.00 |
| Conventional Activator (TAED) | 1.80 | 1.00 | 2.50 | 3.00 | 1.00 |
| Sodium Tripolyphosphate | 25.00 | 15.00 | 25.00 | 15.00 | 15.00 |
| Zeolite A | 0.00 | 0.00 | 0.00 | 0.00 | 0.00 |
| Acrylic Acid/ Maleic Acid Copolymer | 0.00 | 0.00 | 0.00 | 0.00 | 0.00 |
| Polyacrylic Acid, partially neutralized | 0.00 | 3.00 | 3.00 | 3.00 | 3.00 |
| Soil Release Agent | 0.30 | 0.50 | 0.00 | 0.50 | 0.50 |
| Carboxymethylcellulose | 0.00 | 0.40 | 0.40 | 0.40 | 0.40 |
| Sodium Carbonate | 0.00 | 2.00 | 2.00 | 2.00 | 2.00 |
| Sodium Silicate | 6.00 | 3.00 | 3.00 | 3.00 | 3.00 |
| Sodium Bicarbonate | 2.00 | 5.00 | 5.00 | 5.00 | 5.00 |
| Savinase (4T) | 0.60 | 1.00 | 1.00 | 1.00 | 1.00 |
| Termamyl (60T) | 0.40 | 0.40 | 0.40 | 0.40 | 0.40 |
| Lipolase (100T) | 0.12 | 0.12 | 0.12 | 0.12 | 0.12 |
| Carezyme(5T) | 0.15 | 0.15 | 0.15 | 0.15 | 0.15 |
| Diethylenetriaminepenta (methylenephosphonic Acid) | 0.40 | 0.00 | 1.60 | 0.00 | 0.00 |
| Brightener | 0.20 | 0.30 | 0.20 | 0.30 | 0.30 |
| Sulfonated Zinc Phthalocyanine Photobleach | 0.25 | 0.00 | 0.00 | 0.00 | 0.00 |
| $MgSO_4$ | 0.64 | 0.00 | 2.20 | 0.00 | 0.00 |
| $Na_2SO_4$ | balance | balance | balance | balance | balance |

Any of the above compositions is used to launder fabrics at a concentration of 3500 ppm in water, 25° C., and a 15:1 water:cloth ratio. The typical pH is about 9.5 but can be can be adjusted by altering the proportion of acid to Na-salt form of alkylbenzenesulfonate.

Example XXV

A bleaching detergent powder comprises the following ingredients:

| Component | Weight % |
|---|---|
| Organic Catalyst | 0.07 |
| TAED | 2.0 |
| Sodium Perborate Tetrahydrate | 10 |
| $C_{12}$ linear alkyl benzene sulfonate | 8 |
| Phosphate (as sodium tripolyphosphate) | 9 |
| Sodium carbonate | 20 |
| Talc | 15 |
| Brightener, perfume | 0.3 |
| Sodium Chloride | 25 |
| Water and Minors | Balance to 100% |

Example XXVI

A laundry bar suitable for hand-washing soiled fabrics is prepared by standard extrusion processes and comprises the following:

| Component | Weight % |
|---|---|
| Organic Catalyst | 0.2 |
| TAED | 1.7 |
| NOBS | 0.2 |
| Sodium Perborate Tetrahydrate | 12 |
| $C_{12}$ linear alkyl benzene sulfonate | 30 |
| Phosphate (as sodium tripolyphosphate) | 10 |
| Sodium carbonate | 5 |
| Sodium pyrophosphate | 7 |
| Coconut monoethanolamide | 2 |
| Zeolite A (0.1–10 micron) | 5 |
| Carboxymethylcellulose | 0.2 |
| Polyacrylate (m.w. 1400) | 0.2 |
| Brightener, perfume | 0.2 |
| Protease | 0.3 |
| $CaSO_4$ | 1 |
| $MgSO_4$ | 1 |
| Water | 4 |
| Filler[1] | Balance to 100% |

[1] Can be selected from convenient materials such as $CaCO_3$, talc, clay, silicates, and the like. Acidic fillers can be used to reduce pH.

Example XXVII

A laundry detergent composition suitable for machine use is prepared by standard methods and comprises the following composition:

| Component | Weight % |
|---|---|
| Organic Catalyst | 0.82 |
| TAED | 7.20 |
| Sodium Perborate Tetrahydrate | 9.2 |
| Sodium Carbonate | 23.74 |
| Anionic surfactant | 14.80 |
| Alumino Silicate | 21.30 |
| Silicate | 1.85 |
| Diethylenetriaminepentacetic acid | 0.43 |
| Polyacrylic acid | 2.72 |
| Brightener | 0.23 |
| Polyethylene glycol solids | 1.05 |
| Sulfate | 8.21 |
| Perfume | 0.25 |
| Water | 7.72 |
| Processing aid | 0.10 |
| Miscellaneous | 0.43 |

The composition is used to launder fabrics at a concentration in solution of about 1000 ppm at a temperature of 20–40° C. and a water to fabric ratio of about 20:1.

Example XXVIII

| Component | Weight % |
|---|---|
| Organic Catalyst | 1.0 |
| TAED | 10.0 |
| Sodium Perborate Tetrahydrate | 8.0 |
| Sodium Carbonate | 21.0 |
| Anionic surfactant | 12.0 |
| Alumino Silicate | 18.0 |
| Diethylenetriaminepentacetic acid | 0.3 |

-continued

| Component | Weight % |
|---|---|
| Nonionic surfactant | 0.5 |
| Polyacrylic acid | 2.0 |
| Brightener | 0.3 |
| Sulfate | 17.0 |
| Perfume | 0.25 |
| Water | 6.7 |
| Miscellaneous | 2.95 |

Example XXIX

A bleaching composition suitable for use in high suds phosphate geographies has the formula:

| Component | A (% wt) | B (% wt) |
|---|---|---|
| Organic Catalyst | 0.02 | 0.018 |
| NOBS | 1.90 | 2.00 |
| Sodium Perborate Tetrahydrate | 2.25 | 3.00 |
| Sodium Carbonate | 13.00 | 13.00 |
| Anionic surfactant | 19.00 | 19.00 |
| Cationic surfactant | 0.60 | 0.60 |
| Nonionic surfactant | — | 0.40 |
| Sodium Tripolyphosphate | 22.50 | 22.50 |
| Diethylenetriaminepentacetic acid | 0.90 | 0.90 |
| Acrylic acid/Maleic acid copolymer | 0.90 | 0.90 |
| Carboxymethylcellulose | 0.40 | 0.40 |
| Protease | 0.70 | 0.70 |
| Amylase | 0.36 | 0.36 |
| Cellulase | 0.35 | 0.35 |
| Brightener | 0.16 | 0.18 |
| Magnesium sulfate | 0.70 | 0.70 |
| Water | 3.0 | 1.0 |
| Sodium sulfate | Balance | Balance |

While particular embodiments of the subject invention have been described, it will be obvious to those skilled in the art that various changes and modifications of the subject invention can be made without departing from the spirit and scope of the invention. It is intended to cover, in the appended claims, all such modifications that are within the scope of the invention.

The composition is used as a laundry auxiliary for laundering fabrics at a concentration in solution of about 850 ppm at a temperature of 5–50° C and a water to fabric ratio of about 20:1.

The compositions of the present invention can be suitably prepared by any process chosen by the formulator, non-limiting examples of which are described in U.S. Pat. Nos. 5,691,297; 5,574,005; 5,569,645; 5,565,422; 5,516,448; 5,489,392; and 5,486,303.

In addition to the above examples, the bleaching compositions of the present invention can be formulated into any suitable laundry detergent composition, non-limiting examples of which are described in U.S. Pat. Nos. 5,679,630; 5,565,145; 5,478,489; 5,470,507; 5,466,802; 5,460,752; 5,458,810; 5,458,809; and 5,288,431.

Having described the invention in detail with reference to preferred embodiments and the examples, it will be clear to those skilled in the art that various changes and modifications may be made without departing from the scope of the invention and the invention is not to be considered limited to what is described in the specification.

SEQUENCE LISTING

<160> NUMBER OF SEQ ID NOS: 18

<210> SEQ ID NO 1
<211> LENGTH: 21
<212> TYPE: DNA
<213> ORGANISM: Aspergillus aculeatus

<400> SEQUENCE: 1 attcatttgt ggacagtgga c 21

<210> SEQ ID NO 2
<211> LENGTH: 20
<212> TYPE: DNA
<213> ORGANISM: Aspergillus aculeatus

<400> SEQUENCE: 2 gttgatcgca cattgaacca 20

<210> SEQ ID NO 3
<211> LENGTH: 20
<212> TYPE: DNA
<213> ORGANISM: Aspergillus aculeatus

<400> SEQUENCE: 3 accccagccg accgattgtc 20

<210> SEQ ID NO 4
<211> LENGTH: 20
<212> TYPE: DNA
<213> ORGANISM: Aspergillus aculeatus

<400> SEQUENCE: 4 cttccttacc tcaccatcat 20

<210> SEQ ID NO 5
<211> LENGTH: 20
<212> TYPE: DNA
<213> ORGANISM: Aspergillus aculeatus

<400> SEQUENCE: 5 ttaacatctt ttcaccatga 20

<210> SEQ ID NO 6
<211> LENGTH: 20
<212> TYPE: DNA
<213> ORGANISM: Aspergillus aculeatus

<400> SEQUENCE: 6 agctttccct tctctccctt 20

<210> SEQ ID NO 7
<211> LENGTH: 28
<212> TYPE: DNA
<213> ORGANISM: Aspergillus aculeatus

<400> SEQUENCE: 7 gccaccctgg cttccgctgc cagcctcc 28

<210> SEQ ID NO 8
<211> LENGTH: 20
<212> TYPE: DNA
<213> ORGANISM: Aspergillus aculeatus -continued

<400> SEQUENCE: 8 gacagtagca atccagcatt 20

<210> SEQ ID NO 9
<211> LENGTH: 20
<212> TYPE: DNA
<213> ORGANISM: Aspergillus aculeatus

<400> SEQUENCE: 9 agcatcagcc gctttgtaca 20

<210> SEQ ID NO 10
<211> LENGTH: 20
<212> TYPE: DNA
<213> ORGANISM: Aspergillus aculeatus

<400> SEQUENCE: 10 ccatgaagtt caccgtattg 20

<210> SEQ ID NO 11
<211> LENGTH: 20
<212> TYPE: DNA
<213> ORGANISM: Aspergillus aculeatus

<400> SEQUENCE: 11 gcactgcttc tctcccaggt 20

<210> SEQ ID NO 12
<211> LENGTH: 20
<212> TYPE: DNA
<213> ORGANISM: Aspergillus aculeatus

<400> SEQUENCE: 12 gtgggcggcc cctcaggcaa 20

<210> SEQ ID NO 13
<211> LENGTH: 20
<212> TYPE: DNA
<213> ORGANISM: Aspergillus aculeatus

<400> SEQUENCE: 13 acgctcctcc aattttctct 20

<210> SEQ ID NO 14
<211> LENGTH: 19
<212> TYPE: DNA
<213> ORGANISM: Aspergillus aculeatus

<400> SEQUENCE: 14 ggctggtagt aatgagtct 19

<210> SEQ ID NO 15
<211> LENGTH: 20
<212> TYPE: DNA
<213> ORGANISM: Aspergillus aculeatus

<400> SEQUENCE: 15 ggcgcagagt ttggccaggc 20

<210> SEQ ID NO 16
<211> LENGTH: 21
<212> TYPE: DNA

-continued

```
<213> ORGANISM: Aspergillus aculeatus

<400> SEQUENCE: 16

caacatcccc ggtgttctgg g                                                21


<210> SEQ ID NO 17
<211> LENGTH: 347
<212> TYPE: DNA
<213> ORGANISM: Aspergillus aculeatus

<400> SEQUENCE: 17

aaagattcat ttgtggacag tggacgttga tcgcacattg aaccaacccc agccgaccga      60

ttgtccttcc ttacctcacc atcatttaac atcttttcac catgaagctt tcccttctct     120

cccttgccac cctggcttcc gctgccagcc tccagcgccg cacacttctg cggtcagtgg     180

gataccgcca ccgccggtga cttcaccctg tacaacgacc tttggggcga gacggccggc     240

accggctccc agtgcactgg agtcgactcc tacagcggcg acaccatcgc ttgtcacacc     300

agcaggtcct ggtcggagta gcagcagcgt caagagctat gccaacg                   347


<210> SEQ ID NO 18
<211> LENGTH: 294
<212> TYPE: DNA
<213> ORGANISM: Aspergillus aculeatus

<400> SEQUENCE: 18

cagcatctcc attgagtaat cacgttggtg ttcggtggcc cgccgtgttg cgtggcggag      60

gctgccggga gacgggtggg gatggtggtg ggagagaatg tagggcgccg tgtttcagtc     120

cctaggcagg ataccggaaa accgtgtggt aggaggttta taggtttcca ggagacgctg     180

tataggggat aaatgagatt gaatggtggc cacactcaaa ccaaccaggt cctgtacata     240

caatgcatat accaattata cctaccaaaa aaaaaaaaaa aaaaaaaaaa aaaa           294
```

What is claimed is:

1. A bleaching composition comprising an organic catalyst compound, in conjunction with or without a peroxygen source, wherein said organic catalyst compound is selected from the group consisting of organic catalyst compounds that exhibit an organic catalyst lifetime greater than or equal to 30 minutes, said organic catalyst compounds being aryliminium zwitterions having a net charge of from about +3 to about −3, and being represented by the formula [II]:

[II]

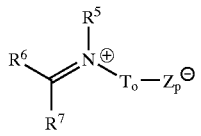

where $R^5$–$R^7$ are independently selected from substituted or unsubstituted radicals selected from the group consisting of H, alkyl, cycloalkyl, aryl, alkaryl, aralkyl, heterocyclic ring, silyl, nitro, halo, cyano, sulfonato, alkoxy, keto, carboxylic, and carboalkoxy radicals; also present in this formula is the radical represented by the formula:

$$—T_o—Z_p^{\ominus}$$

where $Z_p^-$ is covalently bonded to $T_o$, and $Z_p^-$ is selected from the group consisting of $—CO_2^-$, $—SO_3^-$, $—OSO_3^-$, $—SO_2^-$ and $—OSO_2^-$ and p is either 1, 2 or 3; $T_o$ is selected from the group consisting of substituted or unsubstituted, saturated or unsaturated alkyl, cycloalkyl, aryl, alkaryl, aralkyl and heterocyclic ring, provided $T_o$ is not substituted or unsubstituted methylene or a moiety that is covalently bonded to the nitrogen of formula II via unsubstituted methylene.

2. The bleaching composition according to claim 1 wherein said organic catalyst compound is selected from the group consisting of organic catalyst compounds that exhibit an organic catalyst lifetime greater than or equal to 45 minutes.

3. The bleaching composition according to claim 1 wherein said organic catalyst compound is selected from the group consisting of organic catalyst compounds that exhibit an organic catalyst lifetime greater than or equal to 60 minutes.

4. The bleaching composition according to claim 1 wherein said organic catalyst compound is selected from the group consisting of organic catalyst compounds that exhibit an organic catalyst lifetime greater than or equal to 90 minutes.

5. The bleaching composition according to claim 1 wherein said organic catalyst compound is selected from the group consisting of organic catalyst compounds that exhibit an organic catalyst lifetime greater than or equal to 2 hours.

6. The bleaching composition according to claim 1 wherein said organic catalyst compound is selected from the group consisting of:

aryliminium zwitterions having a net charge of from about +3 to about −3 are represented by the formula [XII]:

[XII]

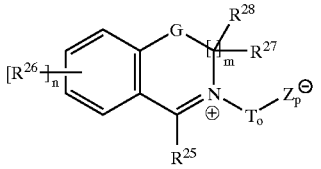

where m is 1 to 3 when G is present and m is 1 to 4 when G is not present; and n is an integer from 0 to 4; each $R^{26}$ is independently selected from a substituted or unsubstituted radical selected from the group consisting of H, alkyl, cycloalkyl, aryl, fused aryl, heterocyclic ring, fused heterocyclic ring, nitro, halo, cyano, sulfonato alkoxy, keto, carboxylic, and carboalkoxy radicals, and any two vicinal $R^{26}$ substituents may combine to form a fused aryl, fused carbocyclic or fused heterocyclic ring; $R^{25}$ may be a substituted or unsubstituted radical selected from the group consisting of H, alkyl, cycloalkyl, alkaryl, aryl, aralkyl, heterocyclic ring, silyl, nitro, halo, cyano, sulfonato, alkoxy, keto, carboxylic, and carboalkoxy radicals; also present in this formula is the radical represented by the formula:

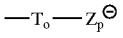

where $Z_p^-$ is covalently bonded to $T_o$, and $Z_p^-$ is selected from the group consisting of $—CO_2^-$, $—SO_3—$, $—OSO_3^-$, $—SO_2^-$ and $—OSO_2^-$ and p is either 1, 2 or 3; $T_o$ is selected from the group consisting of:

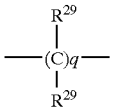

wherein q is an integer from 2 to 8; $R^{29}$ is independently selected from substituted or unsubstituted radicals selected from the group consisting of linear or branched H, alkyl, cycloalkyl, alkaryl, aryl, aralkyl, alkylene, heterocyclic ring, alkoxy, arylcarbonyl, carboxyalkyl and amide groups, provided that all $R^{29}$ groups are not independently selected to be; G is selected from the group consisting of: (1) —O—; (2) $—N(R^{30})—$; and (3) $—N(R^{30}R^{31})—$; $R^{27}$, $R^{28}$, $R^{30}$ and $R^{31}$ are substituted or unsubstituted radicals independently selected from the group consisting of H, oxygen, alkyl, cycloalkyl, alkaryl, aryl, aralkyl, alkylenes, heterocyclic ring, alkoxys, arylcarbonyl groups, carboxyalkyl groups and amide groups; any of $R^{25}$, $R^{26}$, $R^{27}$, $R^{28}$, $R^{30}$ and $R^{31}$ may be joined together with any other of $R^{25}$, $R^{26}$, $R^{27}$, $R^{28}$, $R^{30}$ and $R^{31}$ to form part of a common ring; any geminal $R^{27}$–$R^{28}$ may combine to form a carbonyl; any vicinal $R^{27}$–$R^{31}$ may join to form unsaturation; and wherein any one group of substituents $R^{27}$–$R^{31}$ may combine to form a substituted or unsubstituted fused unsaturated moiety.

7. The bleaching composition according to claim 6 wherein said organic catalyst compound is selected from the group consisting of:

aryliminium zwitterions having a net charge of from about +3 to about −3, as represented by the formula [XII], where $R^{25}$ is H or methyl, $Z_p^-$ is $—CO_2^-$, $—SO_3^-$ or $—OSO_3^-$, and p is 1 or 2.

8. The bleaching composition according to claim 1 wherein said organic catalyst compound comprises from about 0.0001% to about 10% by weight of said composition, and said peroxygen source, when present, comprises from about 0.01% to about 60% by weight of said composition.

9. The bleaching composition according to claim 8 wherein said organic catalyst compound comprises from about 0.01% to about 0.5% by weight of said composition.

10. The bleaching composition according to claim 1 wherein said peroxygen source, when present, is selected from the group consisting of:

(a) preformed peracid compounds selected from the group consisting of percarboxylic acids and salt, percarbonic acids and salts, perimidic acids and salts, peroxymonosulfuric acids and salts, and mixtures thereof; and (b) hydrogen peroxide sources selected from the group consisting of perborate compounds, percarbonate compounds, perphosphate compounds and mixtures thereof; and a bleach activator.

11. The bleaching composition according to claim 10 wherein said peroxygen source is a hydrogen peroxide sources selected from the group consisting of perborate compounds, percarbonate compounds, perphosphate compounds and mixture whereof; and a bleach activator.

12. The bleaching composition according to claim 10 wherein said bleach activator is selected from the group consisting of: tetraacetyl ethylene diamine (TAED); benzoylcaprolactam (BzCL); 4-nitrobenzoylcaprolactam, 3-chlorobenzoylcaprolactam; benzoyloxybenzenesulphonate (BOBS); nonanoyloxybenzenesulphonate (NOBS); phenyl benzoate (PhBz); decanoyloxybenzenesulphonate ($C_{10}$-OBS); benzoylvalerolactam (BZVL); octanoyloxybenzenesulphonate ($C_8$-OBS); perhydrolyzable esters; 4-[N-(nonanoyl) amino hexanoyloxy]-benzene sulfonate sodium salt (NACA-OBS); lauroyloxybenzenesulfonate (LOBS or $C_{12}$-OBS); 10-undecenoyloxy benzenesulfonate (UDOBS); decanoyloxybenzoic acid (DOBA) and mixtures thereof.

13. The bleaching composition according to claim 1 wherein said bleaching compound further comprises one or more of the following detergent components selected from the group consisting of: surfactants, solvents, buffers, enzymes, soil release agents, clay soil removal agents, dispersing agents, brighteners, suds suppressors, fabric softeners, suds boosters, enzyme stabilizers, builders, chelants, other bleaching agents, dyes, dye transfer inhibiting agents, perfumes and mixtures thereof.

14. The bleaching composition according to claim 1 wherein said bleaching composition is a laundry detergent.

15. The bleaching composition according to claim 1 wherein said bleaching composition is a laundry additive.

16. The bleaching composition according to claim 15 wherein said laundry additive further includes a suitable carrier.

17. A method for laundering a fabric in need of laundering, said method comprises contacting said fabric with a laundry solution containing a bleaching composition according to claim 1.

18. A method according to claim 17 wherein the in-use concentration for said organic catalyst compound is about 0.01 ppm to about 10 ppm.

19. A method according to claim 18 wherein the in-use concentration for said organic catalyst compound is about 0.04 ppm to 2.5 ppm.

20. A method according to claim 19 wherein the in-use concentration for said organic catalyst compound is about 0.1 ppm to 1 ppm.

21. A product comprising a bleaching composition according to claim 1, the product further including instructions for using said compound to launder a fabric in need of laundering, the instructions including the step of contacting said fabric with a laundry solution containing the product.

22. An organic catalyst compound wherein said organic catalyst compound is selected from the group consisting of organic catalyst compounds that exhibit an organic catalyst lifetime greater than or equal to 30 minutes, wherein said organic catalyst compound is selected from the group consisting of:

aryliminium zwitterions, which have a net charge of from about +3 to about −3, that are represented by the formula [XII]:

[XII]

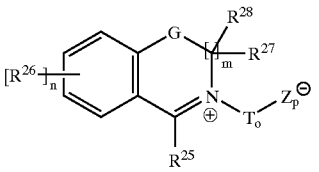

where m is 1 to 3 when G is present and m is 1 to 4 when G is not present; and n is an integer from 0 to 4; each $R^{26}$ is independently selected from a substituted or unsubstituted radical selected from the group consisting of H, alkyl, cycloalkyl, aryl, fused aryl, heterocyclic ring, fused heterocyclic ring, nitro, halo, cyano, sulfonato, alkoxy, keto, carboxylic, and carboalkoxy radicals, and any two vicinal $R^{26}$ substituents may combine to form a fused aryl, fused carbocyclic or fused heterocyclic ring; $R^{25}$ may be a substituted or unsubstituted radical selected from the group consisting of H, alkyl, cycloalkyl, alkaryl, aryl, aralkyl, heterocyclic ring, silyl, nitro, halo, cyano, sulfonato, alkoxy, keto, carboxylic, and carboalkoxy radicals; also present in this formula is the radical represented by the formula:

$$—T_o—Z_p^{\ominus}$$

where $Z_p^-$ is covalently bonded to $T_o$, and $Z_p^-$ is selected from the group consisting of $—CO_2^-$, $—SO_3^-$, $—OSO_3^-$, $—SO_2^-$ and $—OSO_2^-$ and p is either 1, 2 or 3; $T_o$ is selected from the group consisting of;

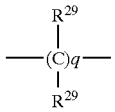

wherein q is an integer from 2 to 8; $R^{29}$ is independently selected from substituted or unsubstituted radicals selected from the group consisting of linear or branched H, alkyl, cycloalkyl, alkaryl, aryl, aralkyl, alkylene, heterocyclic ring, alkoxy, arylcarbonyl, carboxyalkyl and amide groups, provided that all $R^{29}$ groups are not independently selected to be H, provided $T_o$ is not a moiety that is covalently bonded to the nitrogen of formula XII via unsubstituted methylene; G is selected from the group consisting of: (1) —O—; (2) $—N(R^{30})—$; and (3) $—N(R^{30}R^{31})—$; $R^{27}$, $R^{28}$, $R^{30}$ and $R^{31}$ are substituted or unsubstituted radicals independently selected from the group consisting of H, oxygen, alkyl, cycloalkyl, alkaryl, aryl, aralkyl, alkylenes, heterocyclic ring, alkoxys, arylcarbonyl groups, carboxyalkyl groups and amide groups; any of $R^{25}$, $R^{26}$, $R^{27}$, $R^{28}$, $R^{30}$ and $R^{31}$ may be joined together with any other of $R^{25}$, $R^{26}$, $R^{27}$, $R^{28}$, $R^{30}$ and $R^{31}$ to form part of a common ring; any geminal $R^{27}$–$R^{28}$ may combine to form a carbonyl; any vicinal $R^{27}$–$R^{31}$ may join to form unsaturation; and wherein any one group of substituents $R^{27}$–$R^{31}$ may combine to form a substituted or unsubstituted fused unsaturated moiety.

23. The organic catalyst compound according to claim 22 wherein said organic catalyst exhibits an organic catalyst lifetime greater than 30 minutes.

24. The organic catalyst compound according to claim 22 wherein said organic catalyst exhibits an organic catalyst lifetime greater than 1 hours.

25. The organic catalyst compound according to claim 22 wherein said organic catalyst exhibits an organic catalyst lifetime greater than 2 hours.

* * * * *